US007806813B2

(12) United States Patent
Campitelli

(10) Patent No.: US 7,806,813 B2
(45) Date of Patent: Oct. 5, 2010

(54) EXERCISE MACHINE

(76) Inventor: Frank A. Campitelli, 970 E. Smith Rd., Medina, OH (US) 44256

( * ) Notice: Subject to any disclaimer, the term of this patent is extended or adjusted under 35 U.S.C. 154(b) by 0 days.

(21) Appl. No.: 12/410,927

(22) Filed: Mar. 25, 2009

(65) Prior Publication Data

US 2009/0181835 A1 Jul. 16, 2009

Related U.S. Application Data

(63) Continuation-in-part of application No. 10/971,752, filed on Oct. 22, 2004.

(60) Provisional application No. 60/513,504, filed on Oct. 22, 2003.

(51) Int. Cl.
*A63B 21/00* (2006.01)

(52) U.S. Cl. ..... 482/138; 482/92; 482/137

(58) Field of Classification Search ..... 482/92–101, 482/111–113, 133–139, 908, 72–73, 102–103
See application file for complete search history.

(56) References Cited

U.S. PATENT DOCUMENTS 4,226,415 A * 10/1980 Wright ..... 482/113
4,323,236 A * 4/1982 Szabo ..... 482/97
5,184,991 A * 2/1993 Brangi ..... 482/97
5,529,557 A * 6/1996 Barton ..... 482/95
5,730,686 A * 3/1998 Nilsson ..... 482/114
5,848,957 A * 12/1998 White et al. ..... 482/140
7,470,221 B1 * 12/2008 Ramos ..... 482/100
7,604,576 B2 * 10/2009 Drechsler ..... 482/99

* cited by examiner

*Primary Examiner*—Loan Thanh
*Assistant Examiner*—Oren Ginsberg
(74) *Attorney, Agent, or Firm*—Sand & Sebolt

(57) ABSTRACT

An exercise machine in one embodiment includes a frame, a pivot arm, an adapter mounted on the pivot arm to adjust between various adapter positions, and an operator engagement device mounted on the adapter to adjust between various engagement device positions. The adapter is typically telescopically mounted on the pivot arm to extend and retract along a first axis about which the adapter is also rotatable. The engagement device is typically telescopically mounted on the adapter to extend and retract along a second axis which is transverse to the first axis and about which the engagement device is rotatable. The embodiments may include a pivotal connection between the pivot arm and a generally T-shaped handle for positioning the handle and for enhancing the use of the handle. Handle extenders may be included to lengthen a typical T-shaped handle. Unique cable and pulley configurations are also disclosed.

20 Claims, 43 Drawing Sheets

EXERCISE MACHINE

CROSS REFERENCE TO RELATED APPLICATIONS

This application is a continuation-in-part of U.S. patent application Ser. No. 10/971,752, filed Oct. 22, 2004 which is a non-provisional application claiming priority from U.S. Provisional Application No. 60/513,504, filed Oct. 22, 2003, the contents of which applications are incorporated herein by reference.

BACKGROUND OF THE INVENTION

1. Technical Field

The invention relates to an improved exercise machine of the sort typically having a bench and/or standing platform for laying, sitting or standing upon during exercise. More particularly, the invention relates to such an exercise machine typically having a pivotable arm upon which the user imparts a force which is resisted by a resistance mechanism typically including a gas spring. Specifically, the invention relates to such an exercise machine which provides easily adjustable components which facilitate the formation of multiple configurations to better simulate the feel and range of motion of freeweight lifting and other sports activities.

2. Background Information

A great deal of exercise machines have been created in the past to enhance the interaction between the user and the machine. The well-known weightlifting bench has spawned numerous related bench-type exercise machines which simulate weightlifting or other types of movements wherein the user is able to move in a variety of ways while working against a force generally created by weights. For example, there are benches connected to pulleys with cables passing thereover having weights hanging at the other end. One of the drawbacks to benches utilizing weights is the necessity of incorporating the weights into the exercise machine. Such weights not only take up space but are inherently heavy and difficult to move around, thus tending to make such exercise machines more of a permanent stationary object as opposed to one which is movable with relative ease. In addition, the related apparatus for holding the weights takes up additional space. Moreover, the use of weights creates injury risks due to dropping them on some portion of the body. Alternately, a user may incur an injury from the lifting of weights and then be at additional risk by the fact that the weight must be lowered while the user is injured. In addition, a given exercise bench is typically limited to a single type of movement or a very limited number of such movements. Another problem that arises with such benches or similar exercise machines relates to the feel of the machine during operation.

BRIEF SUMMARY OF THE INVENTION

The present invention provides an exercise machine comprising: a frame; a pivot arm pivotally mounted on the frame about a pivot axis; a resistance mechanism mount configured for mounting thereon a resistance mechanism for resisting pivotal movement of the pivot arm; an adapter mounted on the pivot arm and selectively adjustable relative to the pivot arm between a plurality of adapter positions; a first securing mechanism for securing the adapter to the pivot arm at a selected one of the adapter positions; an operator engagement device mounted on the adapter and selectively adjustable relative to the adapter between a plurality of engagement device positions; and a second securing mechanism for securing the engagement device to the adapter at a selected one of the engagement device positions.

The present invention further provides an exercise machine comprising: a frame; a pivot arm; a first pivotal connection between the pivot arm and the frame; a resistance mechanism mount configured for mounting thereon a resistance mechanism for resisting pivotal movement of the pivot arm; a crossbar; a second pivotal connection between the crossbar and the pivot arm; and first and second segments on the crossbar extending outwardly from the second pivotal connection in opposite directions to form a generally T-shaped configuration with the pivot arm.

The present invention also provides an exercise machine comprising: a frame; a pivot arm; a first pivotal connection between the pivot arm and the frame; a resistance mechanism mount configured for mounting thereon a resistance mechanism for resisting pivotal movement of the pivot arm; a first leg; a crossbar comprising first and second segments extending outwardly from the first leg in opposite directions to form a generally T-shaped configuration with the first leg; a second pivotal connection between the first leg and the pivot arm whereby the crossbar is pivotably movable relative to the pivot arm to a plurality of locations; and a securing mechanism for securing the crossbar at a selected one of the locations.

DETAILED DESCRIPTION OF THE INVENTION

Figure 1:
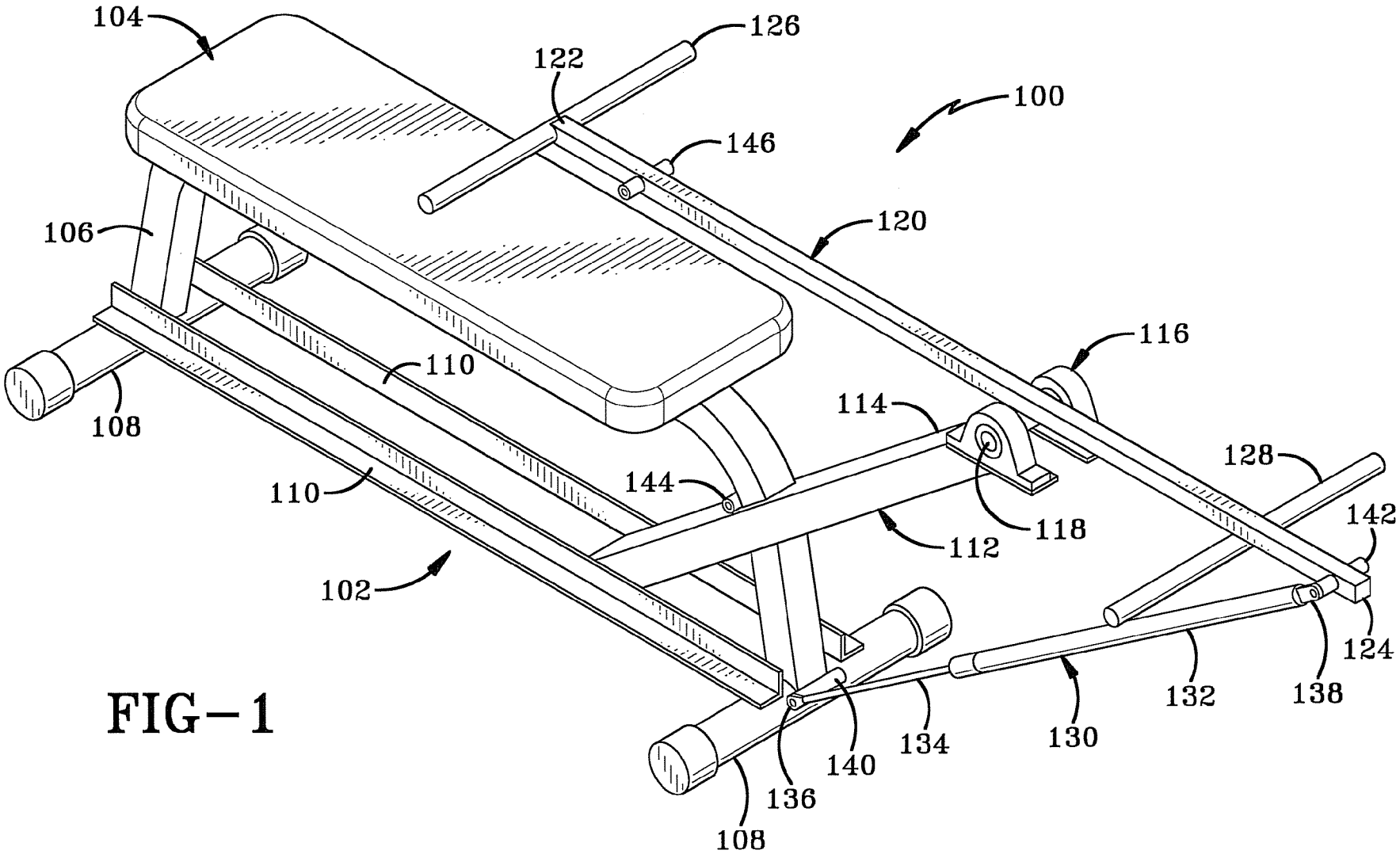
FIG. 1 is a perspective view of a first embodiment of the exercise machine of the present invention.
Figure 2:
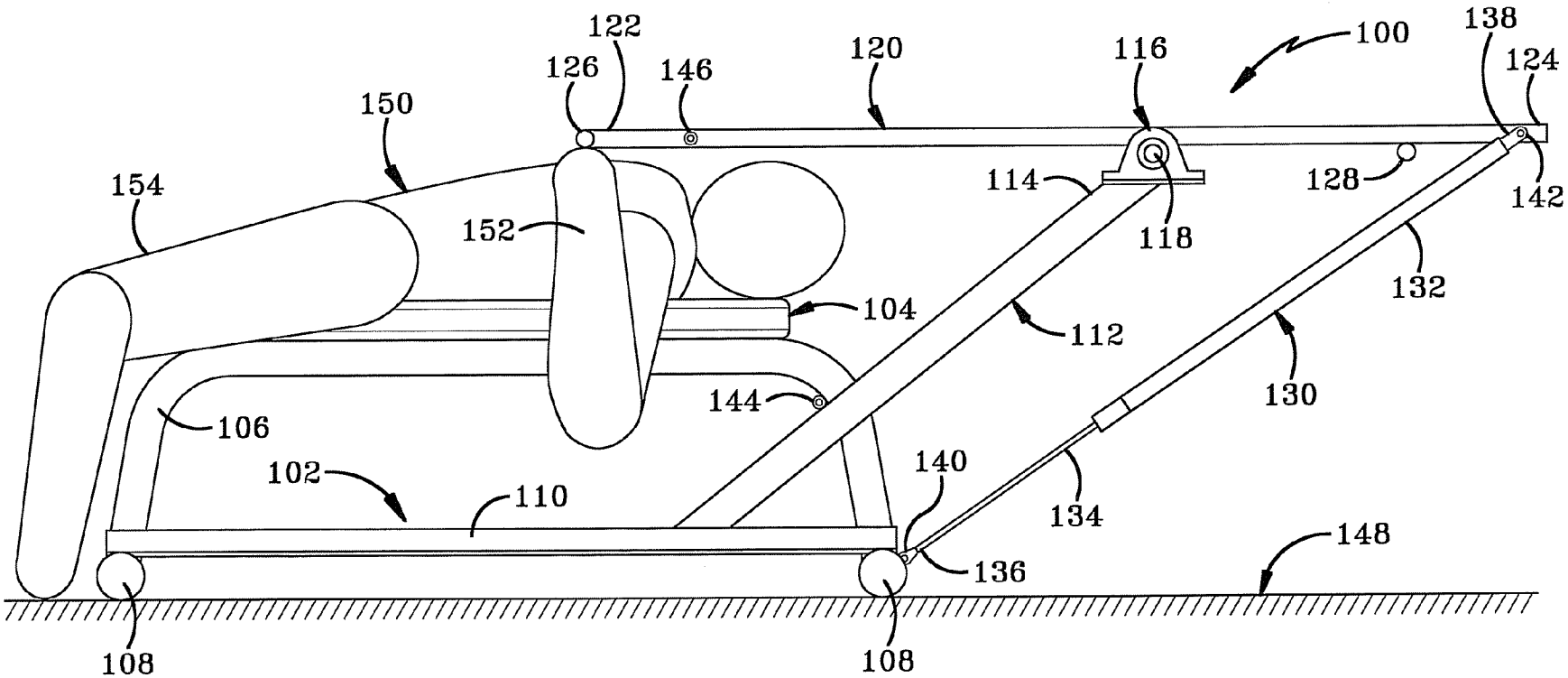
FIG. 2 is a side elevational view of the exercise machine showing a person laying on the bench with retracted or bent arms.
Figure 8:
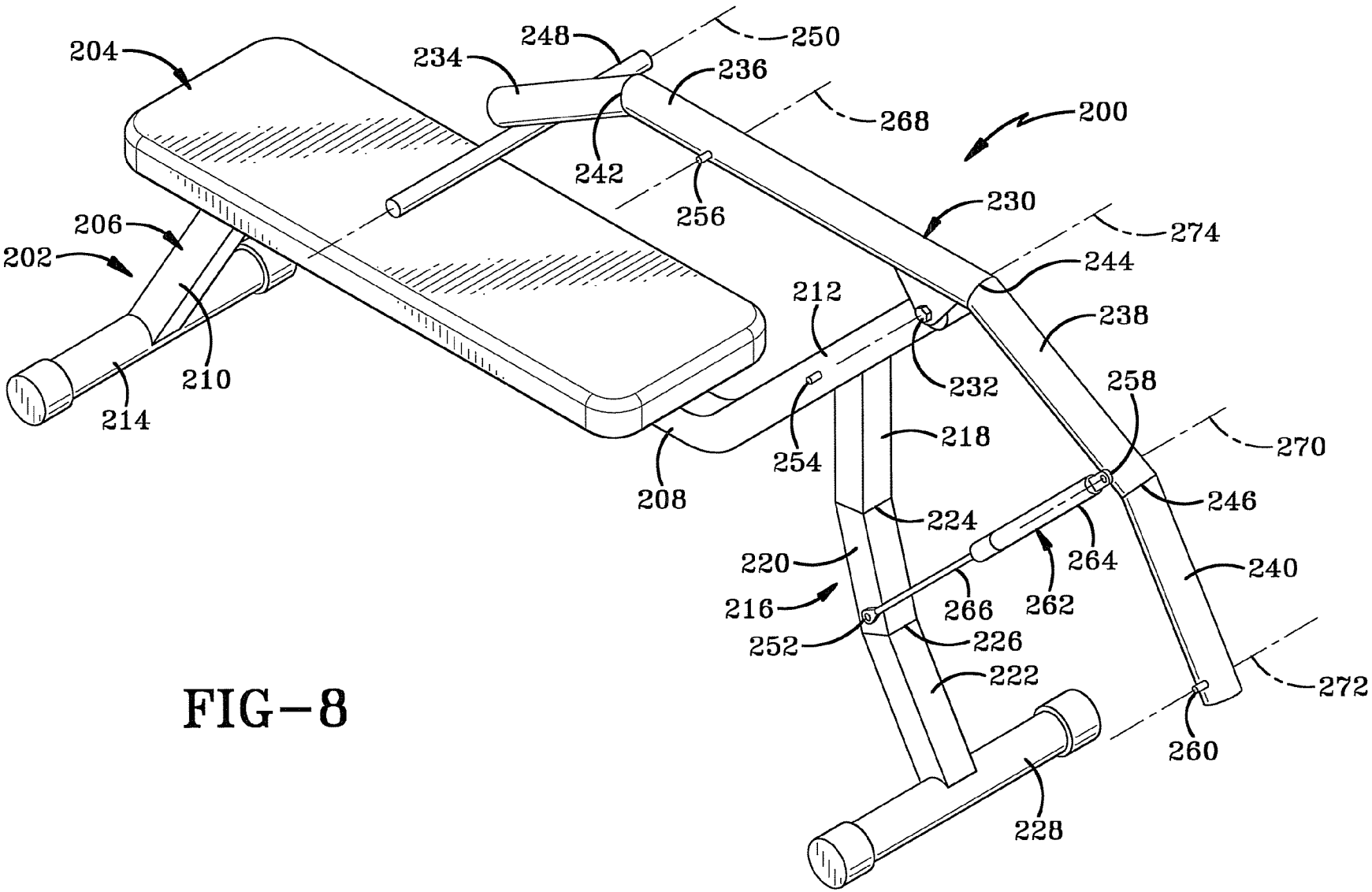
FIG. 8 is a perspective view of a second embodiment of the exercise machine of the present invention wherein the pivotable arm has several sections that are bent with respect to one another and wherein a support leg of the frame also has several sections bent with respect to one another.

The first embodiment of the exercise machine of the present invention is indicated generally at 100 and is shown particularly in FIGS. 1-2. A second embodiment is indicated generally at 200 in FIGS. 8-9. A third embodiment is indicated generally at 300 in FIGS. 17-18. A fourth embodiment is indicated generally at 500 in FIG. 28. A fifth embodiment is indicated generally at 600 in FIG. 29. A sixth embodiment is indicated generally at 700 and FIGS. 30-43 with additional attachments at FIGS. 44-47.

Exercise machine 100 includes a frame 102 with a user support in the form of a bench 104 sitting thereon. Frame 102 includes an inverted generally U-shaped member 106 to which bench 104 is connected. U-shaped member 106 is connected at its ends to a respective pair of horizontal feet 108 at a central location thereof. A pair of spaced angle irons 110 are situated parallel to one another and are attached to each foot 108 at respective ends of angle irons 110. The ends of angle irons 110 are connected to each foot 108 on opposite sides of U-shaped member 106. Frame 102 further includes a mounting arm 112 having a lower end disposed between and mounted to spaced angle irons 110. Mounting arm 112 is further mounted at an intermediate position to U-shaped member 106 as mounting arm 112 angles upwardly and outwardly from the lower end toward an opposed upper end 114 disposed outwardly and upwardly of bench 104. A trunnion 116 is mounted on upper end 114 of mounting arm 112 and includes a pivot pin 118 on which a pivotable member or arm 120 is pivotably mounted so that pivotable arm 120 pivots substantially in a vertical plane, although arm 120 may rotate in a different plane without departing from the spirit of the invention. Frame 102 has a length as measured in a horizontal direction which extends from the foot 108 distal mounting arm 112 (foot 108 to the left in the Figures) to upper end 114 of mounting arm 112.

Pivotable arm 120 includes a first end 122 and a second opposed end 124 defining a length extending therebetween. The length of pivotable arm 120 is roughly of the same order as the length of frame 102. The length of pivotable arm 120 far exceeds its cross sectional dimensions, as discussed later. When first end 122 is in a lowered position, it extends over bench 104. A handle 126 is connected to pivotable arm 120 at first end 122 and extends perpendicularly thereto. Similarly, a foot rest 128 is connected to pivotable arm 120 adjacent second end 124 and extends perpendicularly thereto.

In accordance with one of the main features of the present invention, a force producing mechanism in the form of a gas chamber 130 including a cylinder 132 and a piston rod 134 is pivotally connected adjacent a first end 136 of gas chamber 130 to frame 102 and further pivotally connected adjacent a second end 138 of gas chamber 130 to pivotable arm 120 adjacent second end 124 thereof. More particularly, gas chamber 130 is connected adjacent first end 136 to a mounting location in the form of a pivot mount 140 which is connected to one of feet 108. Gas chamber 130 is connected adjacent second end 138 at another mounting location in the form of a pivot mount 142 connected to pivotable arm 120. Most preferably, gas chamber 130 is a gas spring, although other force producing mechanisms may be used. Gas springs provide a resistance force which increases somewhat during compression, but the increase is substantially less than a piston-cylinder combination wherein the piston seals against the inner surface of the cylinder and thus creates a substantial pressure increase very quickly during compression. It has been found that gas springs are highly suited for use with the present invention.

In accordance with another one of the main features of the present invention, gas chamber 130 is removably mounted to pivot mounts 140 and 142 and there are a plurality of pivot mounts located on frame 102 and on pivotable arm 120 such that gas chamber 130 may be mounted at different locations to provide a different configuration suitable to different exercises which can be performed on exercise machine 100. In the embodiments shown, additional pivot mounts are shown at 144 mounted on frame 102 at the confluence of U-shaped member 106 and mounting arm 112 and also at 146 on pivotable arm 120 adjacent first end 122. With reference to FIGS. 2-7, machine 100 is shown sitting on a floor 148 with a person 150 sitting or laying atop bench 104. Person 150 has arms 152 and legs 154.

Figure 3:
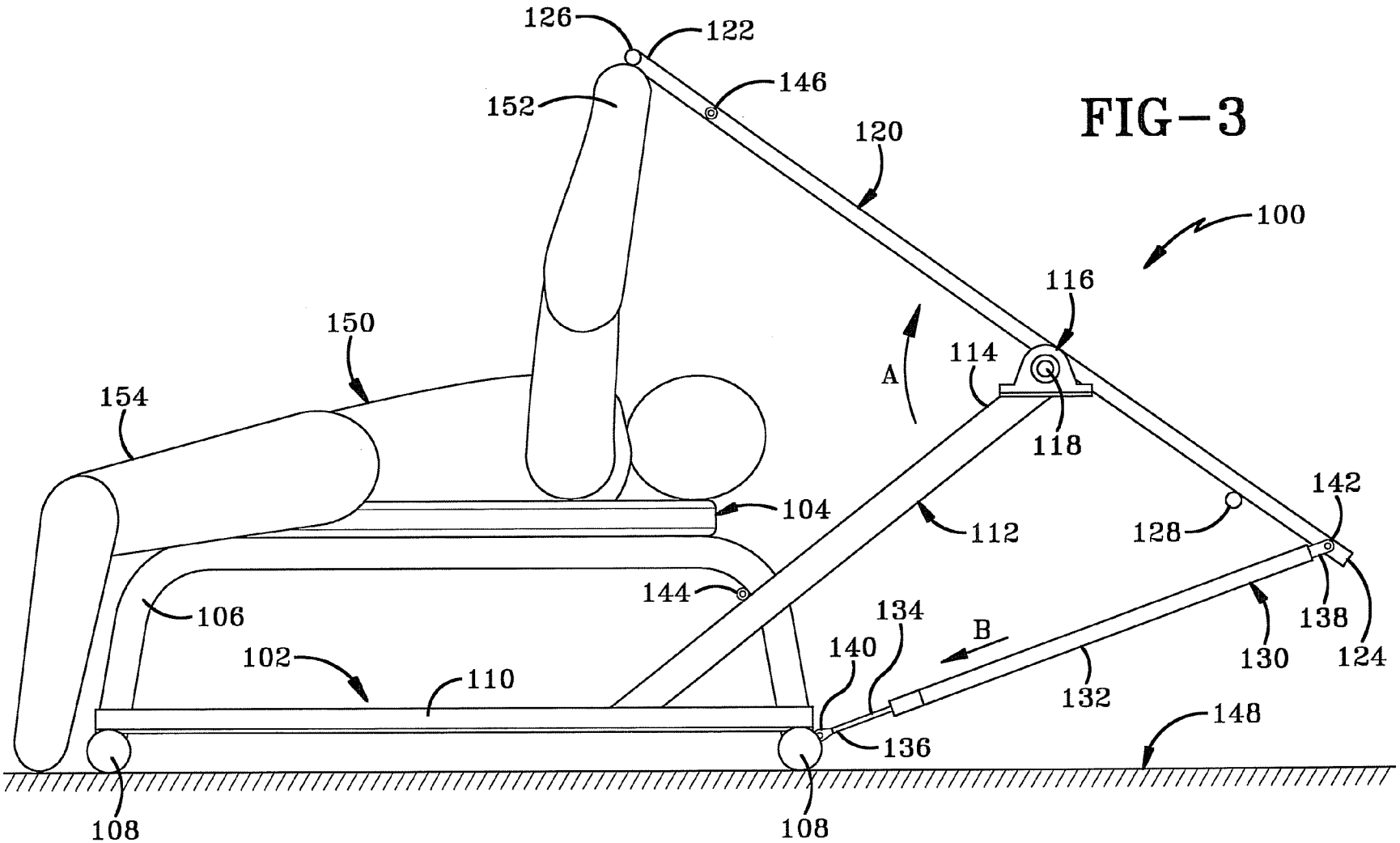
FIG. 3 is a figure similar to FIG. 2 except with the person's arm extended and the handle of the pivotable arm moved upwardly and the gas chamber undergoing compression.

In operation, and with continued reference to FIGS. 2-7, exercise machine 100 functions as follows. FIGS. 2-3 show one option for the use of exercise machine 100. In FIG. 2, person 150 is laying on bench 104 with arms 152 retracted in preparation to manipulate handle 126. Gas chamber 130 is connected as shown in FIG. 1 and described above, and is in an extended position in FIG. 2. FIG. 3 shows person 150 having extended arms 152 to push handle 126 upwardly, thereby pivoting pivotable arm 120 about pivot pin 118 in the direction shown by Arrow A whereby second end 124 of pivot member 120 is moved downwardly. In turn, cylinder 132 is moved toward a retracted position in the direction shown by Arrow B in FIG. 3. During this movement, gas chamber 130 pivots adjacent pivot mounts 142 on pivotable arm 120 and pivot mount 140 on frame 102. Thus, person 150 exerts upward force which is reacted by compression of gas within cylinder 132 of gas chamber 130. This compression of gas provides resistance against which person 150 exerts force in order to exercise. This basic concept is true of all of the embodiments in this application.

Figure 4:
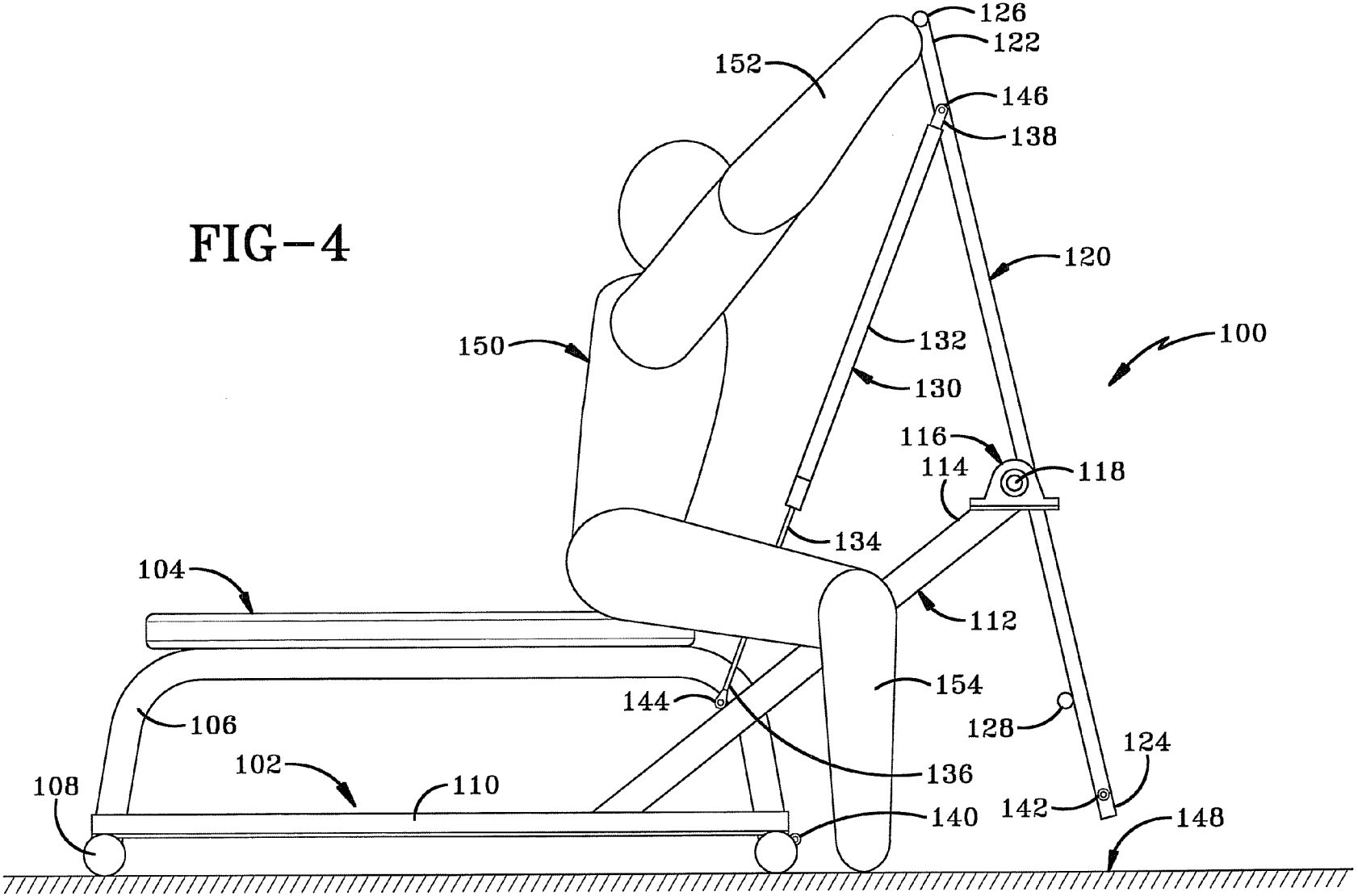
FIG. 4 is a side elevational view of the first embodiment with the gas chamber connected to the bench and the pivotable arm at different locations and a person sitting in an upright position on the bench with arms extended to the handle.
Figure 5:
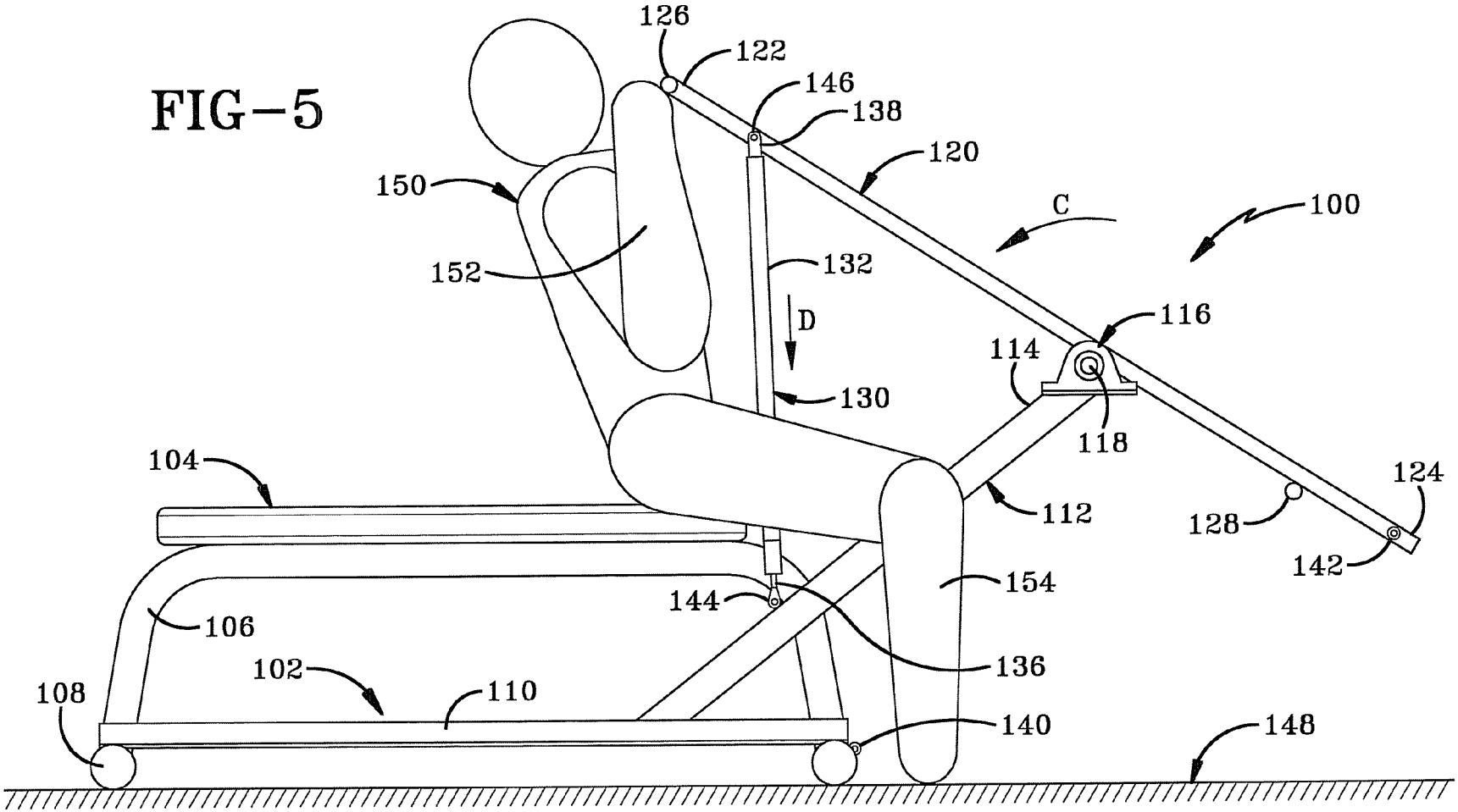
FIG. 5 is similar to FIG. 4 except that the person's arms are retracted to move the handle of the pivotable arm toward the person and compress the gas chamber.

FIGS. 4-5 show an alternate position for the use of gas chamber 130. In this alternate position, gas chamber 130 is connected adjacent first end 136 to pivot mount 144 on frame 102 and adjacent second end 138 and pivot mount 146 on pivotable arm 120. FIG. 4 shows person 150 sitting on bench 104 facing gas chamber 130 and pivotable arm 120 with arms 152 extended. FIG. 5 shows person 150 having retracted arms 152 toward themselves so that handle 126 is pulled downwardly and toward bench 104. Thus, pivotable arm 120 rotates about pivot pin 118 in the direction shown by Arrow C in FIG. 4, in turn compressing gas chamber 130 into a retracted position, cylinder 132 having moved in the direction of Arrow D in FIG. 4 while pivotal movement adjacent first end 136 and first end 138 has occurred as in the previous option shown in FIGS. 2-3.

Figure 6:
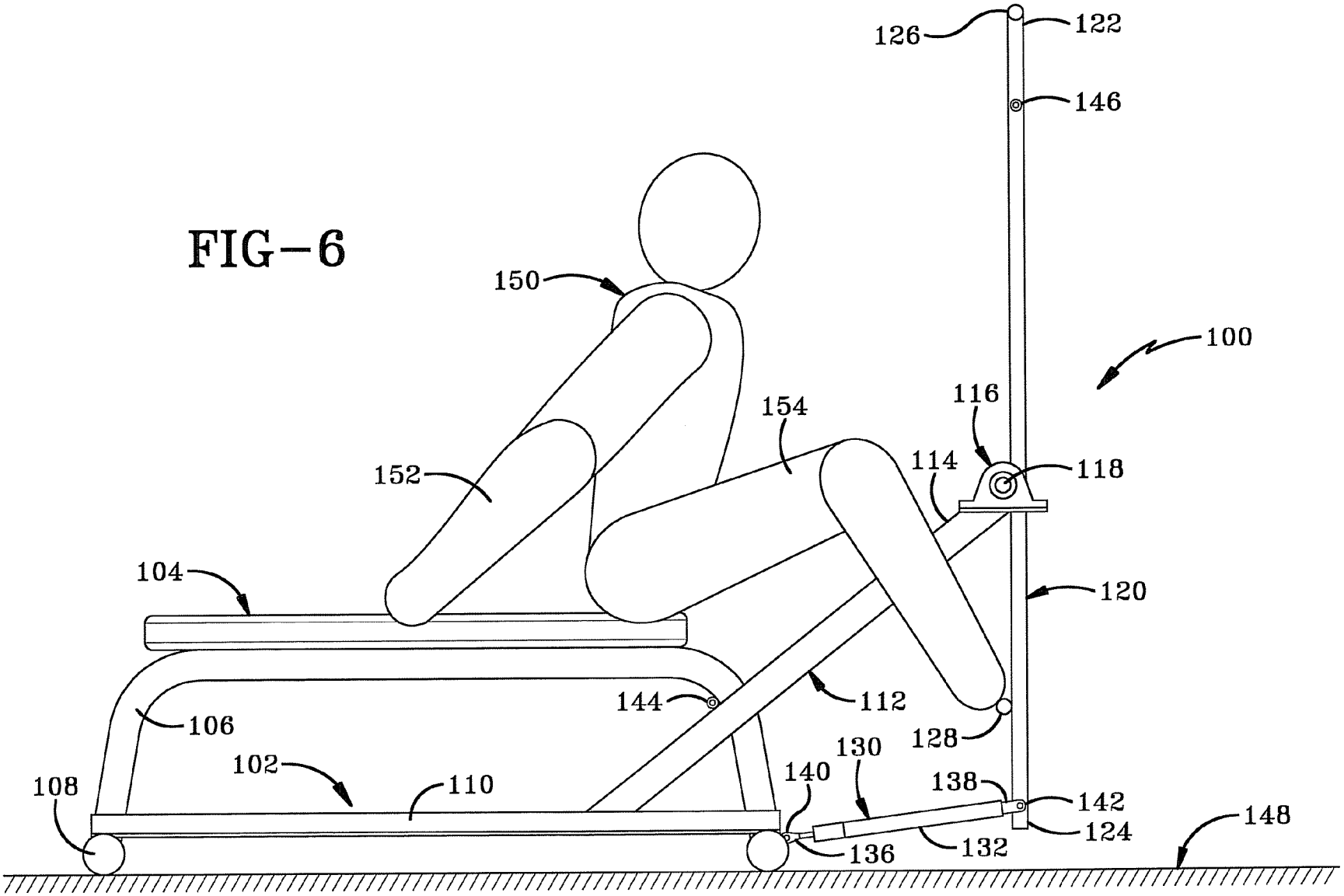
FIG. 6 is a side elevational view of the first embodiment showing the gas chamber in yet another location with the person sitting on the bench with feet on a foot rest mounted on the pivotable arm and with knees bent.
Figure 7:
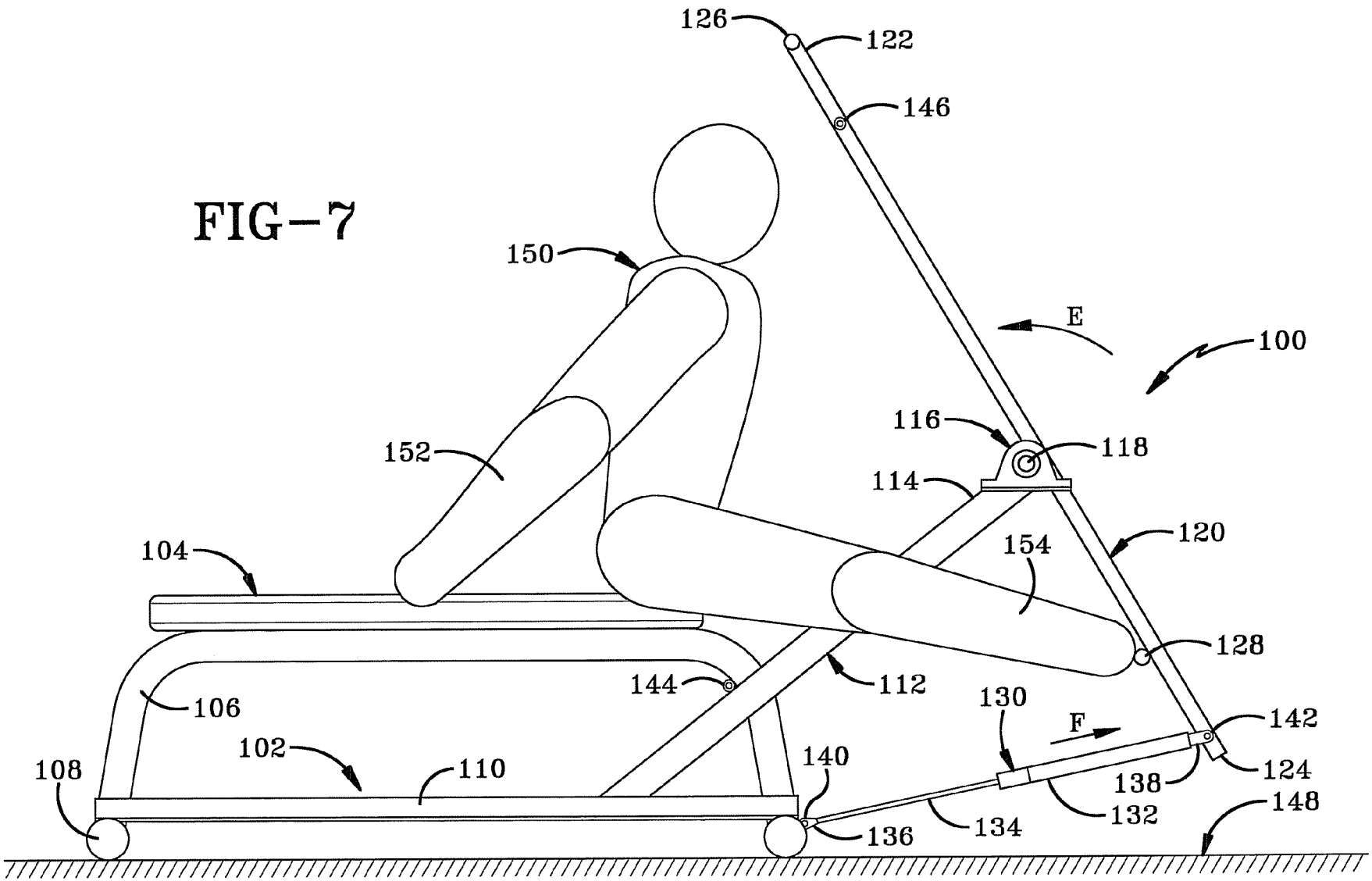
FIG. 7 is similar to FIG. 6 except that the person's legs are extended to push the foot rest outwardly and extend the gas chamber to put the gas chamber under compression.

FIGS. 6-7 shown a third option for the use of exercise machine 100. FIG. 6 shows person 150 sitting on bench 104 facing pivotable arm 120 with feet (not shown) resting on foot rest 128 and with legs 154 bent. FIG. 6 shows gas chamber 130 in a retracted position. FIG. 7 shows person 150 having extended legs 154 to push foot rest 128 outwardly away from bench 104, thereby rotating pivotable arm 120 about pivot pin 118 in a direction shown by Arrow E in FIG. 7. Simultaneously, gas chamber 130 is moved to an extended position with cylinder 132 moving outwardly in the direction as shown as Arrow F.

Pivot mounts may be located in a great variety of positions along pivotable arm 120 and on frame 102 to provide different options for the positioning of gas chamber 130. In addition, person 150 may move pivotable arm 130 in directions opposite to that shown in FIGS. 3, 5 and 7 to create a resistance reaction to the movement within gas chamber 130.

With reference to FIGS. 8-16, exercise machine 200 is further detailed. Exercise machine 200 includes a frame 202 with a user support in the form of a bench 204 sitting atop a portion thereof. Frame 202 includes a generally Z-shaped member 206 having a generally horizontal middle portion 208 to which bench 204 is connected. Z-shaped member 206 further includes a lower leg 210 extending outwardly and downwardly from one end of middle portion 208 and an upper portion 212 extending upwardly and outwardly from the other end of middle portion 208, whereby lower portion 210 and upper portion 212 extend generally away from one another.

Lower leg 210 is attached to a horizontal foot 214 which extends perpendicular to lower leg 210.

In accordance with another one of the main features of the present invention, frame 202 further includes a bent leg 216 having an upper section 218, an intermediate section 220 connected to and extending downwardly from upper section 218 and a lower section 222 connected to and extending downwardly from intermediate section 220. Each section 218, 220 and 222 is bent or angled with respect to one another, as at bend 224 between section 218 and 220 and bend 226 between section 220 and 222. Section 218 is connected at an upper end thereof to upper leg 212 of Z-shaped member 206 and angles downwardly and outwardly somewhat therefrom. Intermediate section 220 further angles downwardly and outwardly from upper section 218 and lower section 222 further angles outwardly and downwardly from section 220. Lower section 222 is connected to a second horizontal foot 228 at a center portion thereof, section 222 being perpendicular to foot 228. Frame 202 has a length extending from first foot 214 to second foot 228.

Figure 9:
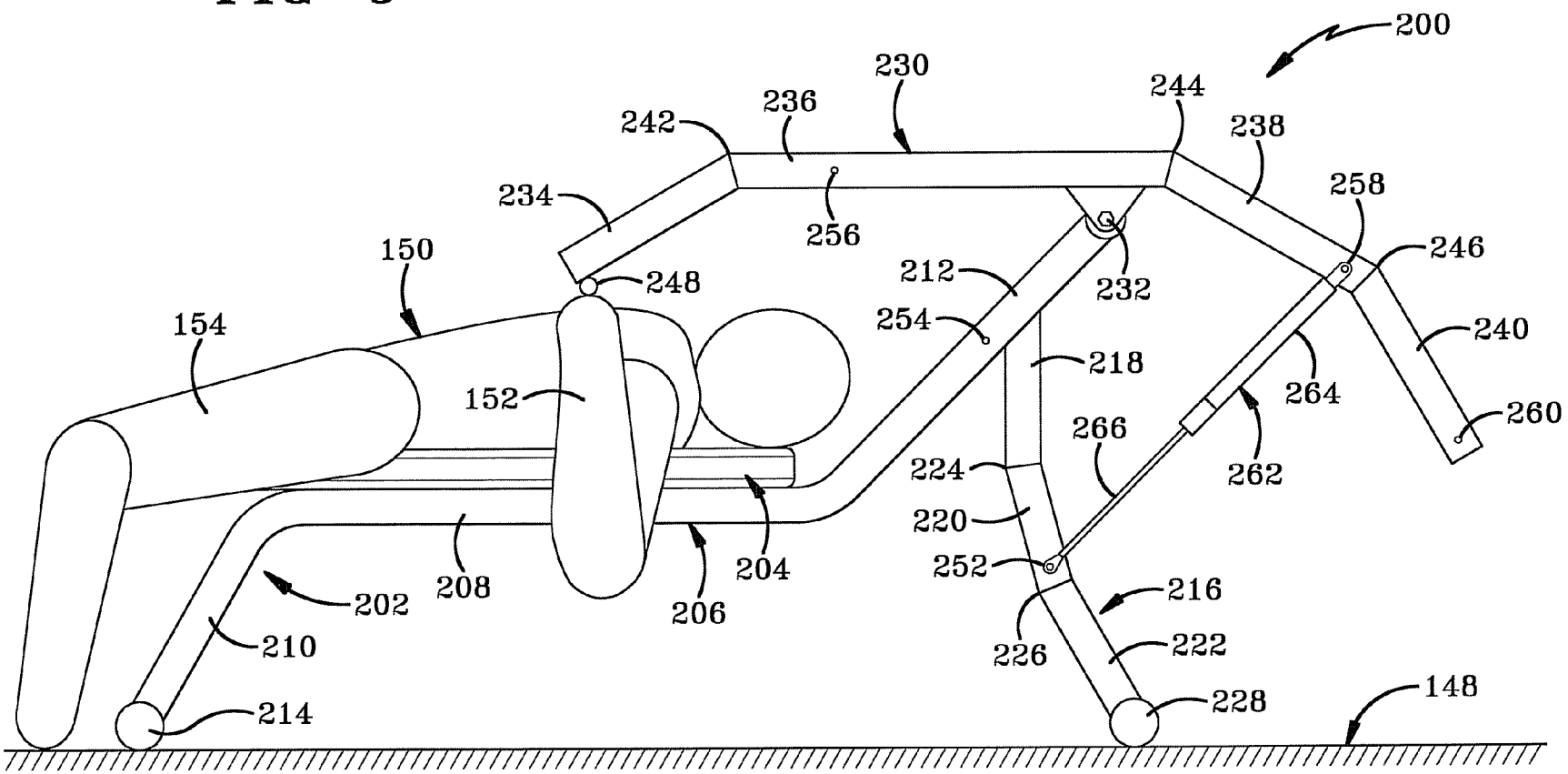
FIG. 9 is a side elevational view of the second embodiment showing a person laying on the bench with arms retracted.

In accordance with another one of the main features of the present invention, a bent pivotable member or arm 230 is pivotally mounted to upper leg 212 adjacent an upper end thereof via pivot pin 232. Pivotable arm 230 has a pair of opposed terminal ends defining a length therebetween. Pivotable arm includes a first section 234 adjacent one end of arm 230, a second section 236 connected to and extending from first section 234, a third section 238 connected to and extending from second section 236 and a fourth section 240 connected to and extending from third section 238. Each of these sections is bent or angled with respect to its adjacent counterpart, as at bend 242 between sections 234 and 236, bend 244 between sections 236 and 238 and bend 246 between sections 238 and 240. A handle 248 has a longitudinal axis 250 and is connected to first section 234 of arm 230 adjacent an end thereof and extends perpendicularly to first section 234. Due to its bent nature, pivotable arm 230 approximates a curve and is broadly a shallow U-shaped member with its interior opening downwardly when handle 248 is in a lowered position as shown in FIG. 9. The length of pivotable arm 230 is roughly of the same order as the length of frame 202. The length of pivotable arm 230 far exceeds its cross sectional dimensions, as discussed later.

As with the previous embodiment, exercise machine 200 includes a plurality of mounting locations in the form of pivot pins located on frame 202 and pivotable arm 230. In accordance with one of the main features of the invention, one of these pivotable pins is mounted on bent leg 216 and is shown at 252 extending from intermediate section 220. Frame 202 includes another pivot pin 254 extending from upper leg 212 of Z-shaped member 206. Pivotable arm 230 includes three pivot pins, one at 256 extending from second section 236, another at 258 extending from third section 238 and yet another at 260 extending from fourth section 240. A force producing mechanism in the form of a gas chamber 262 extends between and is pivotally mounted at either end thereof on pivot pins 252 and 258. Gas chamber 262 includes a cylinder 264 and a piston rod 266. Pivot pin 256 has a longitudinal axis 268, pivot pin 258 has a longitudinal axis 270, pivot pin 260 has a longitudinal axis 272 and pivot pin 232 has a longitudinal axis 274, all of which are parallel to one another.

In accordance with one of the main features of the present invention, a triangle perpendicular to the parallel axes is defined by axis 250 of handle 248, axis 274 of pivot pin 232, and either of axes 270 and 272 of pivot pins 258 and 260 respectively. Thus, any such axis of a pivot pin situated on pivotable arm 230 located on the other side of pivot pin 232 from handle 248 which similarly defines a triangle fits within this concept of the invention. In particular, this triangular configuration between the noted axes presents a movement pattern which is distinct from that found with three aligned axes, two of which pivot about the middle axis and are disposed on opposite sides of the middle axis. This distinct movement accounts for some of the feel associated with the use of exercise machine 200. The triangles just discussed can be created by a structure other than the bent arm structure of pivotable arm 230. For example, a plate, or a triangular shaped figure with pivot pins may be used. However, the bent section nature of arm 230 also adds its own particular benefits to the invention. First, it is a relatively lightweight construction compared to the possibilities just mentioned. In addition, in the region of handle 248, bent arm 230 provides an arch-like structure beneath which the head of person 150 can be more easily positioned than with a straight member. This adds to the safety feature by preventing inadvertent contact between the head of person 150 and arm 230. Further, bent arm 230 provides a structure which is shortened compared to a straight member offering similar angles with which gas chamber 262 is connected to pivot points 258 and 260.

Figure 10:
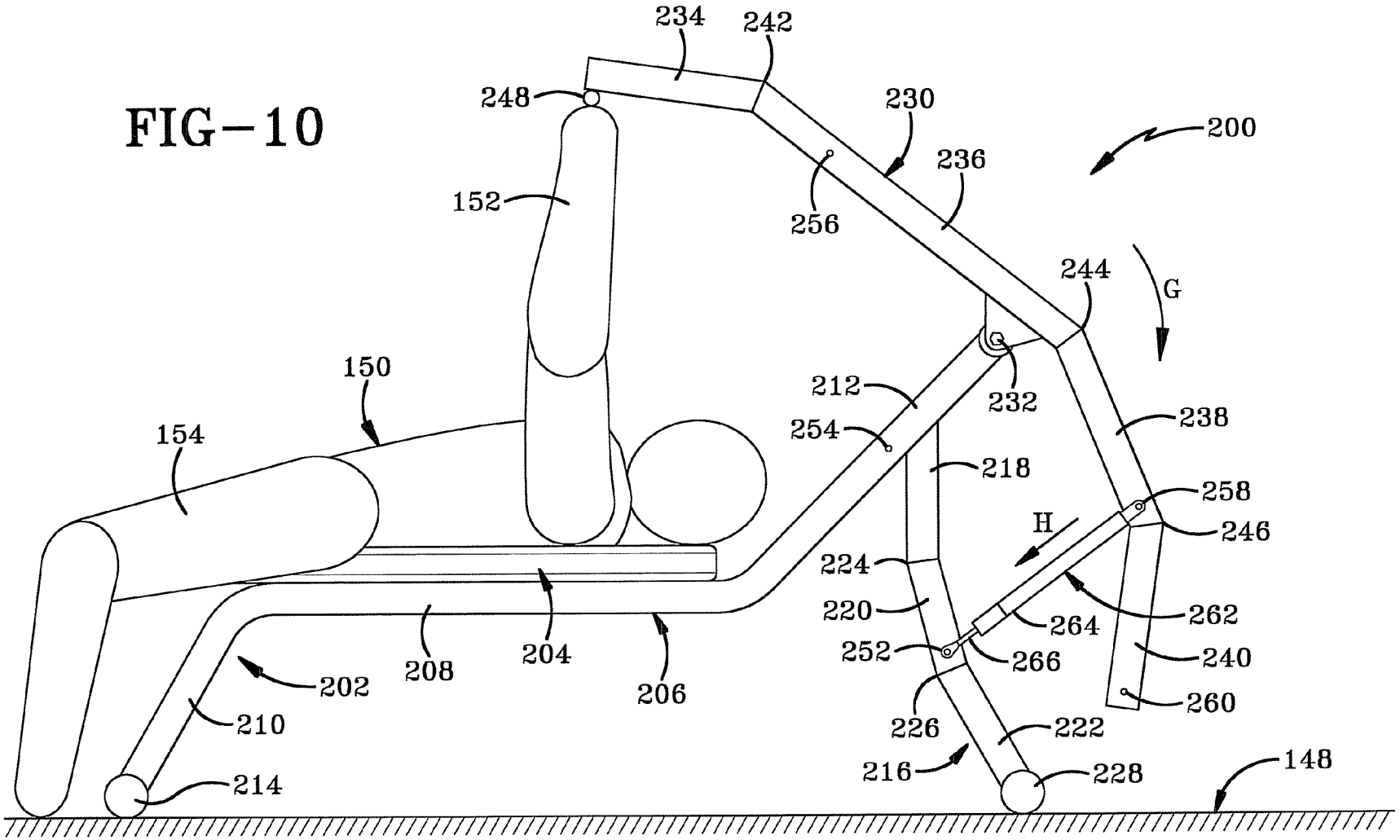
FIG. 10 is similar to FIG. 9 except the person's arms are extended to move the handle upwardly and to compress the gas chamber.

In operation, and with reference to FIGS. 9-16, exercise machine 200 functions as follows. With reference to FIGS. 9-10, exercise machine 200 is used with gas chamber 262 connected as previously noted. FIG. 9 shows person 150 in a supine position on bench 204 with arms 152 in a retracted or bent position. Gas chamber 262 is in an extended position in FIG. 9. FIG. 10 shows person 150 having extended arms 152 so that handle 248 moves generally upwardly to cause pivotable arm 230 to rotate about pivot pin 232 in the direction indicated by Arrow G and causes gas chamber 262 to be retracted and the gas within compressed as cylinder 264 moves in a direction as indicated by Arrow H.

Figure 11:
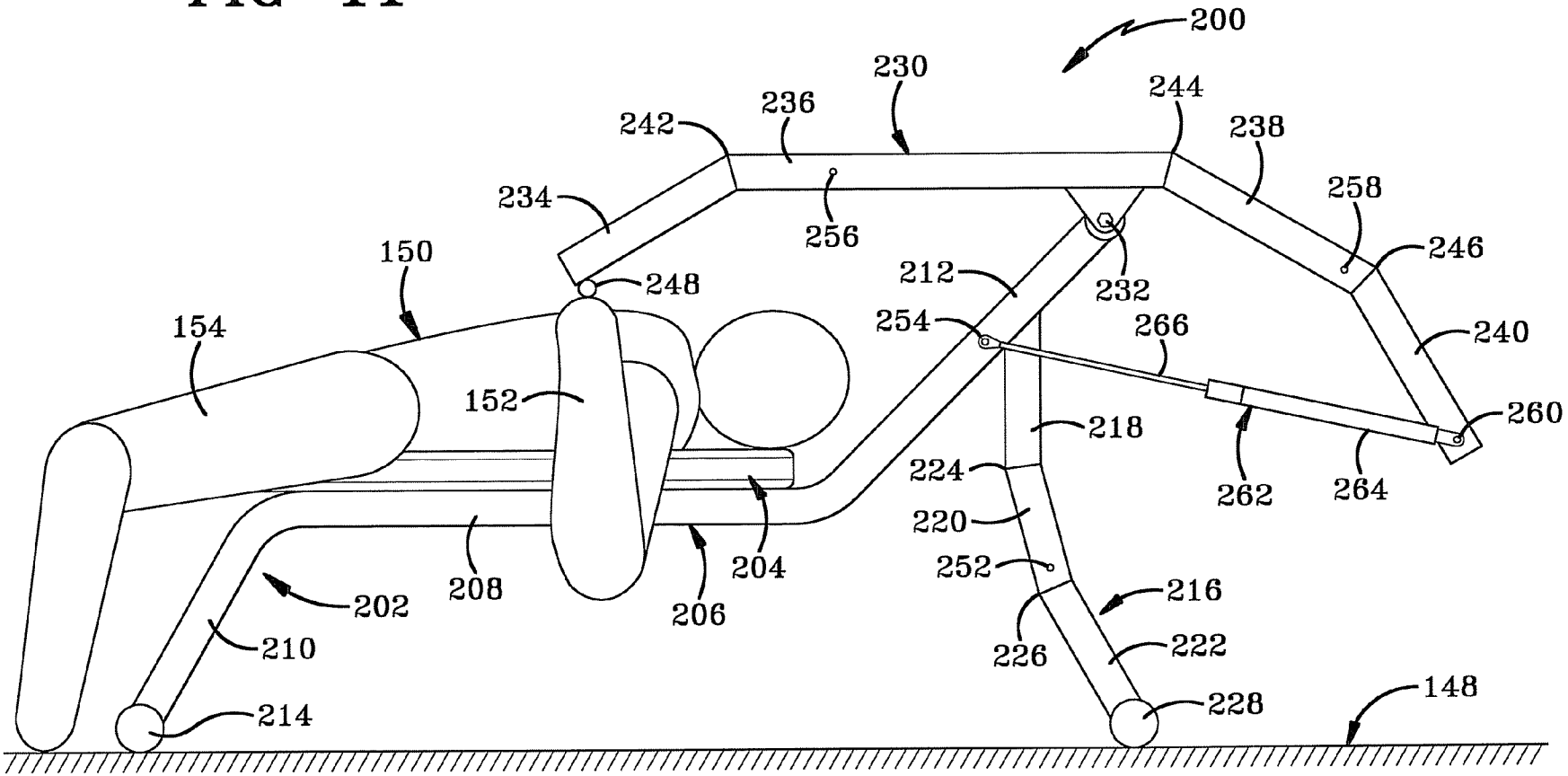
FIG. 11 is a side elevational view of the second embodiment with the gas chamber connected to a different point on the frame showing a person with retracted arms laying on the bench.
Figure 12:
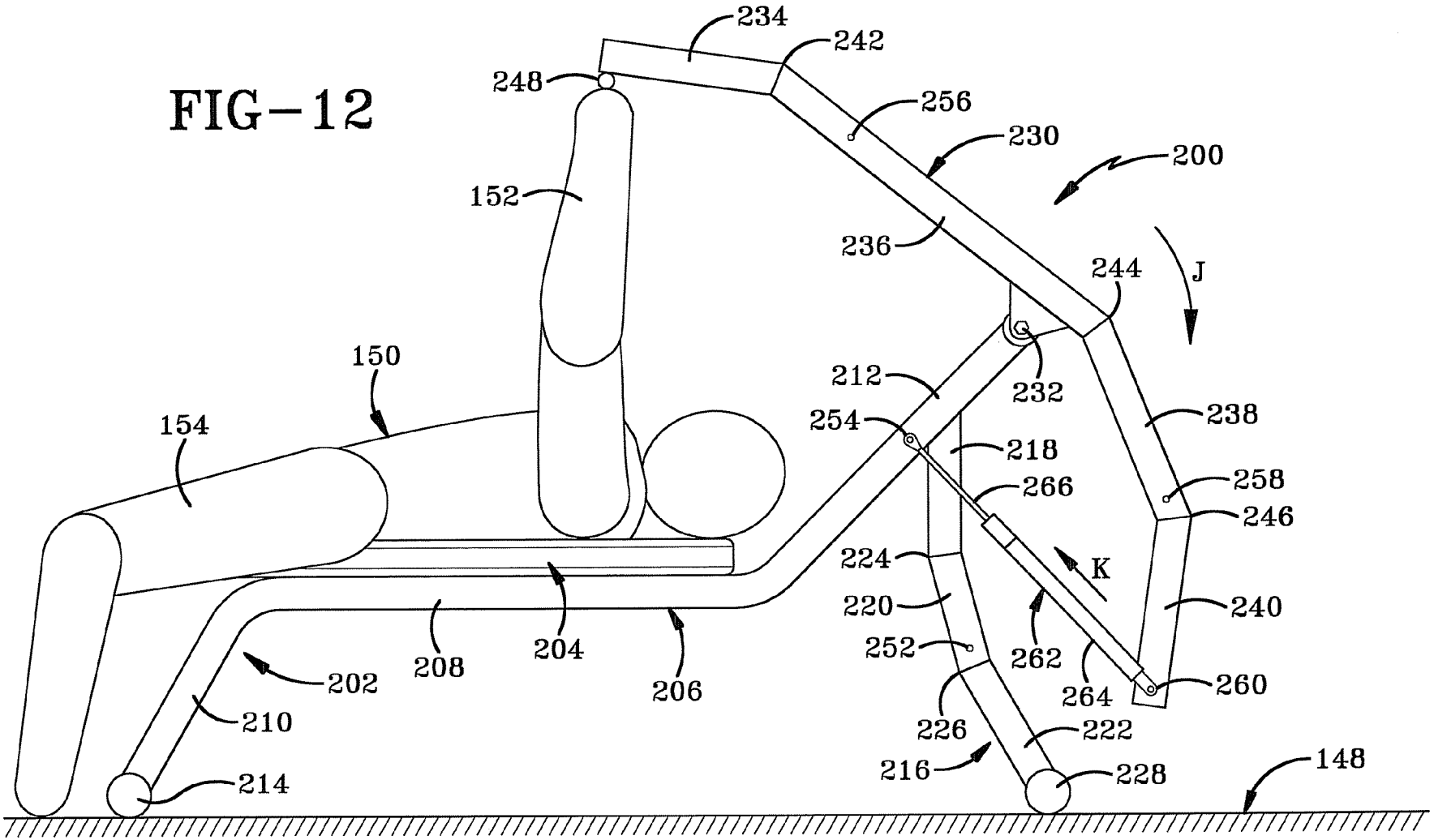
FIG. 12 is similar to FIG. 11 except the person has extended arms to move the handle upwardly and to retract the gas chamber.

An alternate option is shown in FIGS. 11-12, wherein gas chamber 262 is connected at either end to respective pivot pins 254 and 260. Thus, the triangle of concern has been changed to include axis 272 of pivot pin 260, whereas in the option shown in FIGS. 9-10, the triangle included axis 270 of pivot pin 258. FIG. 11 shows person 150 laying on bench 204 with arms 152 bent or retracted with gas chamber 262 in an extended position. FIG. 12 shows person 150 having extended arms 152 to push handle 248 upwardly to rotate pivotable arm 230 about pivot pin 232 in the direction indicated by Arrow J to move gas chamber 262 toward a retracted position by moving cylinder 264 in the direction indicated by Arrow K.

Figure 13:
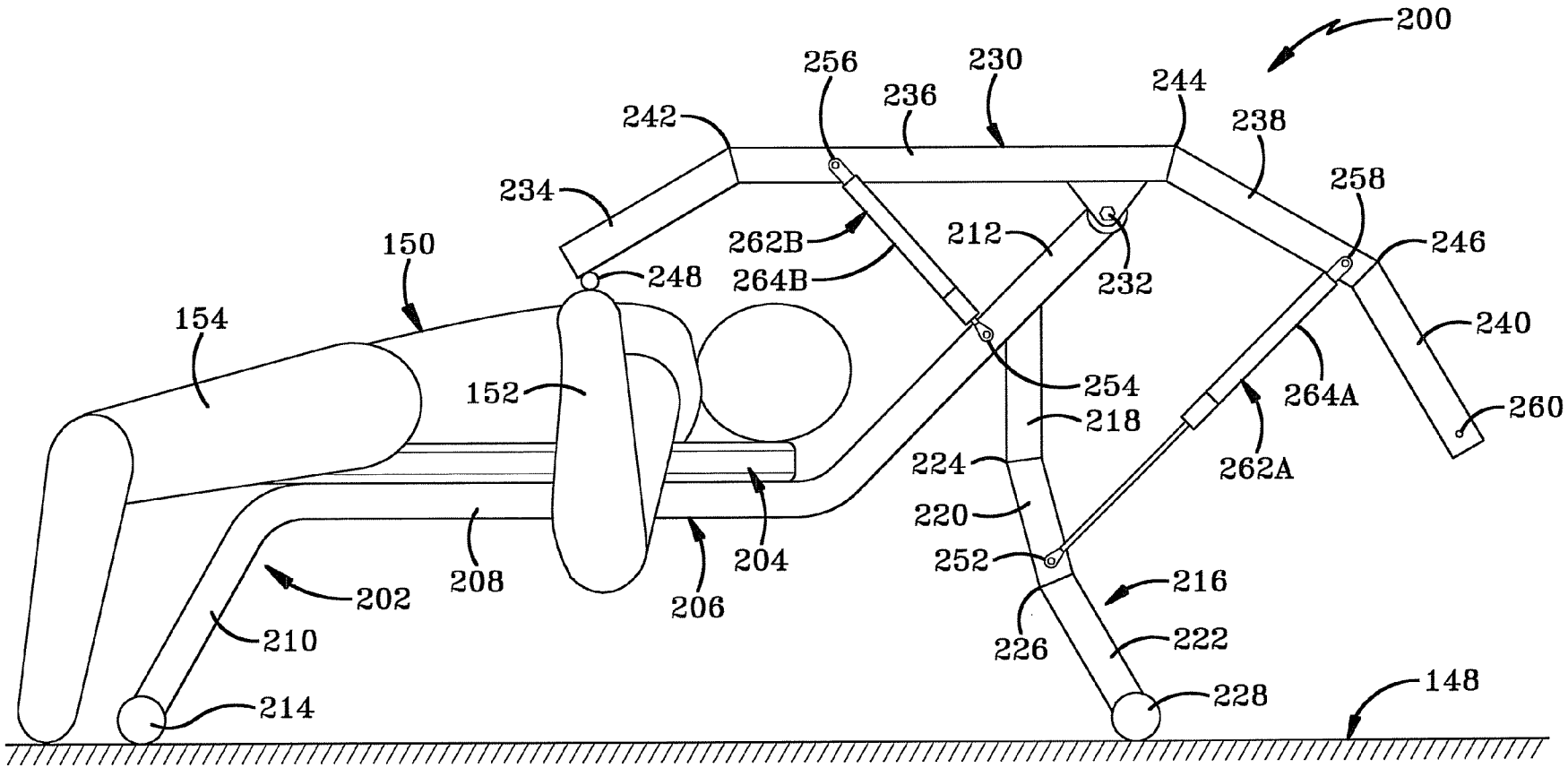
FIG. 13 is a side elevational view of the second embodiment showing an additional gas chamber being connected between the frame and the pivotable arm and further shows a person laying down on the bench with arms in a retracted position.
Figure 14:
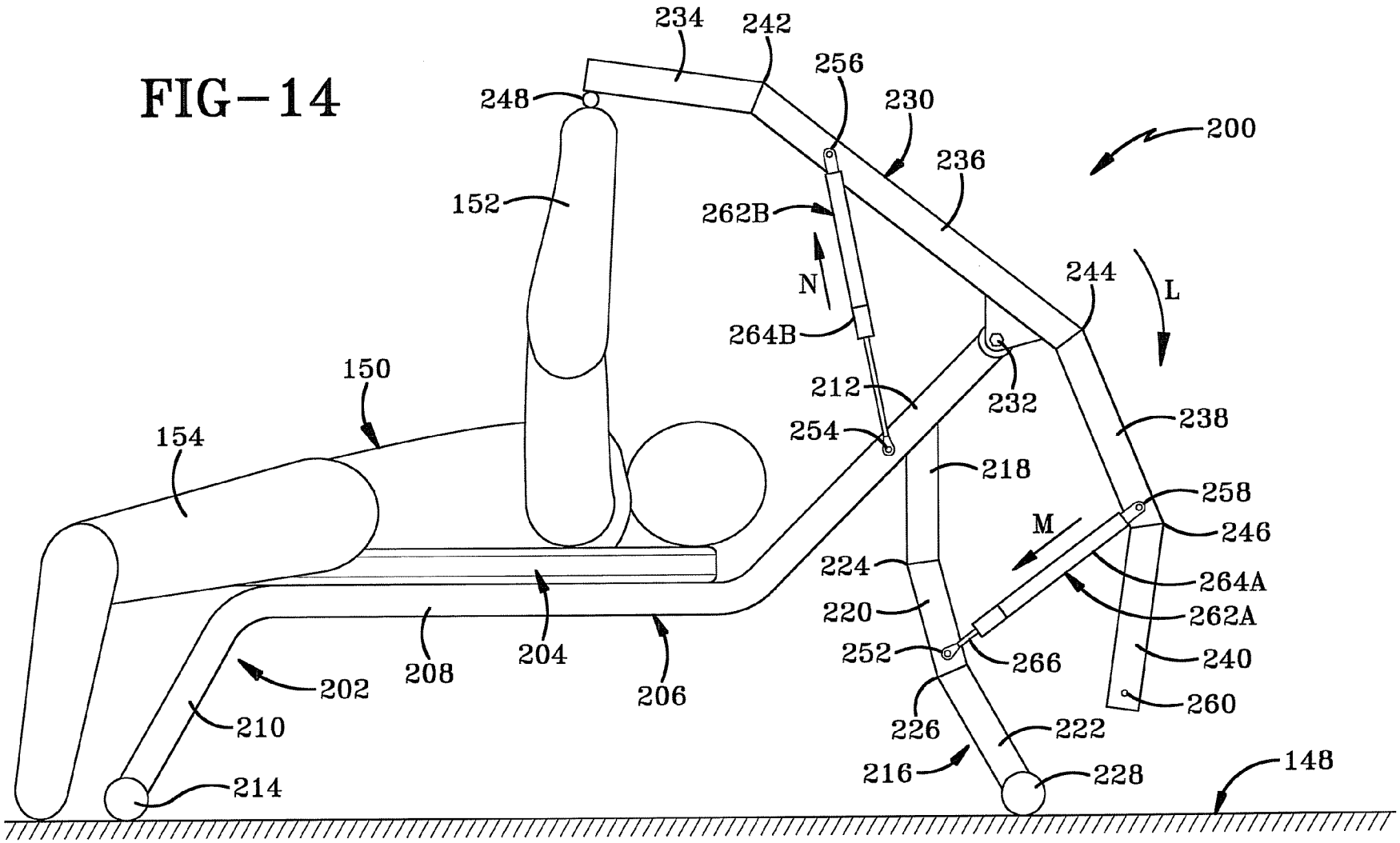
FIG. 14 is similar to FIG. 13 except the person's arms are extended to compress the first gas chamber and extend the second gas chamber.

FIGS. 13-14 show yet another option whereby two gas chambers 262A and 262B are used in conjunction. Gas chamber 262A is shown in the position depicted in FIGS. 9-10 and is shown in an extended position in FIG. 13. Gas chamber 262B has its ends connected at pivot pins 254 and 256 and is in a retracted position in FIG. 13. FIG. 13 further shows person 150 laying on bench 204 with arms 152 in a bent position. FIG. 14 shows person 150 having extended arms 152 to push handle 248 upwardly to rotate pivotable arm 230 about the Arrow shown at L to move gas chamber 262A toward a retracted position as cylinder 264A moves in a direction indicated by Arrow M and to move gas chamber 262B toward an extended position, moving cylinder 264B in the direction indicated by Arrow N. Thus, the force exerted by person 150 in extending arms 152 is reacted in two gas chambers whereby additional resistance to said force is created. It is noted that gas springs are configured to create a resistance force under compression and therefore the force producing mechanism at 262B in FIG. 14 would not be a gas spring if a resistance force is desired in opposition to the extension of the user's arms.

Figure 15:
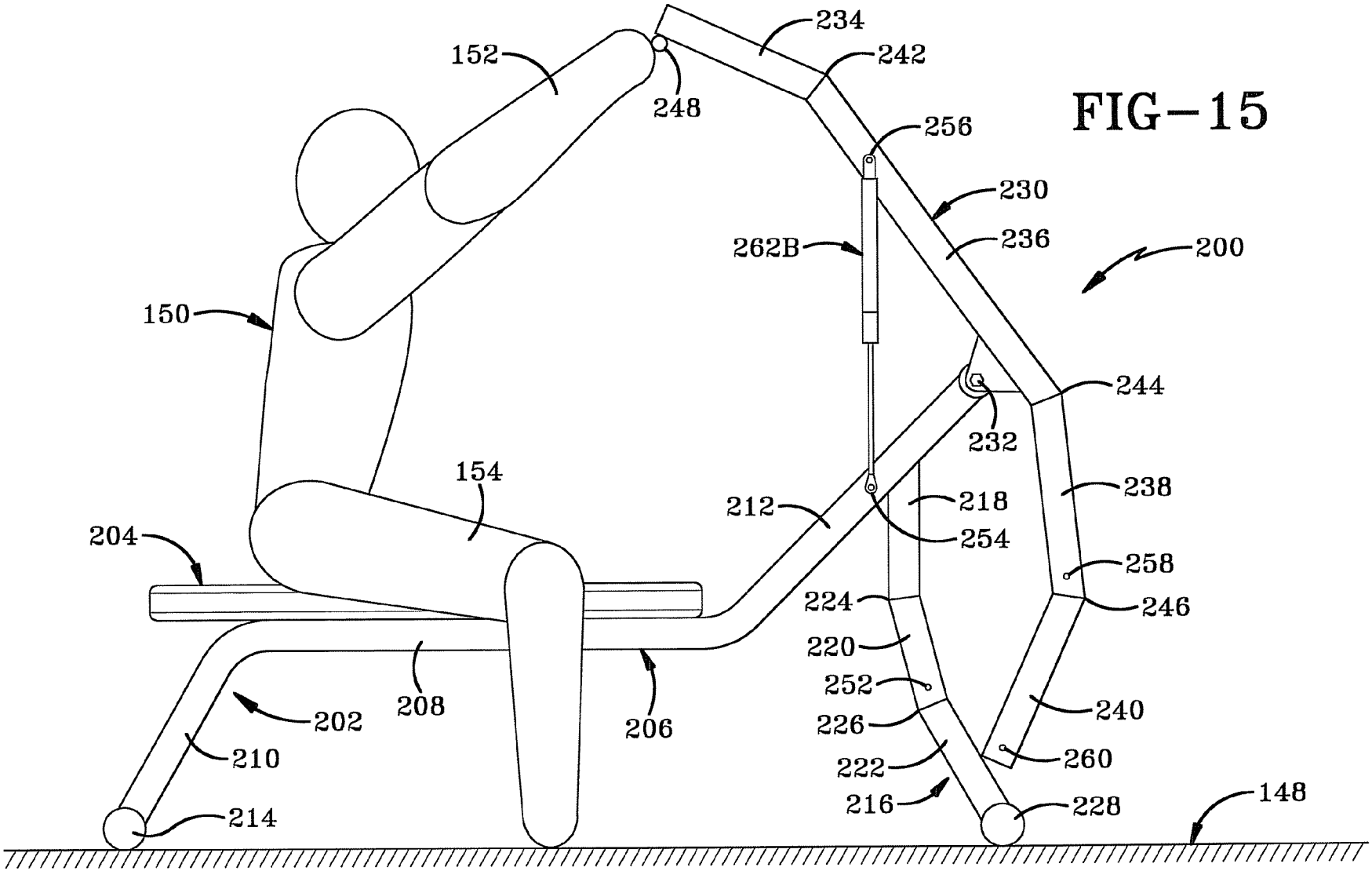
FIG. 15 is a side elevational view of the second embodiment with the first gas chamber removed from the configuration of FIG. 14 and with a person sitting on the bench with arms extended.
Figure 16:
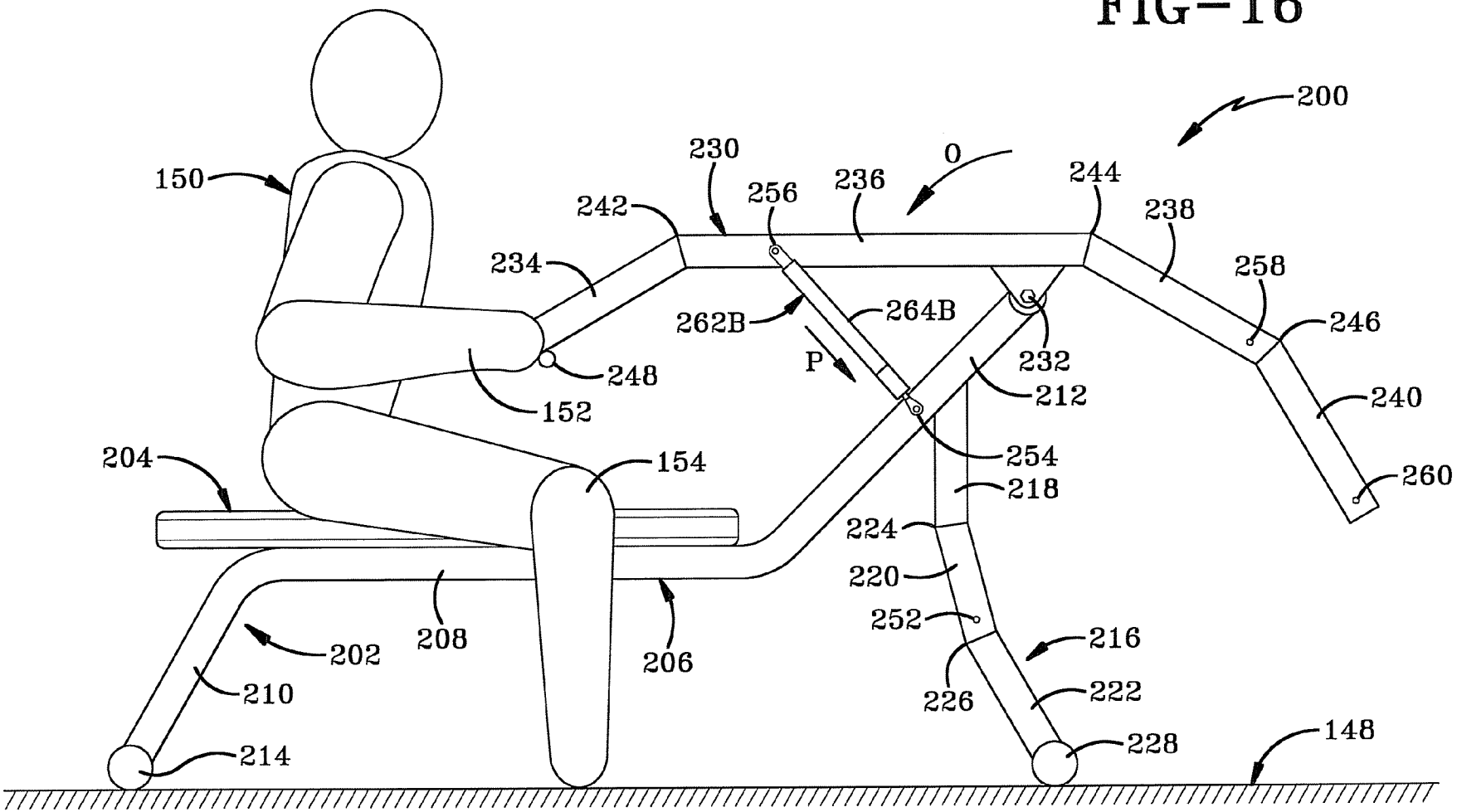
FIG. 16 is similar to FIG. 15 except the person's arms are retracted to pull the handle downwardly and to compress the gas chamber.

FIGS. 15-16 show yet another option wherein gas chamber 262A has been removed from exercise machine 200 in comparison to the configuration of FIGS. 13-14 so that only gas chamber 262B remains attached in the position shown in FIGS. 13-14. However, exercise machine 200 is being used in a different fashion than FIGS. 15-16. FIG. 15 shows person 150 sitting atop bench 204 facing pivotable arm 230 with arms 152 extended and gas chamber 262B in an extended position. FIG. 16 shows person 150 with arms 152 pulled downwardly to rotate pivotable arm 230 about pivot pin 232 in the direction indicated by Arrow O to move gas chamber 262B toward a retracted position by moving cylinder 264B in the direction indicated at Arrow P.

As shown in the figures, exercise machine 200 provides a great variety of options as to the positions in which a person 150 can use the machine as well as the positions of gas chamber 262 and its connections to the various pivot pins. Further, the bent nature of pivotable arm 230 as well as bent leg 216 offers an improved feel during operation of machine 200. As shown in the first embodiment, pivotable arm 230 may be provided with a foot rest to increase the options of exercise machine 200.

It is contemplated that pivotable arm 230 may have sections bent with respect to one another such that they are bent upwardly in the opposite direction shown in the figures. While such an option may offer certain advantages, it also would create an additional upward dimension to machine 200 as compared with the position as shown in FIG. 9. Such a configuration would require that gas chambers be longer than those required in the present embodiment. Such a configuration would also move handle 248 further away from person 150 and eliminate the space created below pivotable arm 230 in the area where the head of person 150 is positioned when in a supine position. The bent nature of arm 230 also reduces the overall length of machine 200 compared to a pivotable arm which is straight. Pivotable arm 230 also allows for a shorter length gas chamber 262 to be utilized between the pivot pins on pivotable arm 230 disposed opposite of pivot pin 232 from handle 248. Bent leg 216 serves another purpose. Because arm 230 serves to reduce the length of gas chamber 262 needed, it also reduces the space available to install a gas chamber between the outer end of arm 230 and bent leg 216. Thus, bent leg 216 is bent so that upper section 218 and lower section 222 extends somewhat toward the outer portion of arm 230, in particular towards third section 238 and fourth section 240. Thus, middle section 220 of bent arm 216 is disposed further away from said sections 238 and 240 of arm 230 to provide additional space for gas chamber 262.

Bent pivotable arm 230 may be an arcuate arm and thus provide similar features, although not exactly the same. Bent arm 230 also has an advantage of being capable of construction from a series of straight sections.

It is further contemplated that an exercise machine using gas chambers and/or a bent arm may be constructed without the use of a bench. For example, such a machine may be configured for exercising in a standing position. Further, the bench variety machines may be used with a person on his or her side with a pivotable arm pivoting, for example, in a horizontal plane. Such variations are within the scope of the invention.

Exercise machine 300 (FIGS. 17-18) has a front end 302 and an rear end 304 opposed thereto. Machine 300 is generally elongated along an axial direction extending between front end 302 and rear end 304. Machine 300 also has a pair of opposed sides 306 (FIG. 17) defining an axial direction extending therebetween. Machine 300 is substantially bilaterally symmetrical with respect to an imaginary vertical plane (not shown) extending in the longitudinal direction and centered between sides 306 of machine 300.

Figure 17:
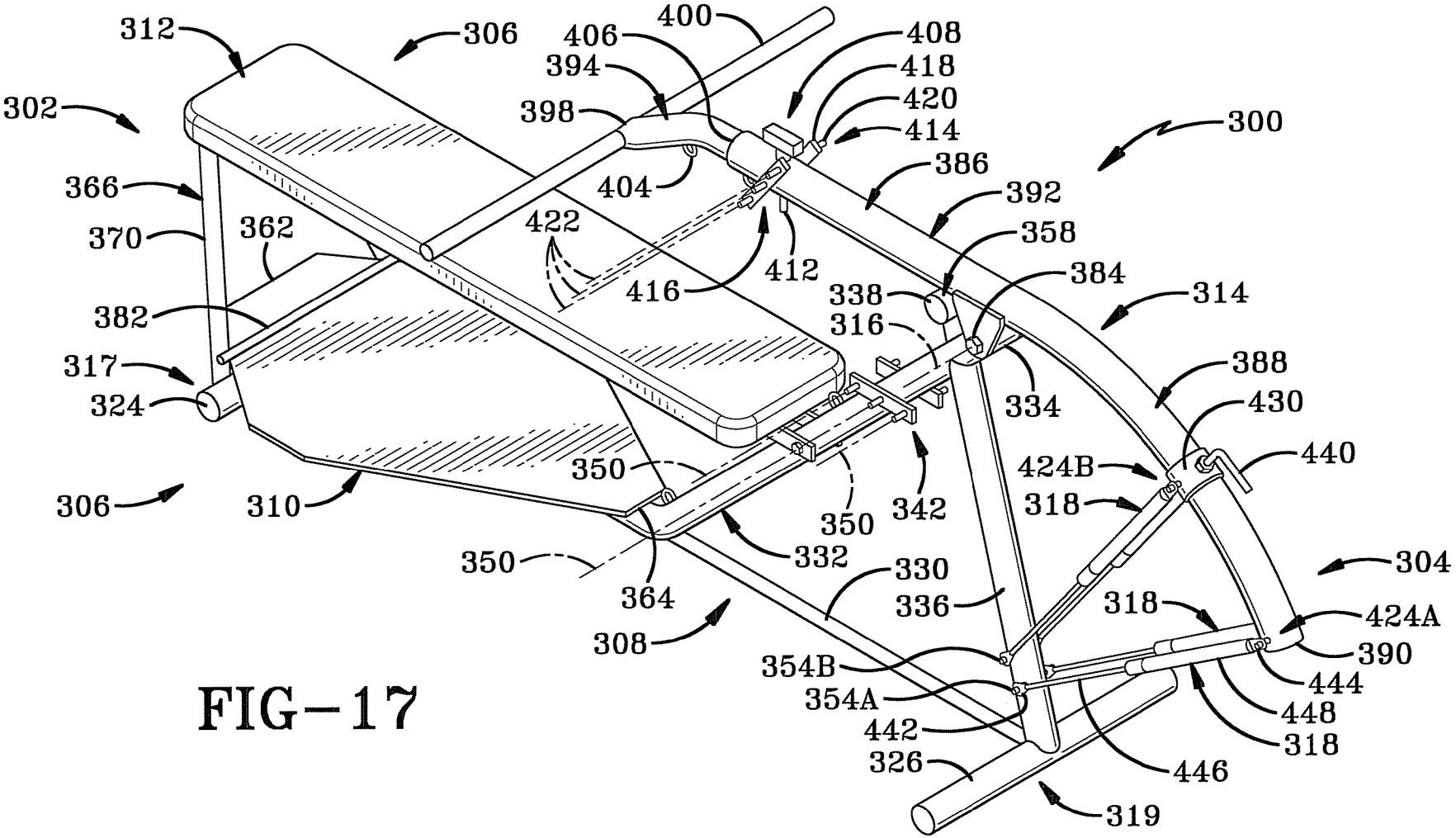
FIG. 17 is a perspective view of a third embodiment of the exercise machine of the present invention.
Figures 18, 19:
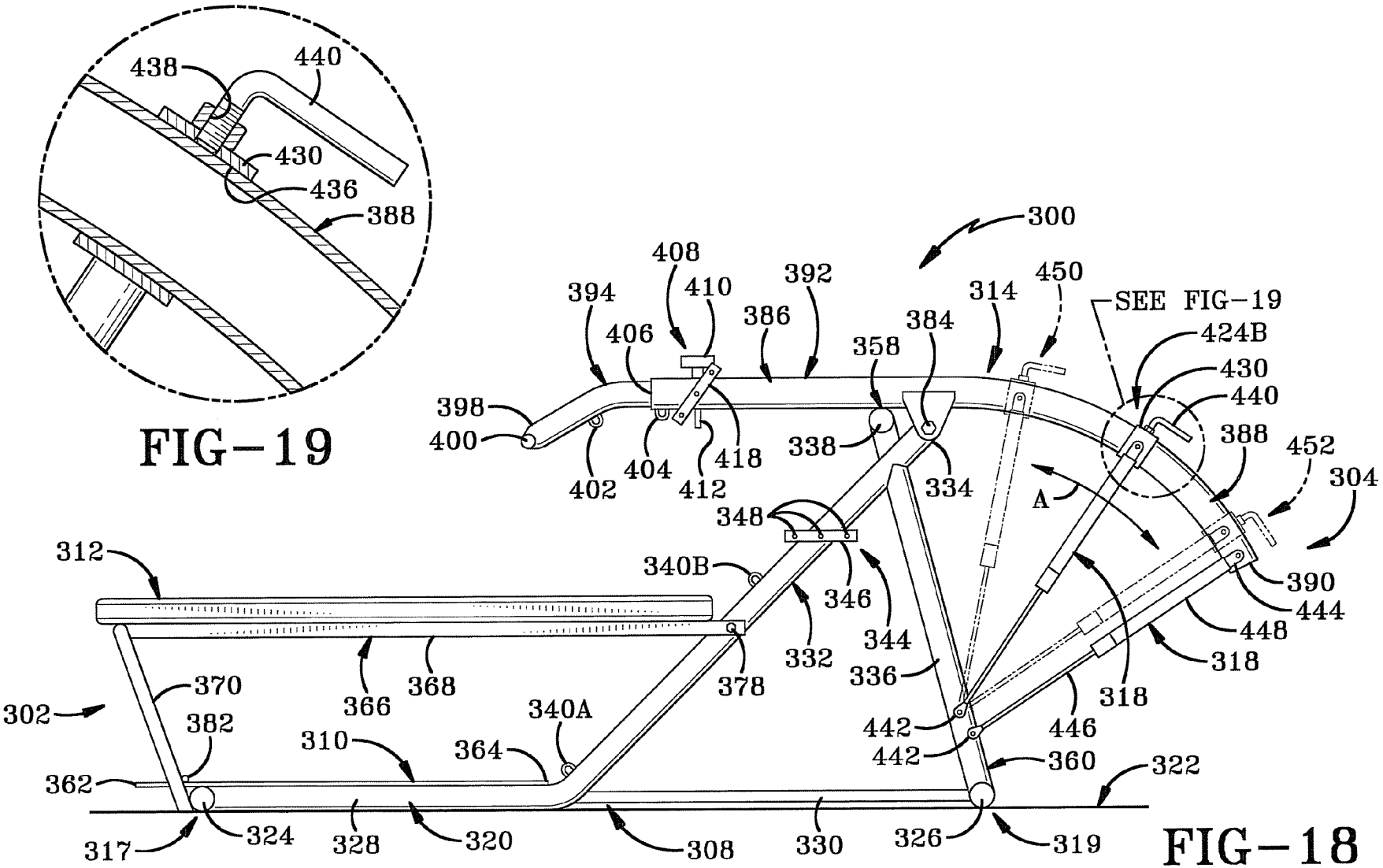
FIG. 18 is a side elevational view of the third embodiment shown in FIG. 17.
FIG. 19 is an enlarged sectional view of the encircled portion of FIG. 18 and shows the adjusting sleeve.

Machine 300 includes a frame 308, a standing platform 310 mounted on frame 308, a bench 312 removably mounted on frame 308, a pivotable member 314 pivotally mounted on frame 308 about a pivot axis 316 (FIG. 17) and a plurality of force producing or resistance mechanisms in the form of gas springs 318. As previously discussed herein, each gas spring provides a resistance force which is generally constant during compression although it does increase somewhat during compression. However, this increase is far less than that of a standard pneumatic piston-cylinder combination. Gas springs are internally pressurized even at rest unlike their standard pneumatic counterparts, which are not pressurized at rest but which very quickly experience an internal pressure increase during compression as the piston slides in a sealed fashion against the inner surface of the cylinder. FIGS. 17, 18, 20, 21, 23 and 24 show gas springs 318 in respective fully extended positions which is in keeping with their internal pressurization at rest. In the configuration shown in these figures, gas springs 318 provide resistance to the pivotal movement of pivot arm 314 only in one direction, namely clockwise as viewed from the right as illustrated in FIG. 18. As noted above, the resistance force during compression of gas spring 318 is generally constant with some increase throughout the entire compression stroke, and thus gas springs 318 offer a generally constant and somewhat increasing resistance to this pivotal movement of pivot arm 314 throughout its clockwise pivotal movement. Because gas springs 318 are under internal pressure at all times, this internal pressure also biases the gas spring to its fully extended position and thus biases pivot arm 314 to its fully forward rotated position shown in FIG. 18. Thus, when the user or operator is laying or sitting on bench 312 or standing on platform 310 raises the handle of pivot arm 314 to rotate it in the clockwise direction noted above, the operator experiences continuous resistance to this pivotal movement throughout the full range of the pivotal movement. In addition, when the operator lowers the handle of pivot arm 314 such that it rotates in the counter clockwise direction, the operator experiences the continuous force produced throughout by gas springs 318 which bias pivot arm 314 to its fully forward or home position of FIG. 18 whereby the operator must apply an upward force on the handle of pivot arm 314 in the clockwise direction even as the pivot arm is moving in the counter clockwise direction in order to prevent pivot arm 314 from rapidly and forcibly rotating in the counter clockwise direction in an uncontrolled manner to the home position. Gas springs 318 thus provide the feel and experience associated with the lifting of freeweights so gas springs 318 produce a continuous force experienced throughout the raising and lowering of pivot arm 314 much like freeweights provide a continuous downward force as they are raised and lowered.

Frame 308 has a front end 317, a rear end 319 opposed thereto and includes a base 320 adapted to lie on a floor 322. Frame 308 has a length extending from front end 317 to rear end 319. Base 320 includes an axially extending first foot 324 adjacent front end 302 and an axially extending second foot 326 spaced from first foot 324 and disposed adjacent rear end 304. A centrally located longitudinally extending member 328 is connected to first foot 324 and extends toward second foot 326 about half the distance between first and second feet 324 and 326. A longitudinally extending connecting member 330 extends from and is connected to longitudinal member 328 to second foot 326, to which member 330 is connected. A mounting arm 332 angles upwardly and rearwardly from longitudinal member 328 adjacent its connection with connecting member 330 and terminates in an upper end 334. Mounting arm 332 and longitudinal member 328 are formed as an integral one-piece member. Frame 308 further includes a leg 336 which extends from and is connected to second foot 326 and angles upwardly and rearwardly to a terminal upper end 338. Leg 336 adjacent upper end 338 thereof intersects and is connected to mounting arm 332 adjacent upper end 334 thereof. Frame 308 has a vertical height extending from its lowermost portion, for example second foot 326, to its uppermost portion atop leg 336 at upper end 338. The height of frame 308 is substantially the same as the length of leg 336 and would be so if leg 336 were vertically oriented.

A pair of pulley mounting locations 340 in the form of U-shaped loops are mounted on mounting arm 332 of frame 308. Mounting locations 340 include lower mounting location 340A and upper mounting location 340B. Lower mounting location 340A is adjacent the intersection of longitudinal member 328, mounting arm 332 and connecting member 330. Upper mounting location 340B is located approximately centrally along the length of mounting arm 332. Each mounting location 340 extends generally upwardly from mounting arm 332. A first set 342 of frame mounting locations are mounted on mounting arm 332 along the upper half of mounting arm 332. First set 342 of frame mounting locations includes a pair of spaced mounting structures 344 disposed on either side of mounting arm 332 as best seen in FIG. 17. Each mounting structure 344 is removably mounted although they may be fixedly attached if desired. Each mounting structure 344 includes an elongated bar 346 with three axially extending mounting members 348 each defining an axially extending axis 350. One of mounting members 348 on one side of mounting arm 332 cannot be seen in the Figures, but each mounting structure 344 is substantially a mirror image of the other so that each of the three mounting members 348 on each bar 346 is aligned with a respective mounting member 348 of the other mounting structure 344 such that axes 350 of the three mounting members 348 of each bar 346 are respectively coaxial. A preferred configuration of each mounting member 348 includes a generally spherical outer portion, more commonly known as a ball stud or a similar type structure, which facilitates a quick-release snap-fit connection with gas springs 318 for quick removal and replacement thereof. Preferably, this snap-fit connection is via a ball and socket connection as detailed further below.

A second set 352 of frame mounting locations is mounted on leg 336 of frame 308 along the lower half of leg 336 and adjacent second foot 326. Second set 352 includes a mounting structure in the form of a plurality of axially extending mounting members 354 (FIG. 20) removably connected to and extending outwardly from each side of leg 336, including a first pair of mounting members 354A and a second pair of mounting members 354B disposed upwardly of members 354A. Mounting members 354A are aligned with one another on the opposed sides of leg 336, as are mounting members 354B. Each mounting member 354 defines an axially extending axis 356 such that mounting members 354A are coaxial with one another and mounting members 354B are coaxial with one another. Each mounting member 354 has substantially the same configuration as each mounting member 348. Thus, each gas spring 318 is typically mounted on mounting member 354 by a quick-release snap-fit ball and socket connection as noted above. A portion of leg 336 adjacent upper ends 338 constitutes a first stop 358 for limiting rotational movement of pivotable member 314 in a first direction which is counterclockwise as viewed from the perspective of FIG. 18. Another portion of leg 336 adjacent second foot 326 defines a second stop 360 for limiting the rotation of pivotable member 314 in a second direction opposite to the first direction.

Standing platform 310 is one form of a user support for supporting the user of machine 300 during use thereof. Platform 310 is rigidly mounted on frame 308 by any suitable means known in the art. More particularly, standing platform 310 is mounted above longitudinal member 328 and first foot 324. Standing platform 310 has a front end 362 and a rear end 364 in opposed relation thereto. Front end 362 extends forward of first foot 324 and rear end 364 is disposed adjacent the intersection of longitudinal member 328, connecting member 330 and mounting arm 332.

Bench 312 is another form of a user support for supporting the user of machine 300 during use thereof. Bench 312 is removably mounted on frame 308. In particular, bench 312 is connected to a bench mounting frame 366 which includes a longitudinally extending base structure 368 and a pair of legs 370 connected to and extending downwardly from base structure 368 adjacent front end 302 of machine 300. Base structure 368 forms a yoke 372 adjacent a front end thereof including a pair of arms 374 each defining a hole 376 for removably receiving a fastener 378 in the form of a bolt for removably connecting base structure 368 to mounting arm 332 of frame 308. In particular, fastener 378 extends through holes 376 and a hole 380 (FIG. 20) formed in mounting arm 332. Legs 370 of bench mounting frame 366 are connected to one another via a connecting rod 382 which extends axially between legs 370 adjacent a lower end thereof. When bench 312 is mounted on frame 308, connecting rod 382 is disposed atop standing platform 310 with front end 362 extending forward of legs 370 and connecting rod 382.

Pivotable member 314 is substantially centered with respect to opposed sides 306 of machine 300 and similarly substantially centered between respective opposed sides of frame 308, standing platform 310 and bench 312. Pivotable member 314 is pivotably mounted on frame 308 adjacent upper end 334 of mounting arm 332 via a pivot member 384 in the form of a bolt. Pivot member 384 extends in an axial direction with pivot axis 316 (FIG. 17) extending therethrough. Pivot member 384 and pivot axis 316 are rearwardly spaced from standing platform 310 and bench 312 in the longitudinal direction of machine 300. Pivotable member 314 is rotatable between a fully forward rotated position (FIGS. 17-18) and a fully rearward rotated position (approximated by FIGS. 24-25).

Pivotable member 314 includes a first portion 386 which extends forward from pivot axis 316 and a second portion 388 which extends rearwardly from pivot axis 316 in a direction generally opposite to that of first portion 386. Part of first portion 386 of pivotable member 314 extends over each of standing platform 310 and bench 312 directly thereabove when pivotable member 314 is in the fully forward rotated position.

Figure 22:
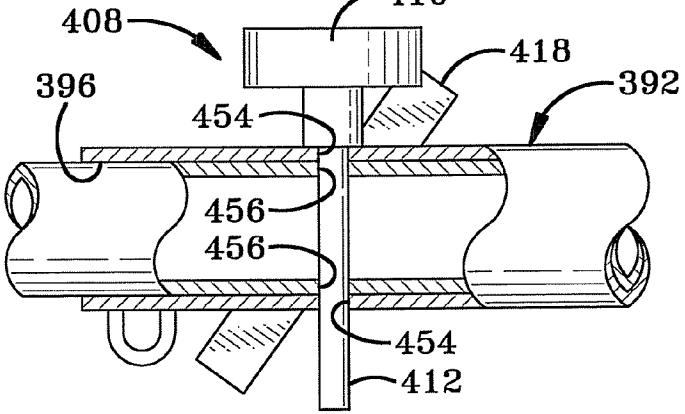
FIG. 22 is an enlarged fragmentary sectional view of the securing mechanism used for securing the handle at various positions.

First portion 386 of pivotable member 314 is extendable and retractable. In particular, first portion 386 includes a substantially straight first segment 392 and an extendable and retractable second segment 394 which is slidably received within an interior chamber 396 (FIG. 22) of first segment 392. Extendable second segment 394 has a forward end 398 which is angled downwardly in a first position as shown in FIGS. 17 and 18. An axially extending handle 400 is connected to second segment 394 adjacent forward end 398 thereof and extends laterally in both directions so that second segment 394 and handle 400 form a T-shaped structure with handle 400 extending perpendicularly to second segment 394.

Second portion 388 has a terminal end 390 and is arcuate over its length from terminal end 390 to adjacent axis 316. In particular, second portion 388 forms a substantially constant arc which curves downwardly and generally toward frame 308. In particular, the arc defined by a second portion 388 is constant with respect to the upper mounting members 354B on leg 336 wherein the center of the circle of which said constant arc is a portion lies on axis 356 of members 354B when pivotable member 314 is in the fully forward rotated position (FIGS. 17-18). No part of second portion 388 of pivotable member 314 extends over platform 310 or bench 312. The length of second portion 388 is in the order of the height of frame 308.

Pivotable member 314 has a length extending from terminal end 390 to first end 398 generally in the longitudinal direction of machine 300. The length of pivotable member 314 when in the retracted position is roughly of the same order as the length of frame 308. Pivotable member 314 has a cross sectional height (FIG. 22) extending in the axial direction of machine 300 and a cross sectional width wherein the length of pivotable member 314 is substantially greater than either of the width and height thereof. The cross sectional height and width are substantially the same here as pivotable member 314 is substantially cylindrical. Thus, the length of pivotable member 314 is substantially greater than and indeed far exceeds the greatest aspect of the cross sectional dimension taken perpendicularly to the length. The ratio of the length to the cross sectional dimension of pivotable member 314 is usually in the range of 15:1 to 28:1 when in the retracted position and in the range of 25:1 to 38:1 when in the extended position. More typically, this ratio is in the range of 20:1 to 24:1 when in the retracted position and in the range of 28:1 to 34:1 when in the extended position.

The analogous ratio for pivotable member 120 of exercise machine 100 is in the order of about 50:1 and for pivotable member 230 of exercise machine 200 is in the order of about 30:1. Thus, due to the requirements of minimizing the amount of material used to form the respective pivotable members and the need for each pivotable member to extend sufficiently in either direction from the pivot axis, as will be understood by one skilled in the art, the length of the pivotable members far exceed their respective cross sectional dimensions.

A pair of pulley mounting locations 402 and 404 in the form of U-shaped loops are mounted on first portion 386 of pivotable handle 314. More particularly, mounting location 402 is connected to extendable second segment 394 adjacent forward end 398 thereof and mounting location 404 is connected to first segment 392 adjacent a forward end 406 thereof. The loops of mounting locations 402 and 404 extend generally downwardly from pivotable member 314. A removable securing mechanism 408 is positioned adjacent and spaced rearwardly from forward end 406 of first segment 392 of pivotable handle 314. Securing mechanism 408 includes a handle 410 with a rod 412 extending therefrom. Securing mechanism 408 selectively secures second segment 394 to first segment 392 of pivotable handle 314 at a desired position, as detailed later.

A first set 414 of pivotable member mounting locations is mounted on first segment 392 adjacent forward end 406 thereof and has substantially the same configuration as first set 342 of frame mounting locations and thus is described here only briefly. First set 414 includes a pair of mounting structures 416 each having a bar 418 with axially extending mounting members 420 each defining an axially extending axis 422 as described with first set 342 of frame mounting locations.

A second set 424 of pivotable member mounting locations is disposed on second portion 388 of pivotable member 314. More particularly, second set 424 includes a first pair of mounting locations 424A in the form of mounting members 426 removably connected to and extending in the axial direction laterally from opposite sides of second portion 388 of pivotable member 314. An axially extending axis 428 extends through each mounting member 426 whereby mounting members 426 are coaxial with one another. Second set 424 of pivotable member mounting locations also includes a second pair of mounting locations 424B which are movably mounted on second portion 388. More particularly, the second mounting locations 424B includes a movable mounting structure in the form of a slidably moveable sleeve 430. A pair of mounting members 432 are removably connected to and extend axially respectively from opposite sides of sleeve 430 (FIG. 24) and define a common axis 434 which extends in the axial direction. Sleeve 430 is substantially cylindrical and defines an interior through passage 436 (FIG. 19) which receives second portion 388 of pivotable member 314 whereby sleeve 430 is slidable along second portion 388. Sleeve 430 defines a threaded hole 438 (FIG. 19) which receives a locking member 440 having a threaded portion which threadably engages sleeve 430 via threaded hole 438 in order to selectively secure or lock sleeve 430 and thereby mounting locations 424B at a desired position.

First set 342 of frame mounting locations and first set 414 of pivotable member mounting locations are used in conjunction with one another for the mounting of gas springs 318 or other force producing mechanisms, as will be discussed in further detail below. Similarly, second set 352 of frame mounting locations and second set 424 of pivotable member mounting locations are used in conjunction with one another for mounting gas springs 318, as shown in FIGS. 17 and 18. More particularly, each gas spring 318 has a first end 442 and a second end 444 opposed thereto and is elongated between said first and second ends 442 and 444. Each gas spring 318 includes a piston 446 and cylinder 448 which slidably receives piston 446 therewithin. Regarding the positioning of gas springs 318 shown in FIGS. 17-18, the pistons 446 of a respective pair of gas springs 318 are pivotally and removably mounted adjacent respective first ends 442 thereof to a respective pair of mounting members 354A about axis 356 thereof and the respective cylinders 448 of said pair of gas springs 318 are pivotally and removably mounted adjacent respective second ends 444 thereof respectively to mounting members 426 about axis 428 thereof.

Figure 20:
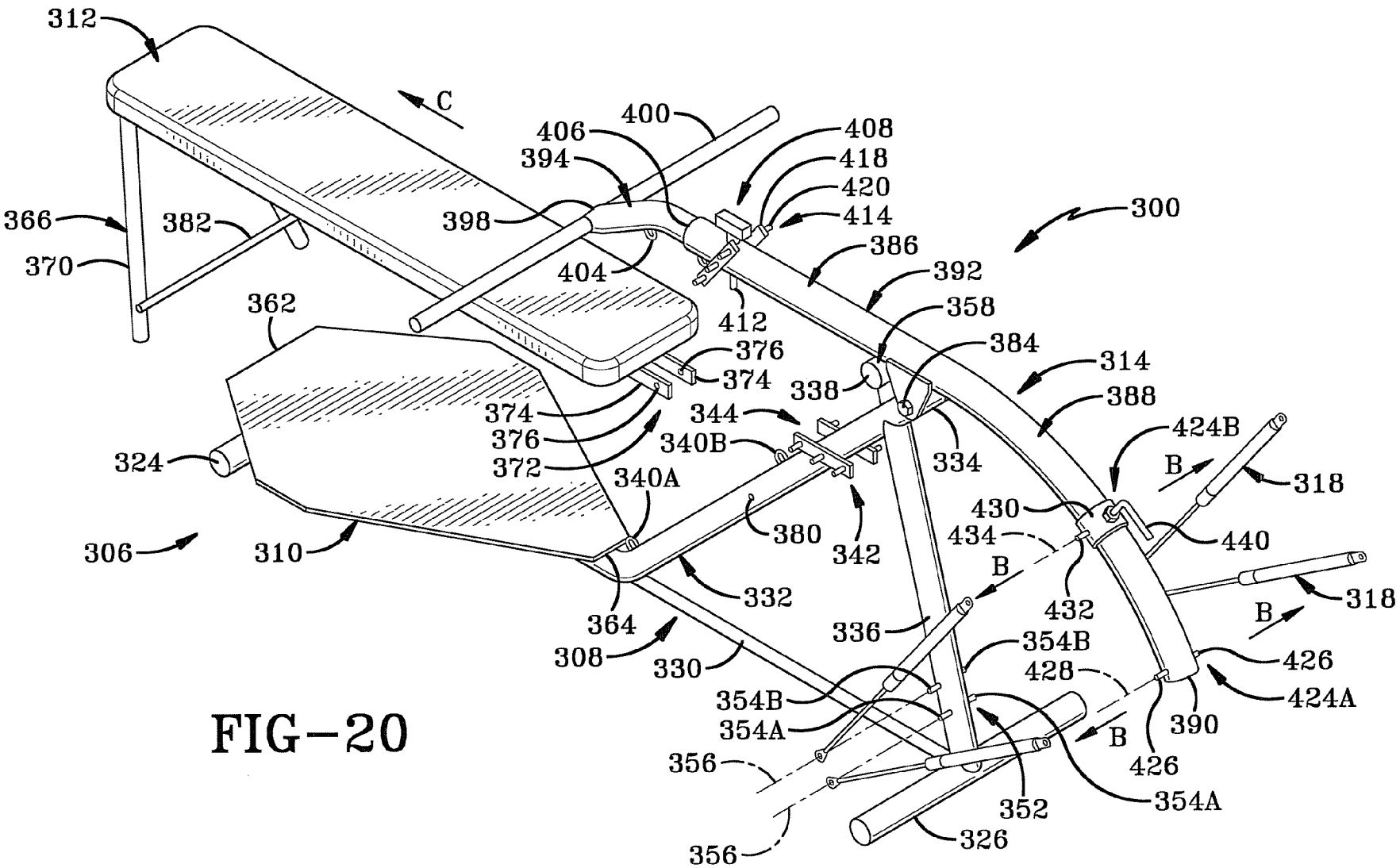
FIG. 20 is a perspective view of the third embodiment of the present invention showing removal of the bench and the gas springs.

As noted above, each gas spring 318 is preferably mounted on the respective mounting members such as mounting members 354, 426 and 432 via a quick-release snap-fit ball and socket connection. Thus, each end of gas spring 318 includes a socket which is respectively likewise identified at 442 and 444 and which receives therein the ball or ball stud of these mounting members to provide this quick-release snap-fit connection. As previously noted, FIGS. 17, 18 and 20 show gas springs 318 in a fully extended position at rest and under internal pressure. In this fully extended position, the first and second end sockets 442 and 444 define therebetween the same linear distance as that defined between mounting member 354A and mounting member 426 and also between mounting member 354B and mounting member 432, when pivot arm 314 is in its home position abutting stop 358. Since gas springs 318 are in their fully extended positions when pivot arm 314 is in the home position, stop 358 is thus positioned to ensure that pivot arm 314 does not rotate in the counter clockwise direction to the degree which would cause over extension of gas springs 318. The fact that stop 358 prevents over extension of gas springs 318 thus prevents the damage that would otherwise assuredly occur to gas springs 318 and/or the associated mounting members during regular use of machine 300. The correct positioning of stop 358 thus ensures the longevity of machine 300.

A second pair of gas springs 318 are respectively pivotally and removably mounted adjacent first ends 442 thereof to mounting members 354B on leg 336 and pivotally mounted adjacent respective second ends 444 thereof to respective mounting members 432 on sleeve 430. As shown in FIG. 18, the upper or outer ends 444 of this second pair of gas springs 318 is moveable in a direction indicated by Arrow A in accordance with the sliding movement of sleeve 430 along second portion 388 of pivotable member 314 as the gas springs 318 pivot about mounting members 354B at the pivotal connection adjacent inner or lower ends 442. This second pair of gas springs 318 and sleeve 430 are shown in phantom in two alternate positions indicating the selective aspect of positioning the mounting members 432 as desired. The length of second portion 388 of pivotable member 314 is sufficient to provide a suitably large range of mounting locations for gas springs 318 via sleeve 430 or another mounting structure to provide a suitable range of force variation which may be selected by the user. This length is simultaneously suited so that in the fully rearward rotated position of pivotable member 314, terminal end 390 is adjacent second foot 326 without contacting floor 322.

It is noted that, as illustrated with machine 200 if FIGS. 13-14, force producing mechanisms may be simultaneously mounted on each of the first and second portions 386 and 388 of pivotable member 314, and may include different types of force producing mechanisms so that one produces force during extension and the other produces force during retraction or compression.

The operation of exercise machine 300 is now described. With references to FIGS. 17 and 18, locking member 440 is loosened if desired to allow the adjustment of the position of sleeve 430 and thereby the position of mounting members 432 and the pair of gas springs 318 pivotally mounted thereon. Once sleeve 430 is moved to a desired position, locking member 440 is tightened to lock sleeve 430 in position in preparation for use of machine 300. The slidable nature of sleeve 430 along second portion 388 allows an infinite number of positions along second portion 388. This allows for different degrees of resistance to the movement of pivotable member 314 whereby the closer that sleeve 430 is to pivot axis 316, the less resistance will be experienced by the user of machine 300 and the farther sleeve 430 is positioned from pivot axis 316, the greater the resistance that will be experienced. Thus, the phantom position indicated at 450 in FIG. 18 is a relatively easier position while the phantom figure indicated at 452 in FIG. 18 is a relatively harder position with respect to the degree of resistance that must be overcome to rotate pivotable member 314. The constant arc of second portion 388 of pivotable member 314 detailed above allows sleeve 430 to slide smoothly without binding when pivotable member 314 is in the fully forward rotated position Once sleeve 430 and the gas springs 318 connected thereto are positioned as desired, the user of machine 300 may lay, sit or assume any other suitable exercise position on bench 312, such as those described with regard to the previous embodiments, in order to perform such exercises as bench presses or overhead presses and so forth. The user would thus typically grasp handle 400 and move handle 400 rotatably upwardly such that pivotable member 314 pivots about axis 316 against a resistance force produced by the gas springs 318 connected to leg 336 and second portion 388 of pivotable member 314. Any number of gas springs may be used and machine 300 may be modified in order to include additional mounting locations and additional gas springs or other force producing mechanisms for increasing the amount of force if desired. Preferably, gas springs or other force producing mechanisms are used in pairs on opposite sides of pivotable member 314 in order to minimize any binding of pivotable member 314 about pivot member 384.

As shown in FIG. 20, gas springs 318 are removed as indicated by Arrows B in preparation for use in alternate locations and may be reinstalled as desired. More particularly, FIG. 20 illustrates the removal of gas springs 318 while they are in their fully extended positions. In fact, gas springs can only be removed safely from their respective mounting members when gas springs 318 are fully extended. As previously noted, pivot arm 314 is in its home position when it abuts stop 358, which also sets the distance between the corresponding mounting members at the fully extended distance between the respective end sockets 442 and 444 of a given gas spring 318. Thus, each gas spring 318 can only be removed from its respective mounting members when pivot arm 314 abuts stop 358. This is true because stop 358 prevents the over extension of gas spring 318, and also because the removal of gas springs 318 when compressed to any degree would be dangerous and difficult if not substantially impossible. By way of example, the typical gas spring used on the present machine is under an internal pressure on the order of 180 pounds per square inch whereby any removal of gas spring 318 in a state of compression would result in its rapid extension which could obviously cause injury.

As previously noted, gas springs in the exemplary embodiment are connected to the frame and pivot arm by respective quick-release snap-fit ball and socket connections. Each of these connections may thus be quickly released simply by pulling on or applying a force in the direction indicated by Arrows B on the given socket end of the respective gas spring 318 in order to disconnect said socket from the ball or ball stud of respective mounting member 354, 426 or 432. The mounting of the respective socket end of the respective gas spring 318 is also accomplished simply by pressing that end onto a respective mounting member. Thus, the removal of the respective end of gas spring 318 from the respective mounting member may be accomplished by the linear movement shown by the respective Arrow B. Likewise, the installation of a given socket end of a given gas spring 318 is accomplished simply by the linear movement opposite the direction shown in Arrow B onto the respective mounting member to create the snap-fit connection. This quick-release removable snap-fit connection thus provides for a very simple mounting and dismounting of gas springs 318 such that no additional fasteners are needed which extend from a given end of the gas spring to the respective mounting member, pivot arm 314, collar 430 or the frame of machine 300. This quick-release connection also eliminates the need for other fastening mechanisms such as cotter pins inserted through a hole to secure an end of a gas spring on a mounting member, or the use of a threaded connection between a pair of threaded members such as an externally threaded shaft and an internally threaded nut. While these various other types of securing mechanisms may be used to secure gas spring 318 on pivot arm 314 and the frame of machine 300, this quick-release connection provides a safe and rapidly deployable mounting and dismounting of the gas springs.

Figure 21:
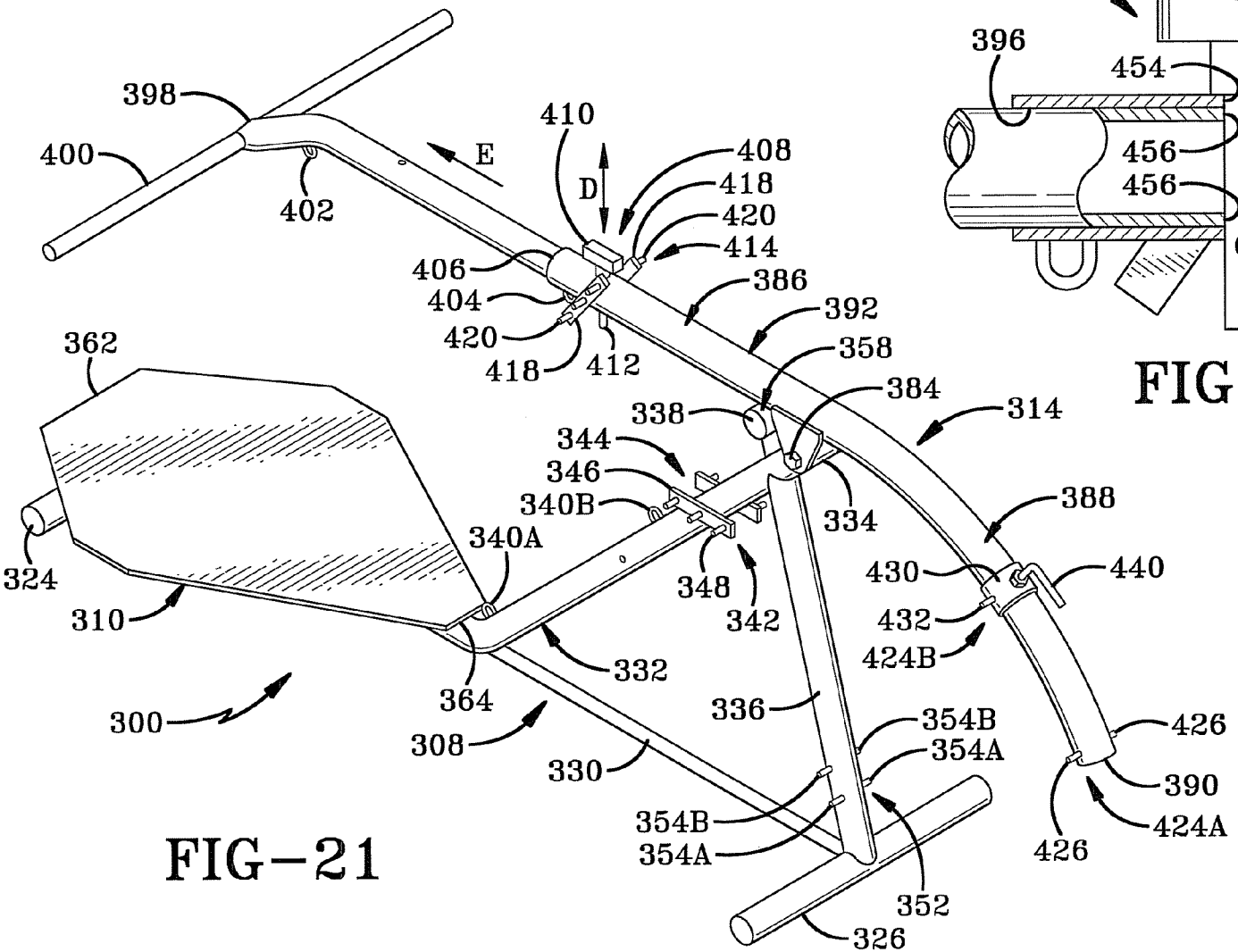
FIG. 21 is a perspective view of the third embodiment after removal of the bench and gas springs showing extension of the handle.

In addition, bench 312 along with bench mounting frame 366 is removable from frame 308 as indicated by Arrow C in FIG. 20 once bolt 378 is removed from holes 376 of yoke 372 and hole 380 of mounting arm 332. Once bench 312 is removed, standing platform 310 is exposed for use as shown in FIG. 21. In addition, securing mechanism 408 is removable and reinsertable as indicated by Arrow D in FIG. 21 in order to allow second segment 394 of pivotable handle 314 to be moved outwardly as shown by Arrow E in FIG. 21, thus extending pivotable member 314 and handle 400 outwardly to an alternate location which may be more suitable to standing exercise of machine 300. More particularly with regard to securing mechanism 408 and with reference to FIG. 22, first segment 392 of pivotable member 314 defines a pair of holes 454 and second segment 394 defines a pair of holes 456 aligned therewith for removably receiving rod 412 of securing mechanism 408 in order to allow the extension of handle 440 as previously described.

Figure 23:
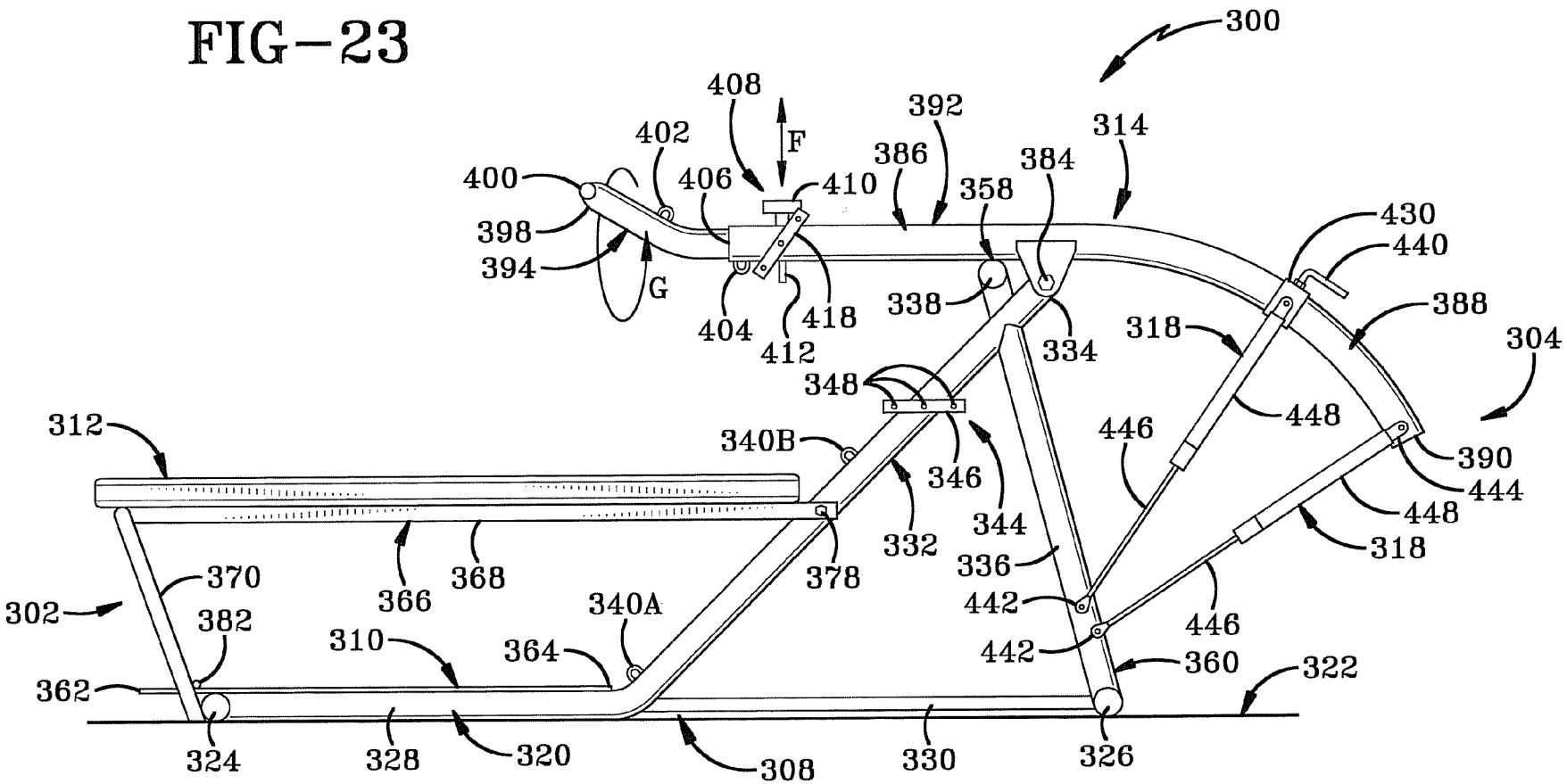
FIG. 23 is a side elevational view of the third embodiment showing the rotation of the handle to a raised position.

Removal and reinsertion of securing mechanism 408 as indicated by Arrow F in FIG. 23 also allows the rotational movement of second segment 394 as indicated by Arrow G in FIG. 23 to allow second segment 394 to move to a second position wherein the portion of second segment 394 adjacent end 398 angles upwardly and handle 400 is positioned upwardly relative to the first position shown in the previous figures. The rotation of second segment 394 maybe used in conjunction with bench 312 connected as shown in FIG. 23 or removed as desired to facilitate different exercises or the preference of the individual user of machine 300. Other mechanisms for adjusting handle 400 to alternate positions will be readily evident to those skilled in the art.

Figure 24:
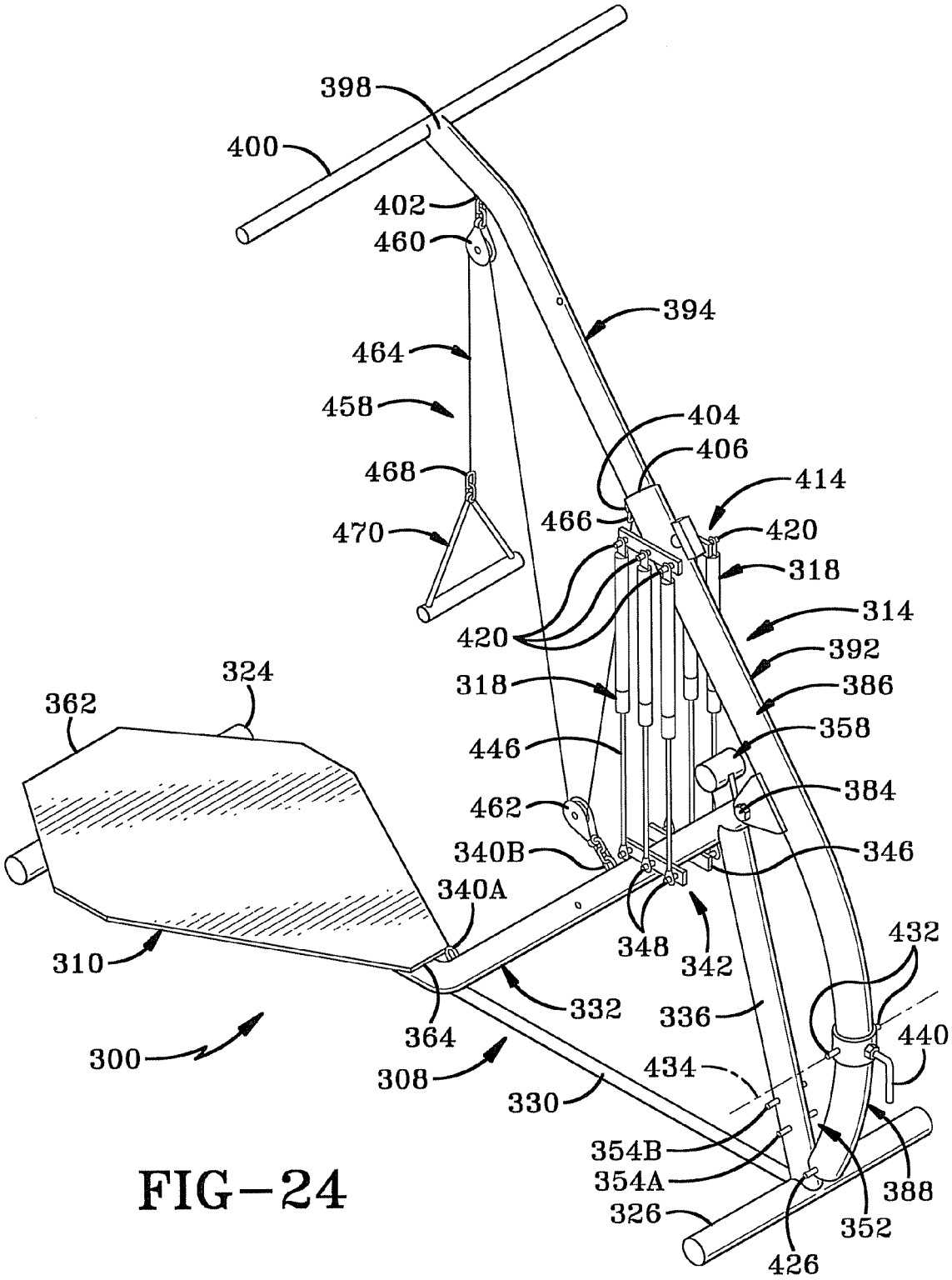
FIG. 24 is a perspective view of the third embodiment of the present invention utilizing a pulley and cable assembly and alternate location of the gas springs wherein the bench is removed.
Figure 25:
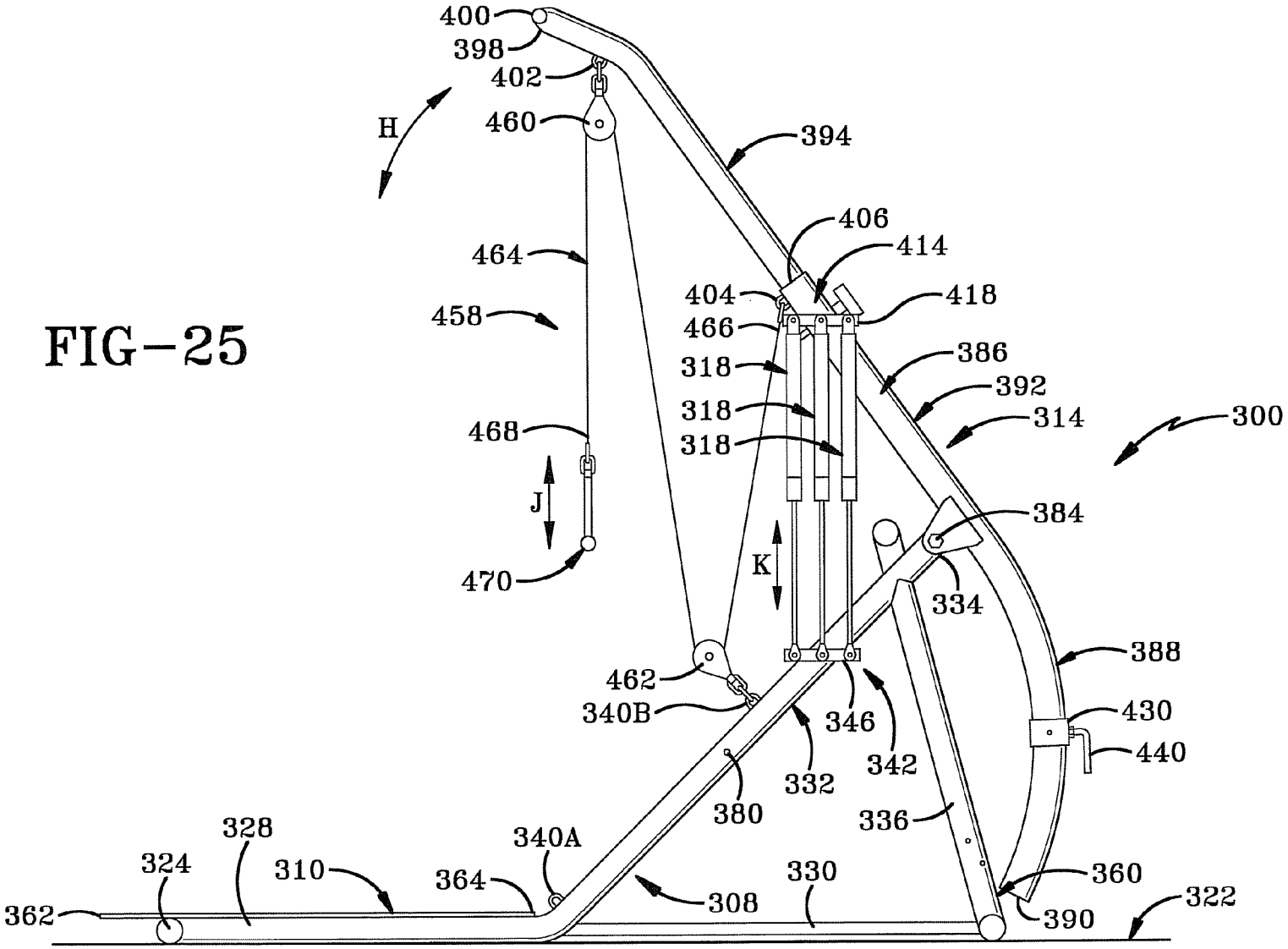
FIG. 25 is a side elevational view of the third embodiment indicating movement of the pivotable member, the cable pull handle and the gas springs.
Figure 26:
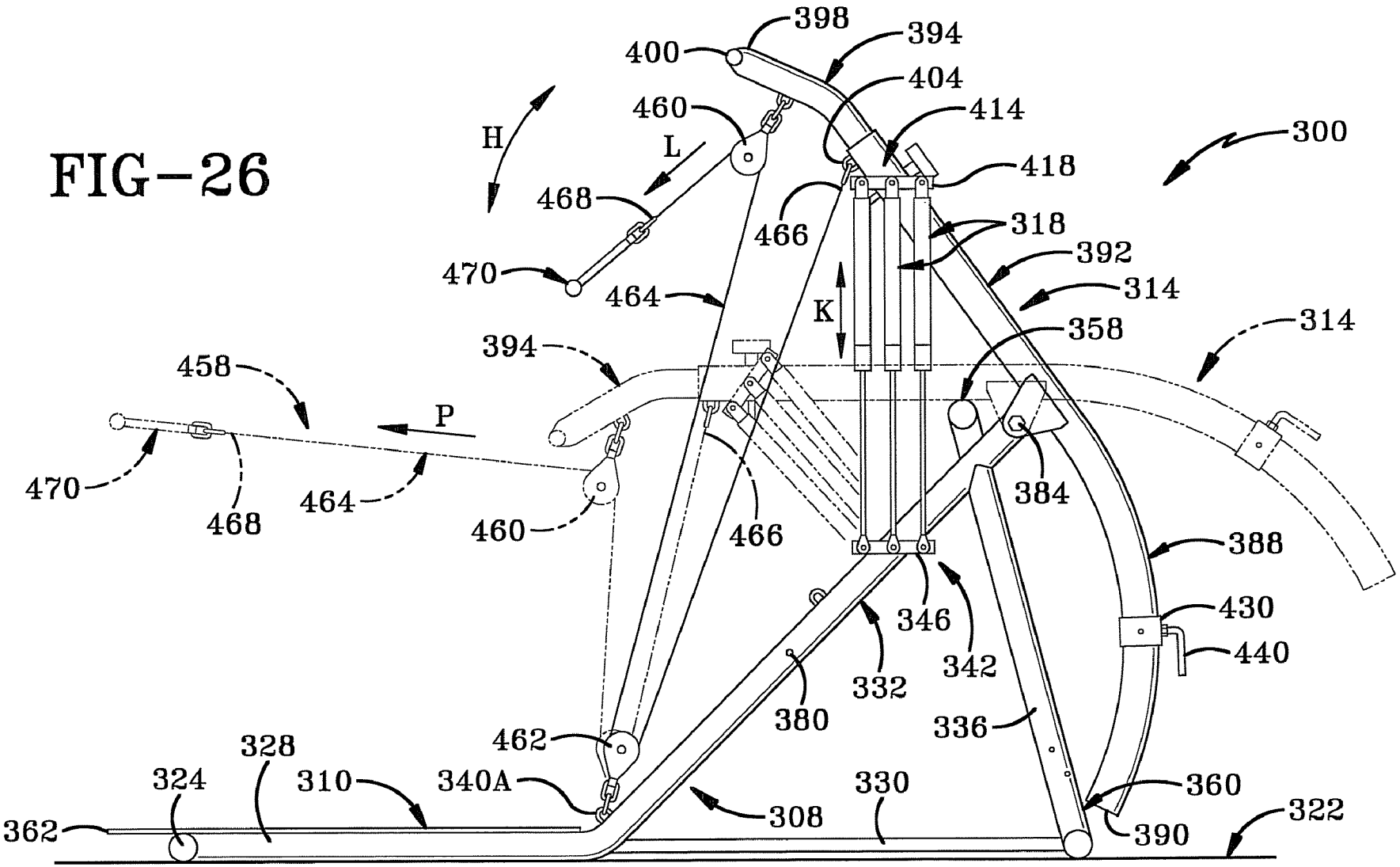
FIG. 26 is a side elevational view of the third embodiment showing a first position in solid lines and a second position in phantom to illustrate the varying direction of the origin of the resistive force to the movement of the cable pull handle.

With references to FIGS. 24-26, some of the versatility of machine 300 is revealed. Gas springs 318, having been removed from mounting members 354, 426 and 432, are now shown mounted on respective mounting members 348 and 420. Gas springs 318 are mountable and dismountable on mounting members 348 and 420 by the same quick-release mechanism discussed previously. An additional pair of gas springs 318 has been added to indicate the use of a total of six gas springs in the position of machine 300 shown in FIGS. 24-26. Machine 300 may also include a cable-pulley assembly 458 which includes an upper pulley 460, a lower pulley 462 and a flexible line in the form of a cable 464 which movably engages pulleys 460 and 462 in a manner known in the art.

The flexible line may also be in the form of a rope or other suitable flexible material capable of use with pulleys and having sufficient tensile strength for the intended use. Upper pulley 460 is mounted on mounting location 402 of extendable second segment 394 of pivotable member 314 and lower pulley 462 is mounted on mounting location 340B of frame 308. Cable 464 has a first end 466 which is mounted at mounting location 404 and a second end 468 on which is mounted a handle 470.

The very simple removal of gas springs and reattachment as discussed above allows machine 300 to be used in a resistance mode when pivotable handle 314 is rotated in the first direction (counterclockwise, FIG. 25) with first portion 386 thereof moving generally downwardly towards standing platform 310 or bench 312 when attached to frame 308. Thus, with or without bench 312 mounted on frame 308, the user can either pull downwardly on handle 400 against resistance provided by gas springs 318 or may pull downwardly and/or in a forward direction towards front end 302 of machine 300 on handle 470 against said resistance. The use of machine 300 in this manner may be achieved with or without extending second segment 394 of pivotable member 314. However, extending second segment 394 facilitates exercise in a standing position. It will be appreciated that second segment 394 may be adjusted to any location between a fully retracted and a fully extended position to allow for a greater variety of positions for use of machine 300. It will be appreciated in addition, that the extension and retraction of second segment 394 also affects the amount of force which must be used to overcome the resistance provided by gas springs 318 as the more extended positions provided a greater amount of leverage.

As discussed with the positioning of gas springs 318 when used with sleeve 430 and associated mounting locations, the various mounting locations 348 and 420 provide a varying degree of force, with a greater degree of force being produced by a gas spring which is mounted on mounting locations 348 and 420 which are relatively farther away from pivot axis 316 with respect to the other mounting locations 348 and 420. In addition, of course, the user may select the number of gas springs 318 that are desired to produce a suitable resistance force for that individual user. Further, one gas spring 318 may be mounted at any of the mounting locations 348 and 420 to vary the force, that is, for example, one gas spring 318 may be mounted on any one of mounting members 348 and any one of mounting members 420 and may or may not be used in conjunction with another gas spring mounted at mounting locations 348 and 420.

Referring to FIG. 25, Arrow H indicates the pivotable movement of pivotable member 314 in the first direction (counterclockwise) and the second direction (clockwise). Arrow J indicates generally the back-and-forth movement of handle 470 and cable 464 which also affects the movement of pivotable member 314. Arrow K in FIG. 25 indicates the extension and retraction of gas springs 318 in response to the movement of pivotable member 314. With reference to FIG. 26, machine 300 also provides a unique feature with regard to the use of cable-pulley assembly 458 in the configuration shown or a similar configuration. FIG. 26 shows machine 300 with second segment 394 of pivotable member 314 in a retracted position and with lower pulley 462 mounted at mounting location 340A instead of 340B.

When the user of machine 300 pulls handle 470 in the direction shown by Arrow L in FIG. 26 to compress spring 318 in the direction indicated by Arrow K, pivotable member 314 moves downwardly along the path of Arrow H to the position shown in phantom lines. At the position shown in phantom lines, handle 470 is being pulled forward in the direction shown by Arrow P, thus demonstrating a changed direction in which handle 470 is pulled and a corresponding change in the direction of the origin of force against which handle 470 is pulled. It will be appreciated that as pivotable member 314 rotates toward the fully forward rotated position shown in phantom, this direction of the origin of force changes continually throughout the pivoting movement of pivotable member 314. At any given time during the pulling of handle 470, the direction along which the resistance force is acting with respect to the user of machine 300 is defined by the linear portion of cable 464 extending from upper cable 460 to handle 470. This change in the direction of the origin of force allows the user of machine 300 to experience the exercise of various muscle groups in a continually changing fashion during the course of pulling handle 470 and/or the use of differing muscle groups due to the changing direction of the origin of force. Applicant also contemplates that this changing of the direction of origin of force will be applicable in other regards.

FIG. 26 also illustrates well the use of first stop 358 and second stop 360. In particular, first stop 358 limits the rotation movement of pivotable member 318 in the first direction when pivotable member 314 contacts first stop 358 as indicated by the pivotable member 314 in phantom. Second stop 360 limits the rotation of pivotable member 314 in the second direction when terminal end 390 of pivotable member 314 contacts second stop 360, which is approximated in FIG. 26 in the solid line illustration of pivotable member 314. (An analogous stop of exercise machine 200 illustrating actual contact by pivotable member 230 is shown in FIG. 15.) The limitation of rotation by stops 358 and 360 serves in part to protect gas springs 318 from damage associated primarily with over extension thereof and also with over compression.

More particularly, FIG. 26 shows pivot arm 314 in solid lines in a position rotated fully clockwise as viewed from the right of the machine such that terminal end 390 abuts stop 360 to prevent further clockwise rotation of pivot arm 314 and to set the distance between the respective sets of mounting members 348 and 420 at the same distance as that defined between the first and second end sockets 442 and 444 of the respective gas spring 318 in its fully extended position. The contact of terminal end 390 with stop 360 thus prevents the over extension of gas springs 318 when mounted on mounting members 348 and 420 and also correctly positions mounting members 348 and 420 to allow for the removal and installation of the respective gas springs 318 thereon while in the fully extended positions. FIG. 26 also illustrates pivot arm 314 in dot dash lines in the home position previously discussed such that gas springs 318 are fully or nearly fully compressed when mounted on mounting members 348 and 420. Stop 358 in the configuration shown in FIG. 26 thus prevents additional counter clockwise movement of pivot arm 314 in order to prevent over compression of gas springs 318, thereby eliminating any damage to gas springs 318 or the corresponding mounting members which could result due to such over compression. Stop 358 thus serves a dual purpose with regard to protecting gas springs 318, namely the prevention of over compression of gas springs 318 when they are mounted on mounting members 348 and 420, and the prevention of over extension of gas springs 318 when they are mounted on mounting members 354, 426 and 432 as illustrated in FIGS. 17, 18 and 20.

Figure 27:
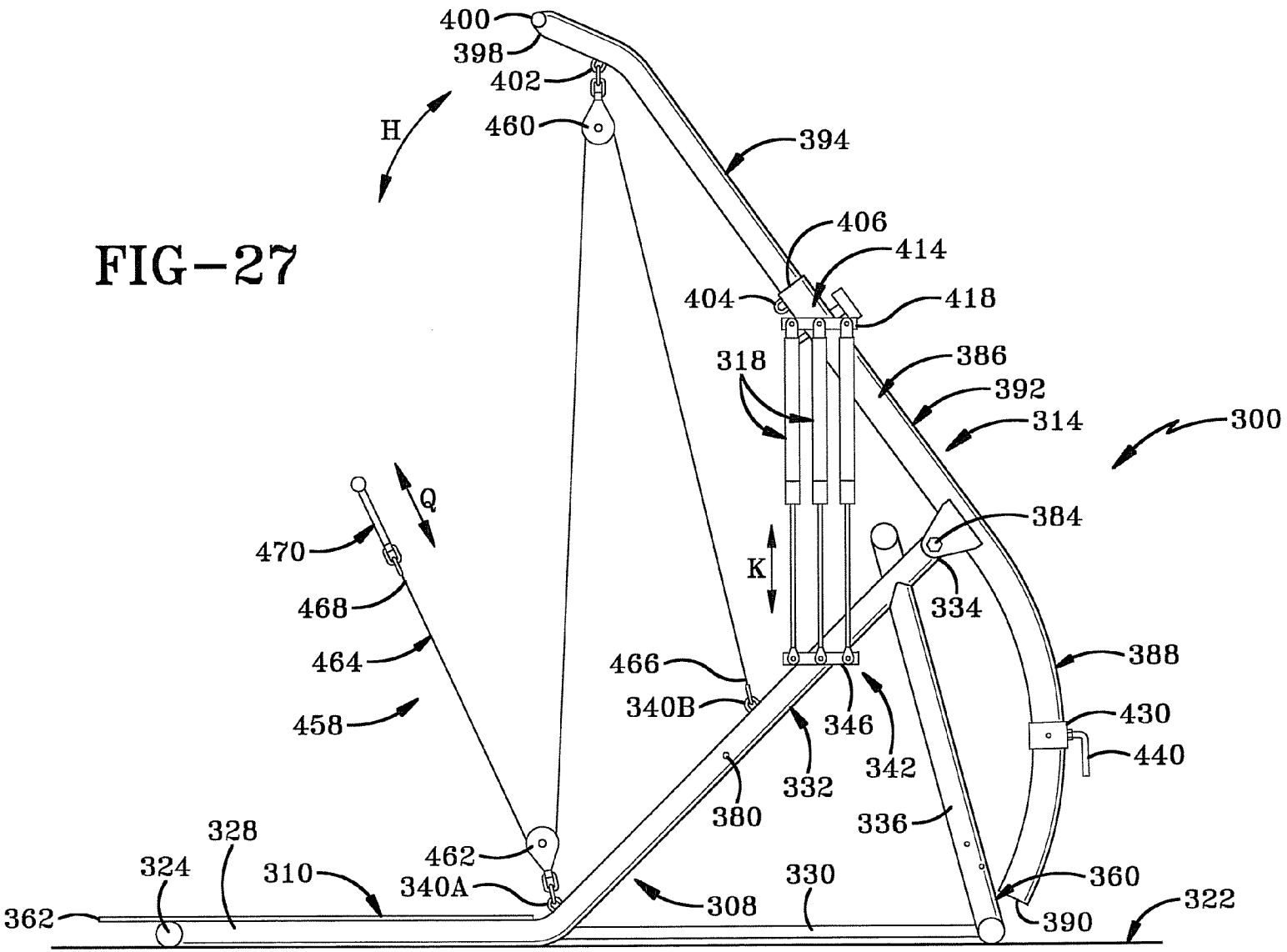
FIG. 27 is a side elevational view of a third embodiment of the present invention utilizing an alternate cable and pulley assembly.

FIG. 27 illustrates the use of machine 300 with cable-pulley assembly 458 situated in a different orientation. In particular, while upper pulley 460 and lower pulley 462 are mounted in the same location as shown in FIG. 26, second segment 394 of pivotable member 314 is again in the extended position and cable 464 is connected adjacent first end 466 thereof at mounting location 340B of frame 308 so that cable 464 is looped about pulleys 460 and 462 in a fashion generally opposite to that shown in FIG. 26. More particularly, cable 464 extends from mounting location 340B upwardly and over pulley 460 and then downwardly and around lower pulley 462 so that second end 468 and handle 470 may be pulled in a generally upward direction by the user of machine 300 in order to take advantage of a different direction of the origin of force. It is noted, however, that this arrangement of cable-pulley assembly 458 does not provide the changing direction of the origin of force as a result of the pivotable movement of pivotable member 314 as discussed with regard to FIG. 26. As a result of the alternate orientation of cable-pulley assembly 458, handle 470 moves generally in the direction indicated by Arrow Q to move pivotable member 314 as indicated by Arrow H and gas spring 318 as shown by Arrow M, as discussed previously.

Figure 28:
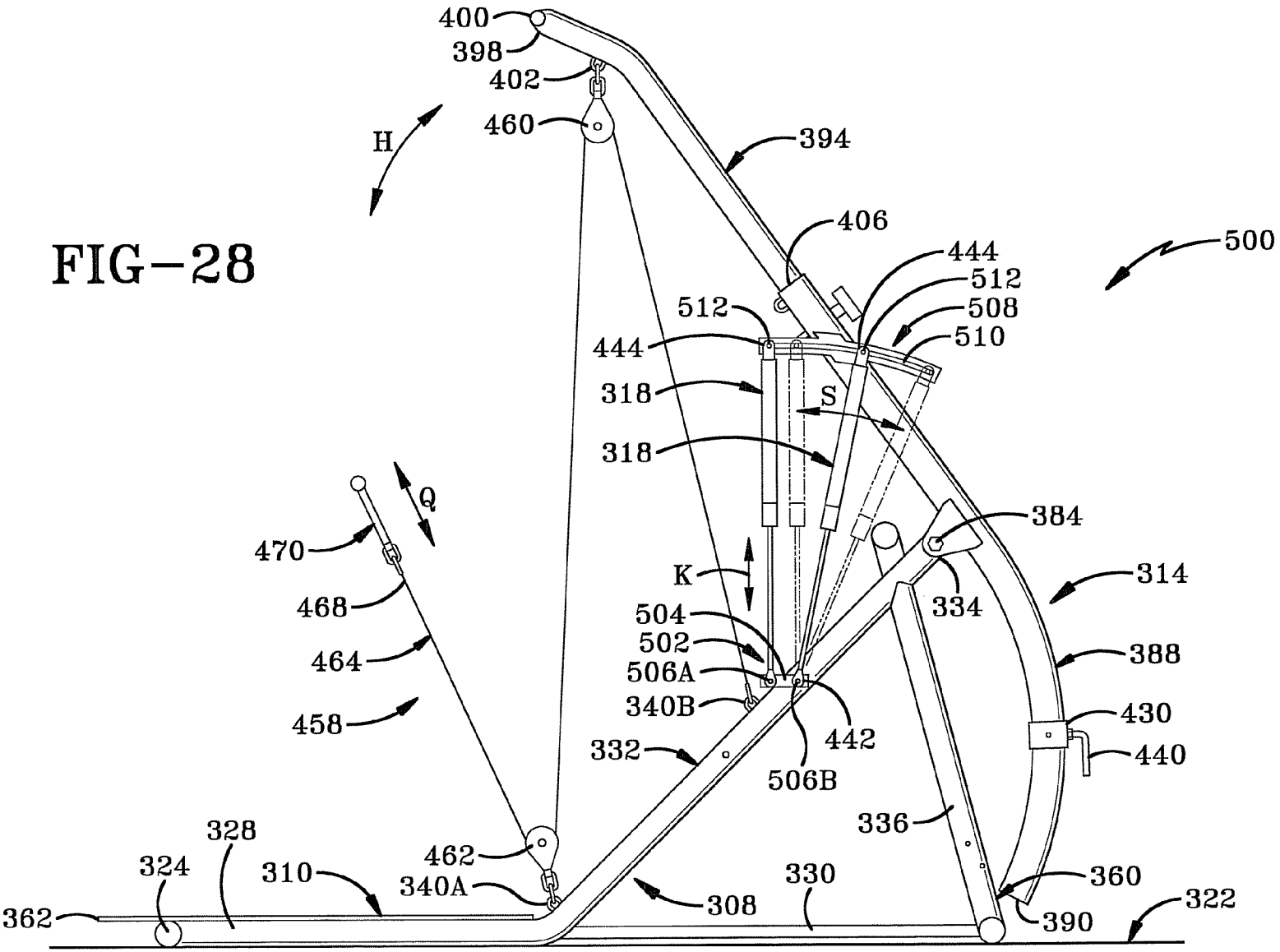
FIG. 28 is a side elevational view of a fourth embodiment of the present invention utilizing the cable and pulley assembly of FIG. 27 and an alternate gas spring adjustment configuration.

Exercise machine 500, the fourth embodiment of the invention, is shown in FIG. 28 and is similar to machine 300 except for the use of different mounting structures mounted on mounting arm 332 and on pivotable arm 314. In particular, machine 500 includes a mounting structure 502 mounted on mounting arm 332 in a position analogous to that of mounting structure 344 of machine 300. Mounting structure 502 includes a pair of bars 504 (only one shown) mounted on opposite sides of mounting arm 332. A pair of mounting members 506A and 506B extend axially from each bar 504 such that each pair of mounting members 506A and 506B are aligned with the respective pair mounted on the other bar 504 to be aligned axially as discussed with regard to mounting members 348 of machine 300. Pivotable member mounting locations are carried by an alternate mounting structure 508 mounted on pivotable member 314. Mounting structure 508 defines an arcuate slot 510. A pair of gas springs 318 are respectively mounted on mounting members 506A and 506B adjacent respective first ends 442 thereof. Each gas spring 318 is mounted adjacent a respective second end 444 thereof to mounting structure 508. In particular, a connecting member 512 is used to connect each gas spring 318 to mounting structure 508 via slot 510 such that connecting member 512 extends through slot 510 and is selectively securable to mounting structure 508 thereby. Any suitable mechanism may be used for mounting gas springs 318 to mounting structure 508 via slot 510 as will be appreciated by those skilled in the art.

One of gas springs 318 is mounted on mounting structure 508 in a selectively moveable manner as indicated by Arrow S and is securable at any position between the positions shown in phantom lines. The other gas spring 318 is mounted in a set position although it may also be moveably mounted in a manner similar to the other gas spring 318. As discussed with regard to sleeve 430 of machine 300, the movement of gas spring 318 as indicated by Arrow S in FIG. 28 similarly provides adjustability to any position along slot 510 to provide a greater or lesser degree of resistance for the user of machine 500. Once again, a lesser resistance force is created as the moveable gas spring 318 is positioned closer to axis 316 and a relatively greater force is created as gas spring 318 is moved away from axis 316.

Thus, exercise machine 300 provides a relatively compact exercise apparatus which provides resistance force for the use of exercising without the necessity of using weights or much larger machinery in order to provide a variety of exercise positions for exercising various muscle groups. Eliminating the use of weights has safety advantages and saves space, as discussed previously. It is contemplated, however, that weights may be used on a modified version of exercise machine 300 in addition to the force producing mechanism such as gas springs 318 if desired. In addition, machine 300 is a compact unit which provides a great variety of different exercises without the use of a much larger structure typically required with other exercise machinery.

A variety of changes may be made to machine 300 that are within the scope of the present invention, as will be appreciated by those skilled in the art. For example, the frame of a machine such as machine 300 may be varied in a number of ways while still providing the sufficient mounting locations and adjustability aspects that are important to machine 300. Machines similar to machine 300 may be used only with a standing platform such a platform 310 or only with a bench such as 312 although the removability of bench 312 and the use of platform 310 add to the benefits of machine 300.

Various mounting structures have been described herein with regard to machine 300 which are associated with mounting of gas springs 318 or other force producing mechanisms. It is contemplated that any of these types of mounting structures may be interchanged with one another as desired to facilitate the adjustment of the force producing mechanisms in producing greater or lesser degrees of resistant force. Thus, each of the various types of mounting structures described herein, or other suitable structures, may be disposed on either frame 306 or pivotable member 314. For instance, a sleeve like sleeve 430 may be used on leg 336 of mounting arm 332; mounting structures like structures 344 and 416 may be used on leg 336 or second portion 388 of pivotable member 314; and mounting members like mounting members 354 may be used on mounting arm 332 and pivotable member 314.

Mounting members 354 may be mounted on leg 336 in various ways. For instance, they may threadably engage a threaded hole in leg 336 or may be a single rod extending all the way through leg 336 via holes therein and held in place by various retaining clips or pins. Such options permit removal of mounting members 354, although they may be fixedly mounted by welding or by another suitable manner known in the art.

As noted sleeve 430 may be removably mounted on pivotable member 314. Sleeve 430 may be formed, for example, in two pieces which are selectively removably from one another or pivotally attached to allow removal of sleeve 430 from pivotable member 314. Such a configuration is readily applicable to use of a sleeve like sleeve 430 used on leg 336 or mounting arm 332. Another example to make sleeve 430 removable is to make mounting members 426 removable to allow sleeve 430 to slide off terminal end 390 of pivotable member 314. Where are sleeve similar to sleeve 430 is mounted on frame 308, for instance on leg 336, the frame members may be removably connected to allow removal of the sleeve therefrom. Thus, for instance, leg 326 may be removably mounted on leg 336.

The preferred removable feature of the various mounting structures described allows for their replacement if damaged instead of replacing more costly structure, such as the pivotable member or portions of the frame.

Frame 308 and pivotable member 314 are formed of tubular members, but this is not necessary to the function of the exercise machine. Thus, the structural members may be solid and may be in the form of substantially flat plates where appropriate. For instance, pivotable member 314 may be formed of a metal plate as opposed to a tubular member. A host of other options is readily apparent to one skilled in the art. While it is an advantage to have an extendable handle/first portion of the pivotable member, many exercises may still be performed on machine 300 without this feature. It will be appreciated also that the extension and retraction of handle 400 may be achieved in a great variety of ways as will be evident to those skilled in the art.

As noted previously, gas springs are preferred as the force producing mechanism. However, other force producing mechanisms known in the art may be used, either alone or in combination with gas springs. Various elastic members such as rubber or other elastomers may be suitable and particularly for creating a resistance force during extension thereof, in contrast to the compression of gas springs.

Figure 29:
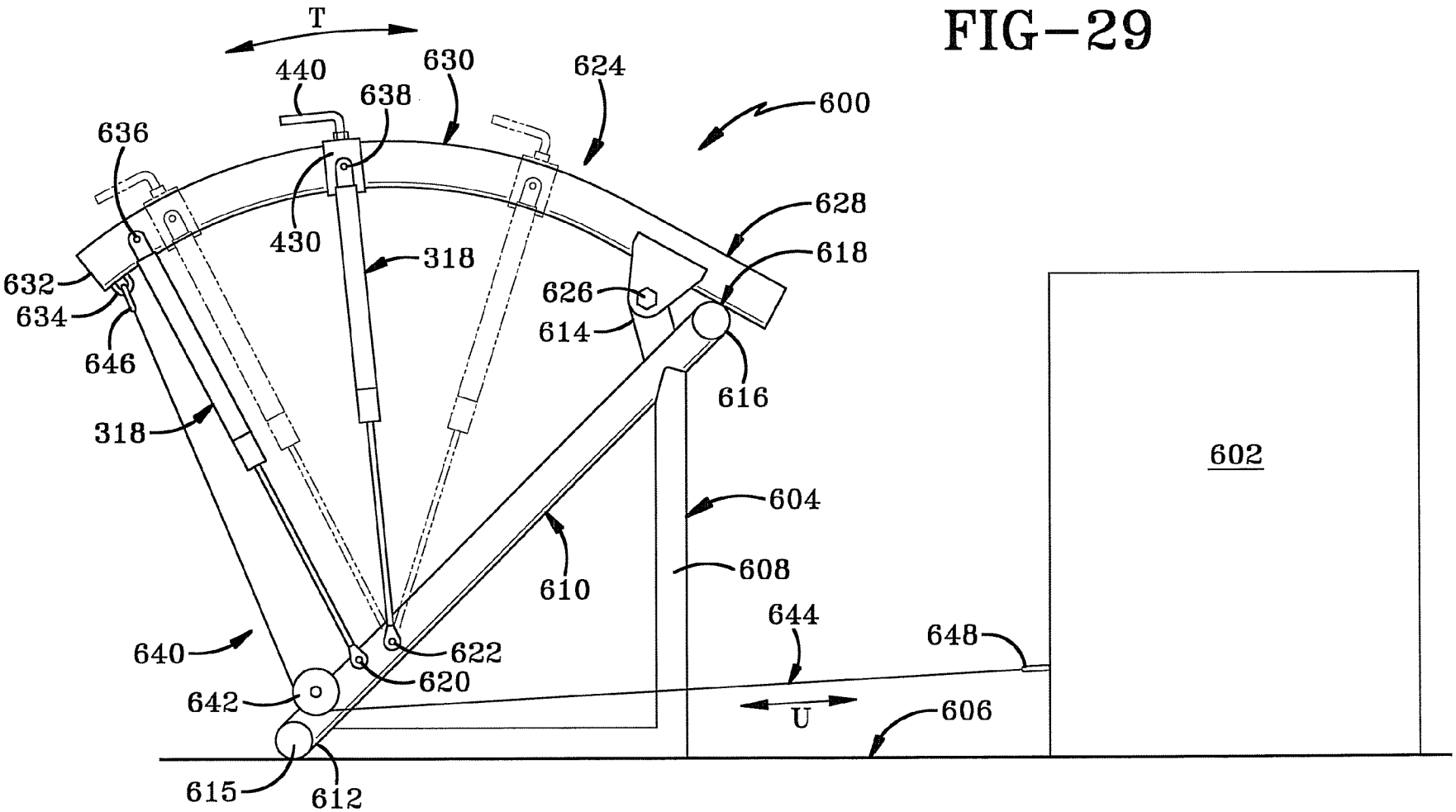
FIG. 29 is a side elevational view of a fifth embodiment of the present invention utilizing an alternate cable and pulley assembly for use with other exercise machines adapted for use with a cable.

Exercise machine 600, the fifth embodiment of the present invention, is shown in FIG. 29. Machine 600 is configured for use with a separate exercise apparatus 602. Machine 600 is a truncated version of machine 300 and thus more compact. As it is readily evident, machine 600 eliminates the use of a larger frame such as frame 308, a standing platform such as platform 310 and a bench such as bench 312 of machine 300. In addition, a truncated pivotable member is used. More particularly, machine 600 includes a frame 604 including a base 606 with an upright 608 extending upwardly therefrom. Frame 604 further includes a mounting arm 610 which angles generally upwardly from a rear end 612 of base 606 to intersect upright 608 adjacent an upper end 614 thereof. An axially extending foot 615 analogous to foot 326 of machine 300 is mounted adjacent the intersection of base 606 and mounting arm 610. Mounting arm 610 has an upper end 616 defining a stop 618. A pair of mounting members 620 and 622 analogous to mounting members 354A and 354B of machine 300 extend axially from either side of mounting arm 610, although only one pair is shown.

A pivotable member 624 is pivotally connected to frame 604 adjacent upper end 614 of upright 608 about an axially extending pivot member 626 whereby pivotable member 624 is rotatable about an axially extending pivot axis extending through pivot member 626. Pivotable member 624 includes a first portion 628 extending generally longitudinally in a first direction which is generally away from pivot member 626 and a second portion 630 extending generally and longitudinally in a direction generally opposite that of first portion 628 and way from pivot member 626. Second portion 630 is an arcuate member which has a constant curve as discussed with regard to second portion 388 of pivotable member 314 of machine 300. This constant arc is with regard to mounting member 622 in the same fashion as the arc of second portion 388 with respect to mounting member 354B of machine 300. Pivotable member 624 has a terminal end 632 distal first portion 628. A mounting location 634 in the form of a loop extends downwardly from pivotable member 634 adjacent terminal end 632. A pair of mounting members 636 (only one shown) extends from either side of pivotable member 624 in a position analogous to that of mounting members 426 of machine 300. Another pair of mounting locations 638 (one shown) extends from either side of sleeve 430 and is analogous to mounting member 432 of machine 300.

A pair of gas springs 318 is mounted in the same manner as described with regard to machine 300. Machine 600 includes a cable-pulley assembly 640 including a pulley 642 mounted on mounting arm 610 adjacent its intersection with base 606. Cable assembly 640 also includes a cable 644 which moveably engages pulley 642. Cable 644 has a first end 646 mounted at mounting location 634 on pivotable member 624 and a second end 648 which is adapted to mount to exercise apparatus 602. Apparatus 602 is a piece of the exercise machinery which is adapted to utilize a cable such as cable 644.

Thus, machine 600 is configured to provide the resistance force as discussed with regard to exercise machine 300 with the use of gas springs or other force producing or resistance mechanisms in conjunction with the use of sleeve 430 or a similar mechanism for adjusting the force as discussed therewith. As explained with regards to the exercise machine 300, sleeve 340 is moveable in the direction indicated by Arrow T in FIG. 29. In addition, cable 644 is moveable as indicated by Arrow U in FIG. 29 to move pivotable member 624 in a fashion somewhat similar to that described with regard to machine 300. Thus, machine 600 provides the advantages discussed with regard to machine 300 in using gas springs 318, sleeve 430 and so forth. As a result, exercise apparatus 602 may be adapted to utilize the resistance force provided by gas springs 318 alone or in conjunction with other force producing mechanisms associated with apparatus 602. Machine 600 is also substantially more compact than machine 300 and thus more suited to being more easily moved and positioned with regard to use with apparatus 602.

Exercise machine 700 is now described with reference to FIGS. 30-43 with additional attachments or operator engagement devices shown in FIGS. 44-47. Exercise machine includes an adapter 702 which is mountable on the front segment or leg 392 of pivot arm 314 and is configured for mounting various attachments or operator engagement devices so that these devices may be adjusted to a plurality of positions as will be described below. Adapter 702 includes a straight mounting leg 704 with its rear end slidably inserted into the interior chamber of front leg 392 and secured in a retracted position (FIG. 30) by securing mechanism 408 via rod 412 extending through one of a plurality of spaced holes (not shown) in mounting leg 704 in the same manner as described with the mounting of the T-shaped handles of previous embodiments. Adapter 702 further includes a mounting mechanism including a sleeve 706 secured to the front end of leg 704 and a handle 702 connected to a rod in a manner similar to that of handle 410 and rod 412 in order to secure the various attachments mounted in sleeve 706 via holes formed in the attachment in a manner similar to that of the attachment of leg 704 disposed in front segment 392. A D-ring or closed loop 710 is rigidly attached to the front of leg 704 adjacent sleeve 706 and provides a pulley mounting location on adapter 702. A through bore 712 is formed in sleeve 706 and is angled relative to the bore or interior chamber formed within first leg 392 so that the various attachments may be secured at an angle different than they would be if inserted directly into front leg 392.

Figure 38:
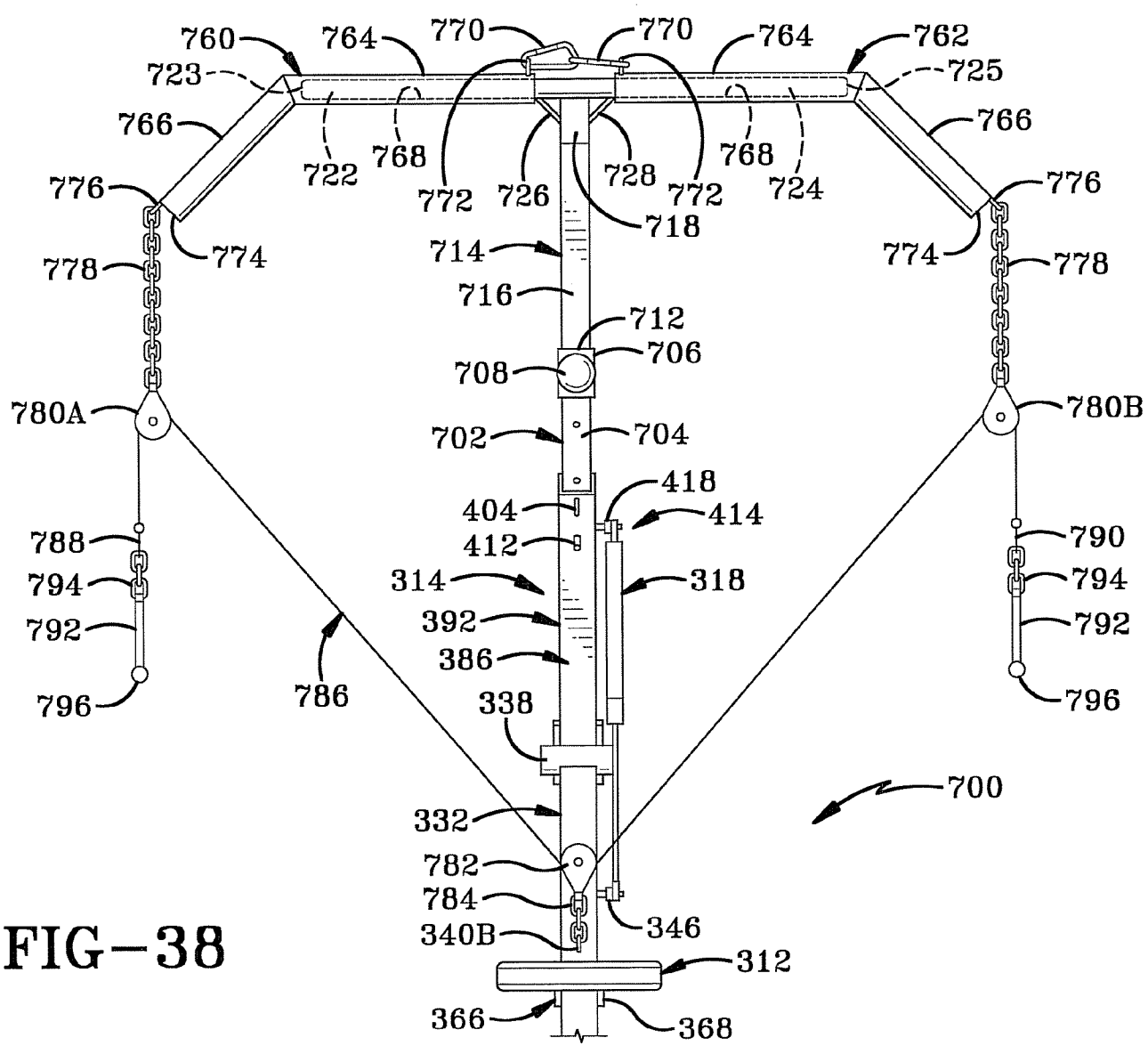
FIG. 38 is a front elevational view taken on line 38-38 of FIG. 37 showing the extender arms secured to the T-shaped handle and the cable-pulley assembly in the home position.

One operator engagement device is a T-shaped handle 714 which includes a straight mounting leg 716 which is inserted through bore 712 in one position so that it angles upwardly and rearwardly from its front end to its rear end so that the rear section of leg 714 extends above legs 714 and 392 and forms an acute angle V with each of mounting leg 714 and front leg 392 of pivot arm 314. While angle V may vary, it is in the exemplary embodiment approximately 45 degrees. Mounting leg 716, mounting leg 704 and pivot arm 314 are all aligned in common longitudinal vertical plane which extends from the front to the rear of machine 700 and cuts through its center. T-shaped handle 714 further includes a front leg 718 which is rigidly secured to the front of mounting leg 716 and angles obtusely downwardly therefrom (angle $V_a$) and perpendicular to legs 704 and 392. Angle $V_a$ may vary but is in the exemplary embodiment approximately 135 degrees. A crossbar 720 is rigidly secured to the front end of front leg 718 and includes first and second segments or legs 722 (FIG. 38) and 724 which extend outwardly in opposite directions from one another from the connection with front leg 718 to respective outer terminal ends 723 and 725 (FIG. 38). Legs 722 and 724 provide hand grips or operator engagement surfaces for manual engagement and manipulation of crossbar 720. First and second rods 726 (FIG. 38) and 728 are rigidly secured to front leg 718 and respectively to first and second legs 722 and 724 of crossbar 720 to provide respective closed loops which may serve as pulley mounting locations.

Figure 30:
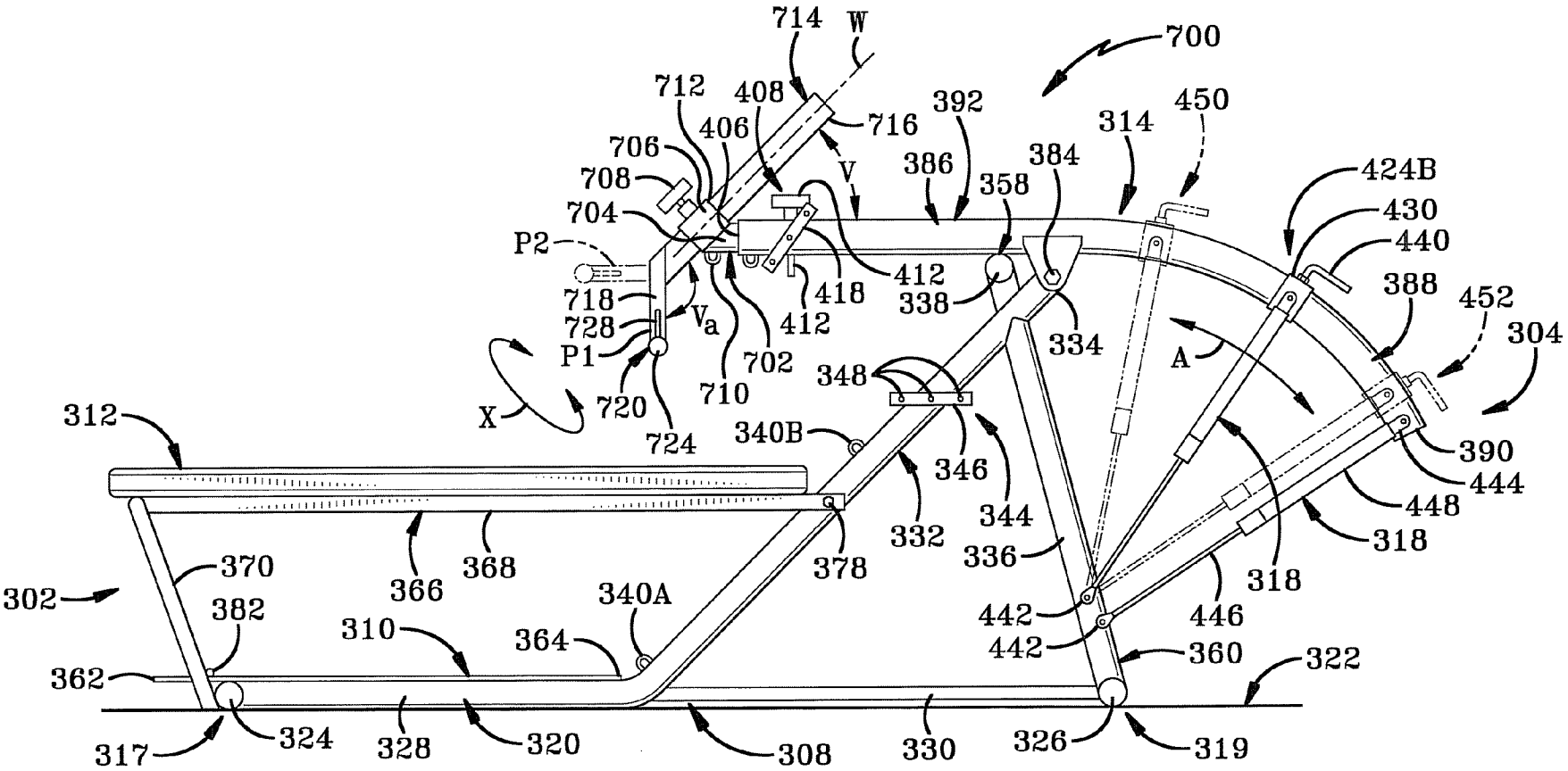
FIG. 30 is a side elevational view of the sixth embodiment of the exercise machine of the present invention with the pivot arm abutting the first stop and showing the adapter of the present invention in its retracted position and an attachment in the form of a T-shaped handle in its retracted position with phantom lines showing an alternate rotated position of the T-shaped handle.

FIG. 30 also shows that adapter 702 may be rotated 180 degrees about the longitudinal axis W of mounting leg 716 and secured by the securing mechanism of adapter 702 with front leg 718 (phantom lines) angled obtusely upwardly relative to mounting leg 716 and parallel to mounting leg 704 and front leg 392 in contrast to its perpendicular position shown in solid lines in FIG. 30. FIG. 30 thus shows position P1 in which adapter 702 is in its retracted position, mounting leg 716 (solid lines) is in its retracted position and front leg 718 angles downwardly relative mounting leg 716. FIG. 30 also shows position P2 in which adapter 702 and mounting leg 716 are in their retracted positions and front leg 718 shown in phantom lines angles upwardly relative to mounting leg 716. Adapter 702 is thus in both telescopically mounted for extension and retraction along axis W and rotatable about axis W when securing mechanism 408 is in an unsecured position. Securing mechanism 408 in its secured position prevents said extension and retraction and rotation.

Figure 30A:
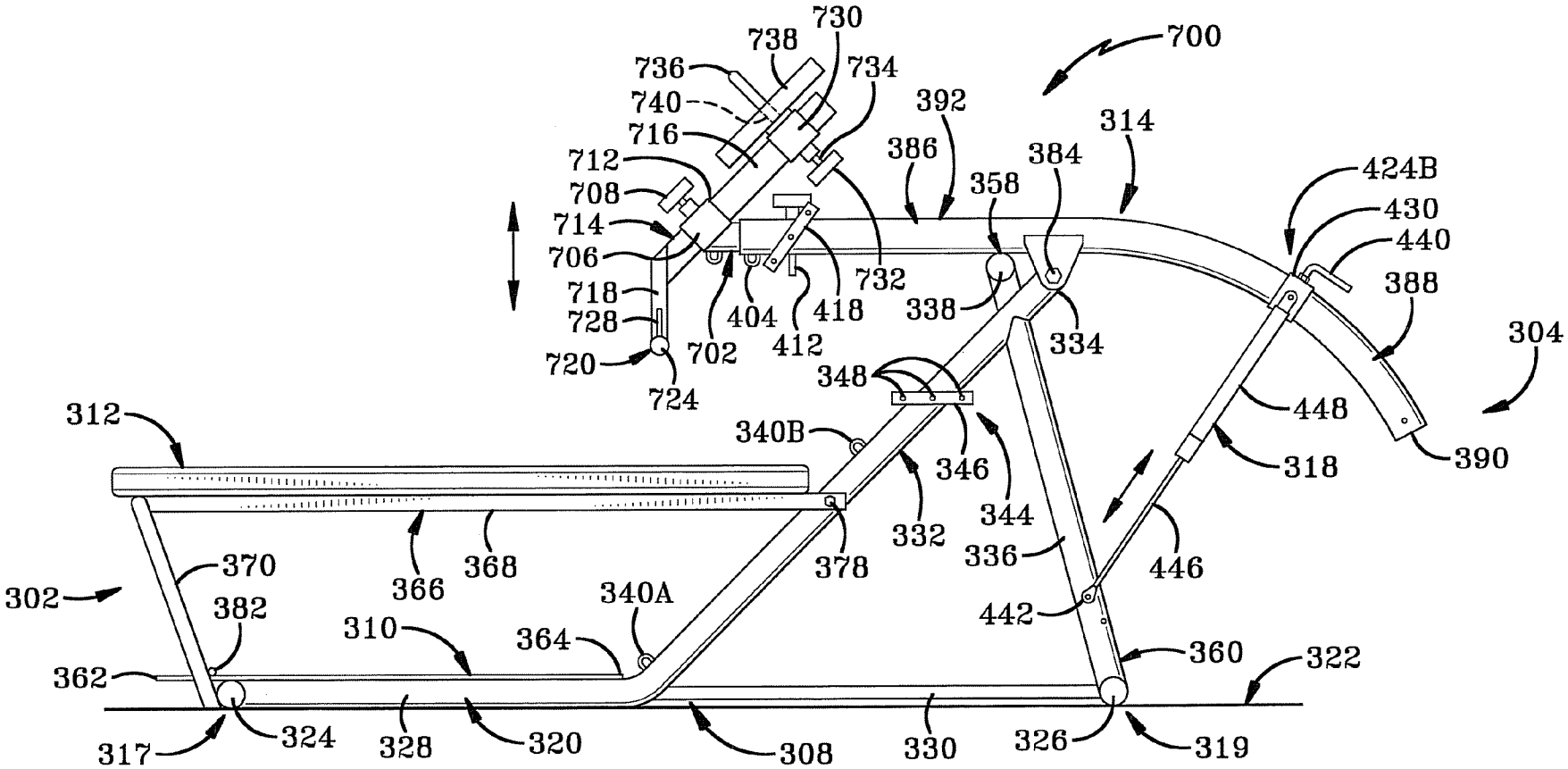
FIG. 30A is similar to FIG. 30 and shows the weight mounting mechanism attached to the T-shaped handle with a standard weight thereon.

FIG. 30A shows a resistance mechanism mount in the form of a weight attachment mechanism which includes a sleeve 730 secured to mounting leg 716 by a securing mechanism including a handle 732 and rod 734 extending therefrom and selectively positionable in the various holes formed in leg 716. A weight mounting shaft 736 is secured to and extends upwardly from sleeve 730 for mounting a standard weight 738 via a central hole 740 thereof through which shaft 736 extends. Machine 700 is thus adapted to add additional weights 738 if desired. Weights 738 provide a resistance mechanism for resisting pivotal movement at pivot arm 314.

Figure 31:
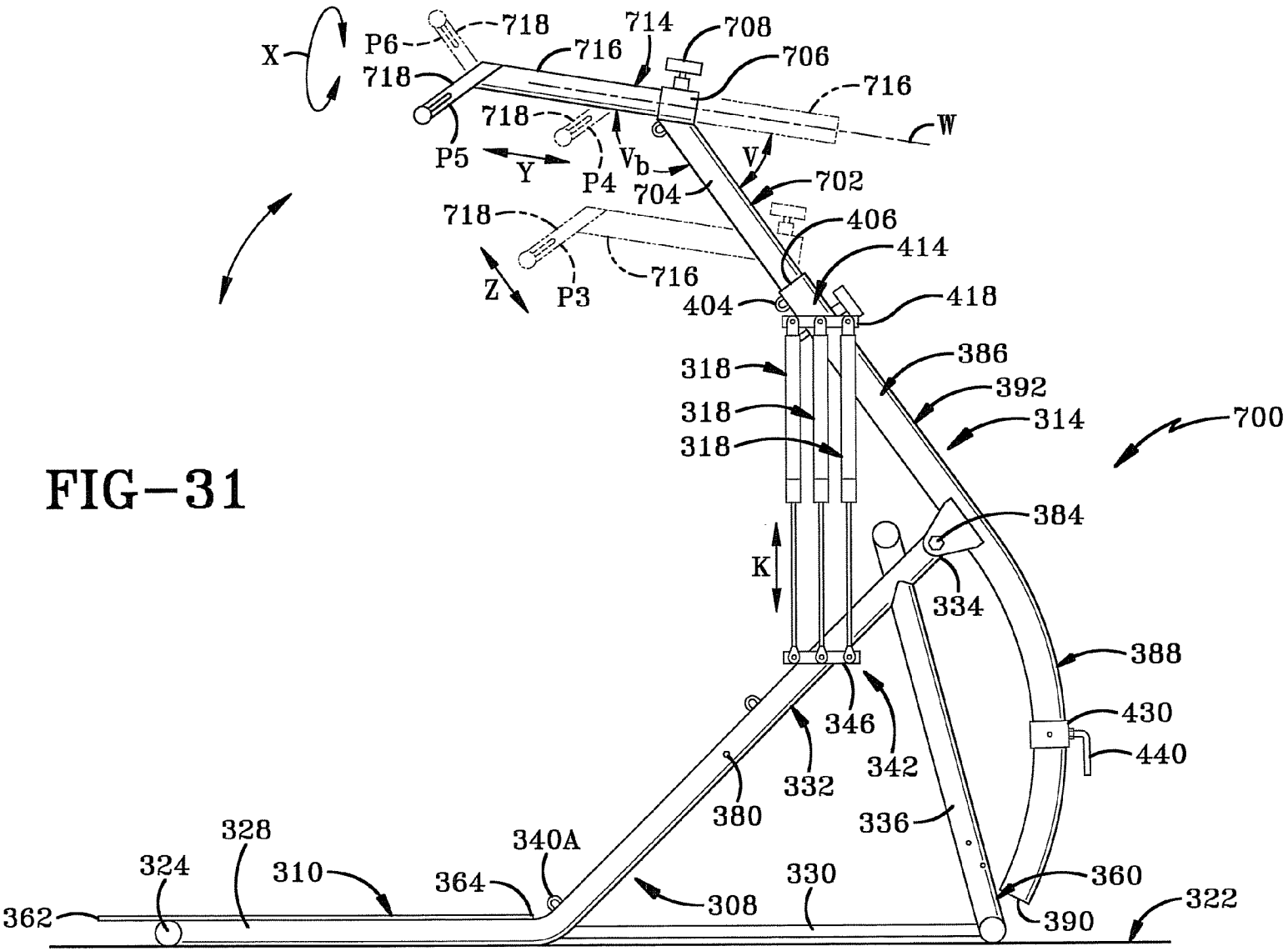
FIG. 31 is a side elevational view of the sixth embodiment with the pivot arm contacting the second stop and showing the adapter in its extended position and the T-shaped handle in its extended position with phantom lines showing various alternate positions of the adapter and T-shaped handle.

FIG. 31 shows machine 700 with the front of pivot arm 314 rotated upwardly and the rear of pivot arm rotated downwardly so that terminal end 390 abuts second stop 360. Gas springs 318 are connected on mounting bars 346 and 418 forward of pivot 384 instead of rearwardly thereof as shown in FIGS. 30 and 30A and also provide a resistance mechanism for resisting pivotal movement at pivot arm 314. Bench 312 has also been removed so that the user may stand on platform 310. FIG. 31 shows various additional positions of T-shaped handle 714 when used in conjunction with adapter 702. FIG. 31 shows positions P3, P4, P5 and P6 with position P5 shown in solid lines and the other positions shown in phantom lines. Position P3 illustrates adapter 702 in its retracted position and mounting leg 716 in its extended position with front leg 718 angling downwardly therefrom. Position P4 shows mounting leg 704 of adapter 702 in its extended position with mounting leg 716 in its retracted position and front leg 718 angling downwardly therefrom. Position P5 shows adapter 702 in its extended position and mounting leg 716 in its extended position with front segment 718 angling downwardly therefrom. Position P6 is the same as P5 except that front segment 718 has been rotated as indicated by Arrow X 180 degrees so that front segment 718 angles upwardly relative to mounting leg 716. FIG. 31 also illustrates with reference to position to P5 that the portion of mounting leg 716 extending forward from sleeve 706 forms an angle $V_b$ with each of legs 704 and 392. Angle $V_b$ may vary but is in the exemplary embodiment 135 degrees and thus the sum of angles V and $V_b$ is in the exemplary embodiment 180 degrees. In addition, angle $V_b$ is in the exemplary embodiment substantially equal to angle $V_a$.

Figures 32, 33:
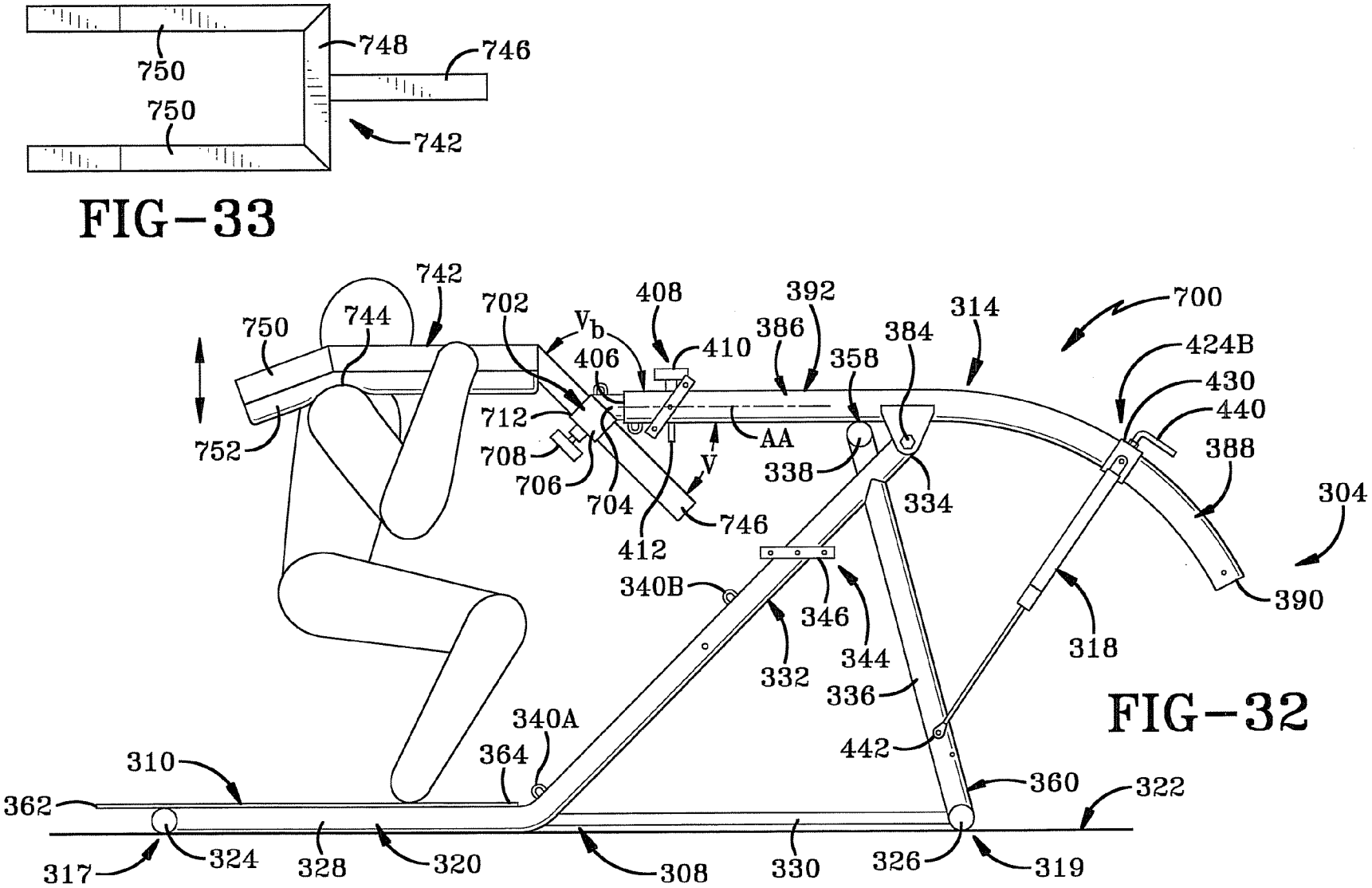
FIG. 32 is similar to FIG. 30 and shows the forked shoulder attachment mounted on the adapter.
FIG. 33 is a top plan view of the forked shoulder attachment.
Figure 34:
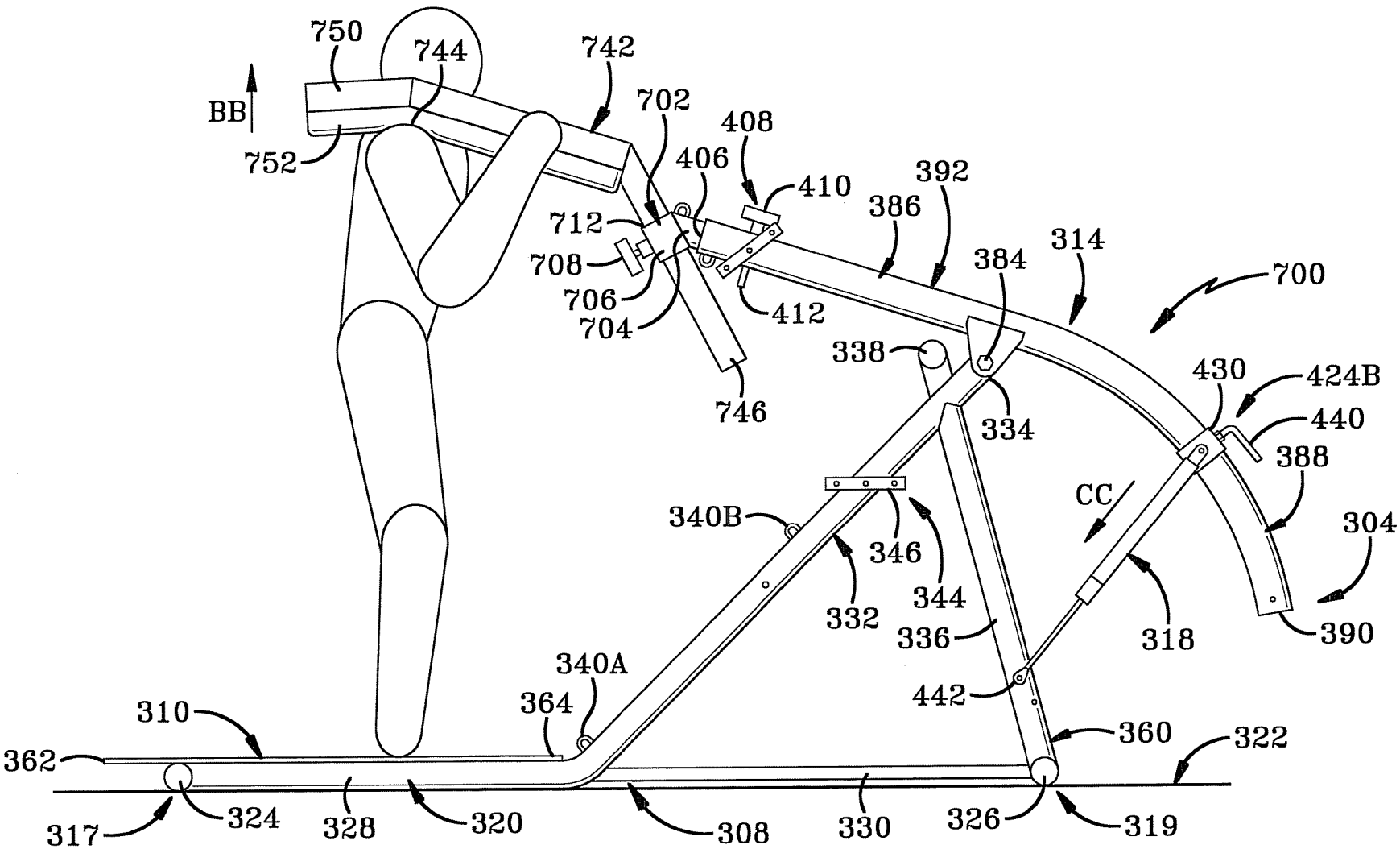
FIG. 34 is similar to FIG. 32 and shows the shoulder attachment having moved up to pivot the front portion of the pivot arm upwardly.

FIG. 32 shows adapter 702 in an alternate position with mounting leg 716 rotated about its longitudinal axis AA 180 degrees from the positions shown in FIGS. 30-32 so that through bore 712 of sleeve 706 extends perpendicular to the positions shown in FIGS. 30-32. FIG. 32 also shows adapter 702 securing another operator engagement device in the form of a shoulder engageable fork or support 742 for engagement with shoulders 744 of the user or operator of machine 700. Shoulder support 742 includes a mounting leg 746 and a U-shaped fork having a base 748 connected to and extending perpendicular to leg 746 and a pair of spaced arms 750 connected to and extending forward from base 748. Respective pads 752 are mounted on the lower surfaces of arms 750 to provide a cushioned operator engagement surface for engagement with shoulders 744. Mounting leg 746 of shoulder support 742 angles downwardly and rearwardly from its front end to its rear end through bore 712 of sleeve 706 so that the rear portion of leg 746 extends directly below legs 716 and 392 and forms angle V with respect to mounting leg 716 and front leg 392, thus illustrating the 180 degree rotation of adapter 702 relative to that shown in FIG. 30 where angle V is disposed above mounting leg 716 and front leg 392. Mounting leg 746 of shoulder support 742 is substantially the same as mounting leg 716 of T-shaped handle 714 and illustrates that any of the attachments of machine 700 may be mounted in the alternate rotated position relative to adapter 702 and that adapter 702 may be mounted with each of these attachments if desired in its alternate rotated positions. FIG. 34 shows the operator standing up so that shoulders 744 apply an upward force indicated at Arrow BB on shoulder support 742 in order to pivot the front of pivot arm 314 upwardly and the rear of pivot arms 314 downwardly to compress gas spring 318 as indicated at Arrow CC.

Figure 35:
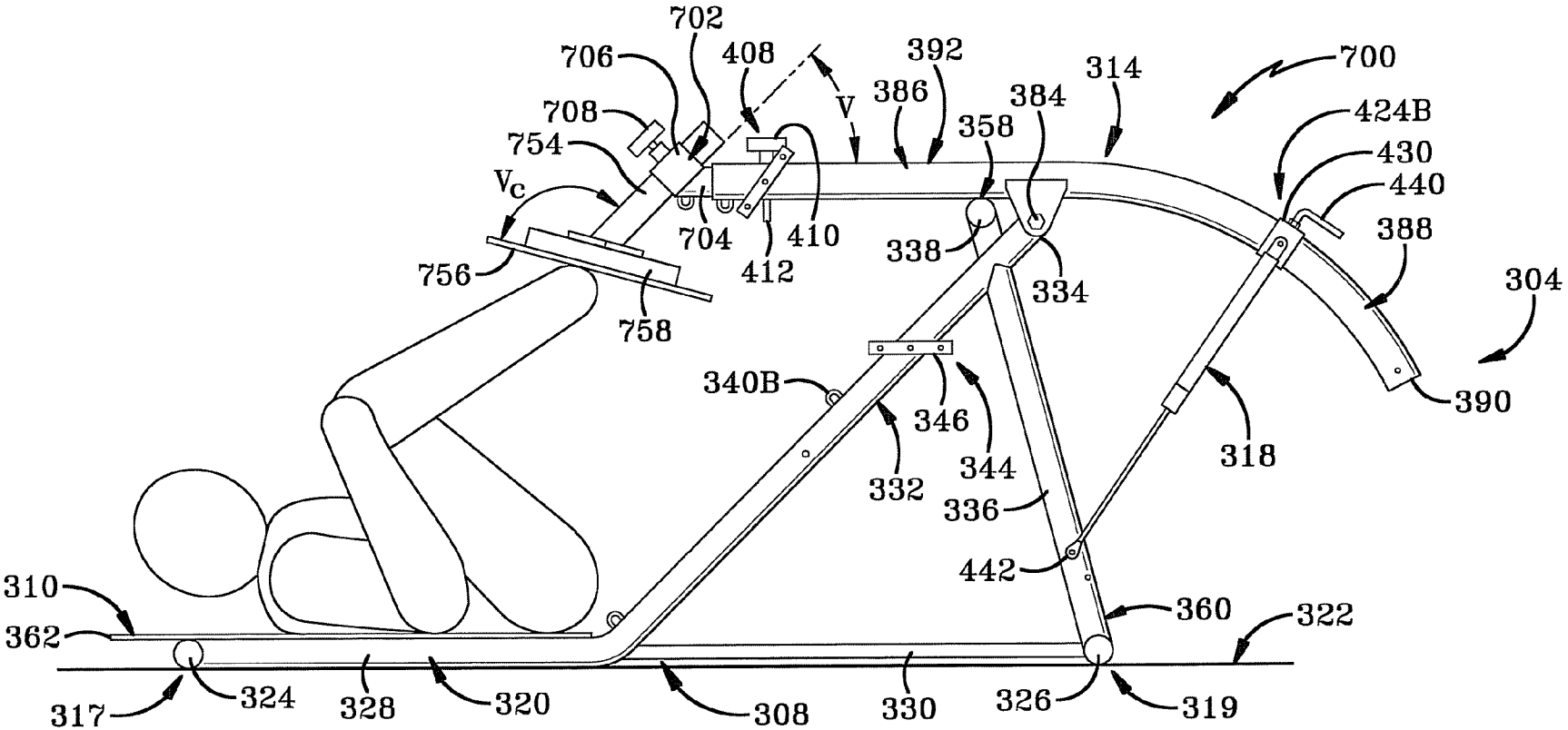
FIG. 35 is similar to FIG. 32 and shows the foot plate mounted on the adapter.
Figure 36:
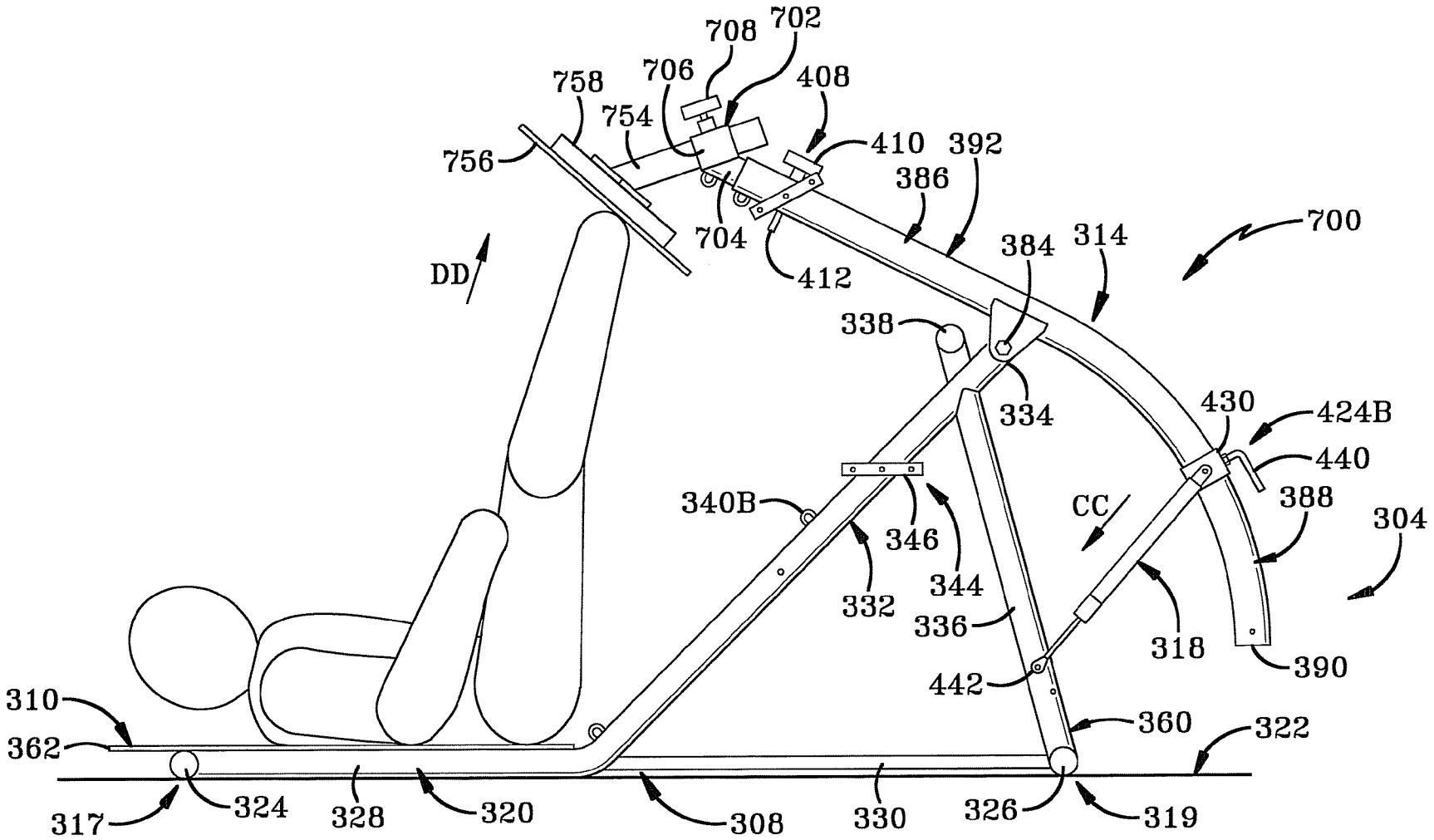
FIG. 36 is similar to FIG. 35 and shows the foot plate having moved upwardly to pivot the forward portion of the pivot arm upwardly.

FIG. 35 shows another attachment or operator engagement device used with adapter 702 in the form of a foot engagement device comprising a mounting leg 754 and a flat foot plate 756 secured to mounting leg 754 by suitable mounting structure 758. Mounting leg 754 is secured within sleeve 706 in the same manner as the mounting legs of the other attachments. FIG. 35 shows adapter 702 with sleeve 706 mounted in the position shown in FIGS. 30-32 so that the rear portion of mounting leg 754 forms angle V above mounting leg 716 and front leg 392. The front portion of foot plate 756 and mounting leg 754 define therebetween an angle $V_c$ which is somewhat less than angle $V_a$. Thus, foot plate 756 is not parallel to mounting leg 716 or leg 392 of pivot arm 319, but angles from its rear to its front slightly upwardly relative to horizontal when machine 700 is in the position shown in FIG. 35. This configuration better accommodates engagement with the operator's feet. FIG. 36 shows the operator with his or her back on platform 310 and extending his or her legs upwardly to provide with his or her feet an upward force shown at Arrow DD on the operator engagement surface of foot plate 756 in order to pivot the pivot arm 314 about pivot 384 to compress gas spring 318.

Figure 37:
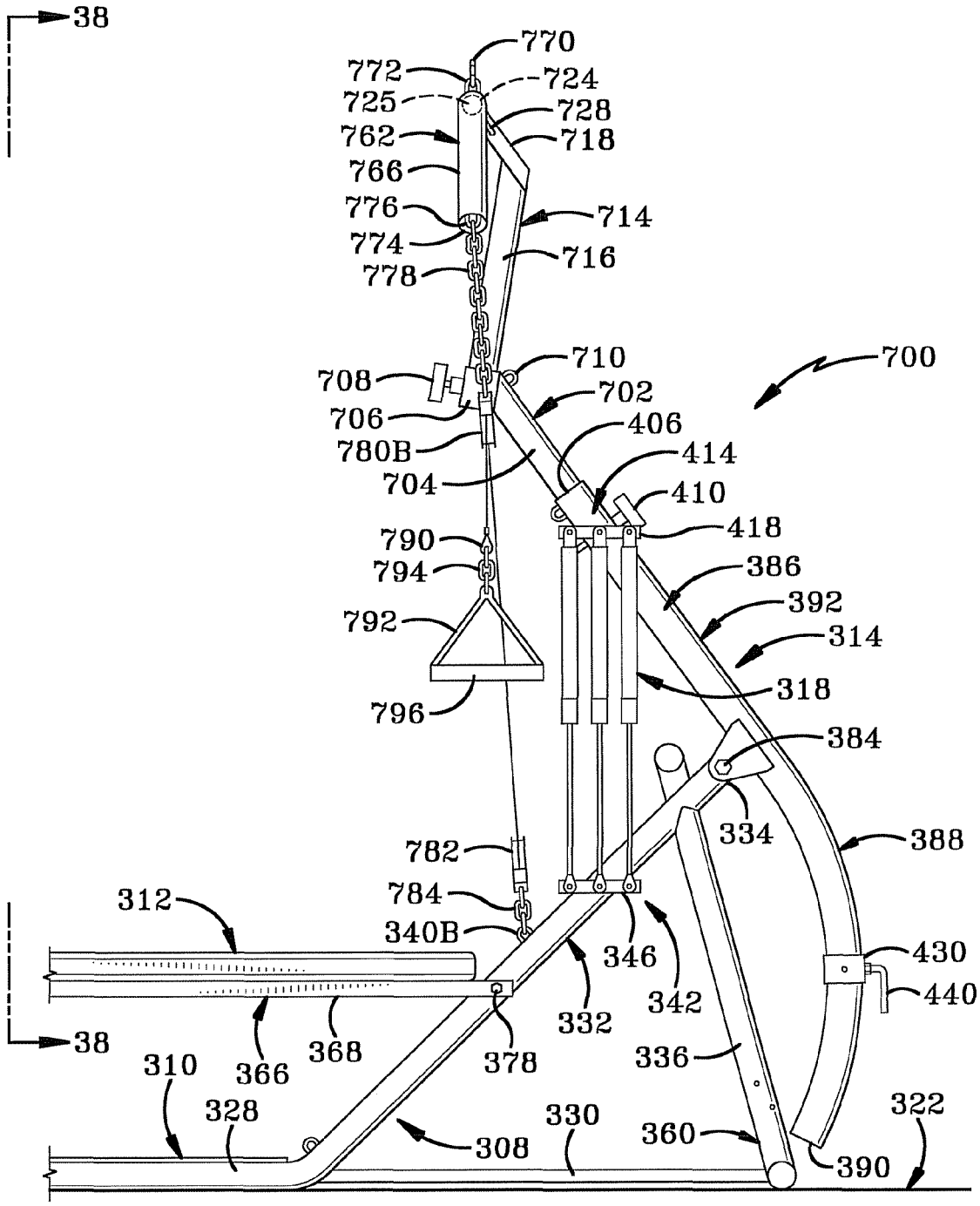
FIG. 37 is a side elevational view of the rear portion of the sixth embodiment with the pivot arm abutting the second stop, extender arms mounted on the T-shaped handle and the free floating cable-pulley assembly mounted on the frame and extender arms.

FIGS. 37 and 38 show a cable-pulley assembly in its home position mounted on T-shaped handle 714 by first and second extenders or extender bars 760 and 762. Each of the extender bars includes a straight first inner segment or leg 764 and a second outer segment or leg 766 connected to the outer end of inner leg 764 and extending outwardly and downwardly therefrom. Each inner leg 746 defines an interior chamber 768 which typically extends all the way through leg 764 for slidably receiving therein a respective one of first legs 722 and 724 of crossbar 720. A securing mechanism is provided to secure first and second extender bars 760 and 762 to one another and handle 714 to prevent them from sliding off of legs 722 and 724. More particularly, a pair of rings 770 such as those used in mountain climbing and known as carabiners are clipped to one another and respectively to a pair of D-rings or loops 772 adjacent the inner ends of inner legs 764. Rings 770 include openable and closeable spring-loaded arms for removable connection of rings 770 to one another and D-rings 772. Other securing mechanisms may be used for this purpose. Each second leg 766 is connected to and extends at an angle downwardly from the outer end of each inner leg 764 and terminates in a respective terminal end 774 positioned laterally outwardly of respective ends 723 and 725 of legs 722 and 724. A D-ring or other closed loop 776 is rigidly connected to each outer leg 766 at terminal end 774. A flexible elongated suspension member shown here in the form of a chain 778 is connected to and hangs downwardly from each D-ring 776. Other flexible elongated members may be used besides a chain, such a short length of cable, rope, synthetic line and so forth. Pulleys 780A and 780B are connected to the bottom of respective chains 778 so that each pulley 780 hangs from or is suspended from the respective D-ring 776 in a manner that allows it pivot or swivel in any direction therefrom. Another pulley 782 is connected to D-ring 340B by a short segment of chain 784 so that pulley 782 is likewise able to swivel with respect to D-ring 340B. A cable or other suitable line 786 is mounted on pulleys 780 and 782 and includes an elongated flexible body with first and second ends 788 and 790. Cable 786 extends upwardly from first end 788 to the pulley 780A so that cable 786 wraps over and engages pulley 780A, then downwardly to and below pulley 782 in engagement therewith, then upwardly and over pulley 780B and then downwardly to second end 790. First and second triangular shaped handles 792 are suspended from each end 788 and 790 of cable 786 via a pair of short segments of chain 794. Each handle includes a hand grip 796. FIGS. 37 and 38 show adapter 702 in a partially extended position with T-shaped handle 714 in a fully extended position and front leg angling forward from mounting leg 716.

Figure 39:
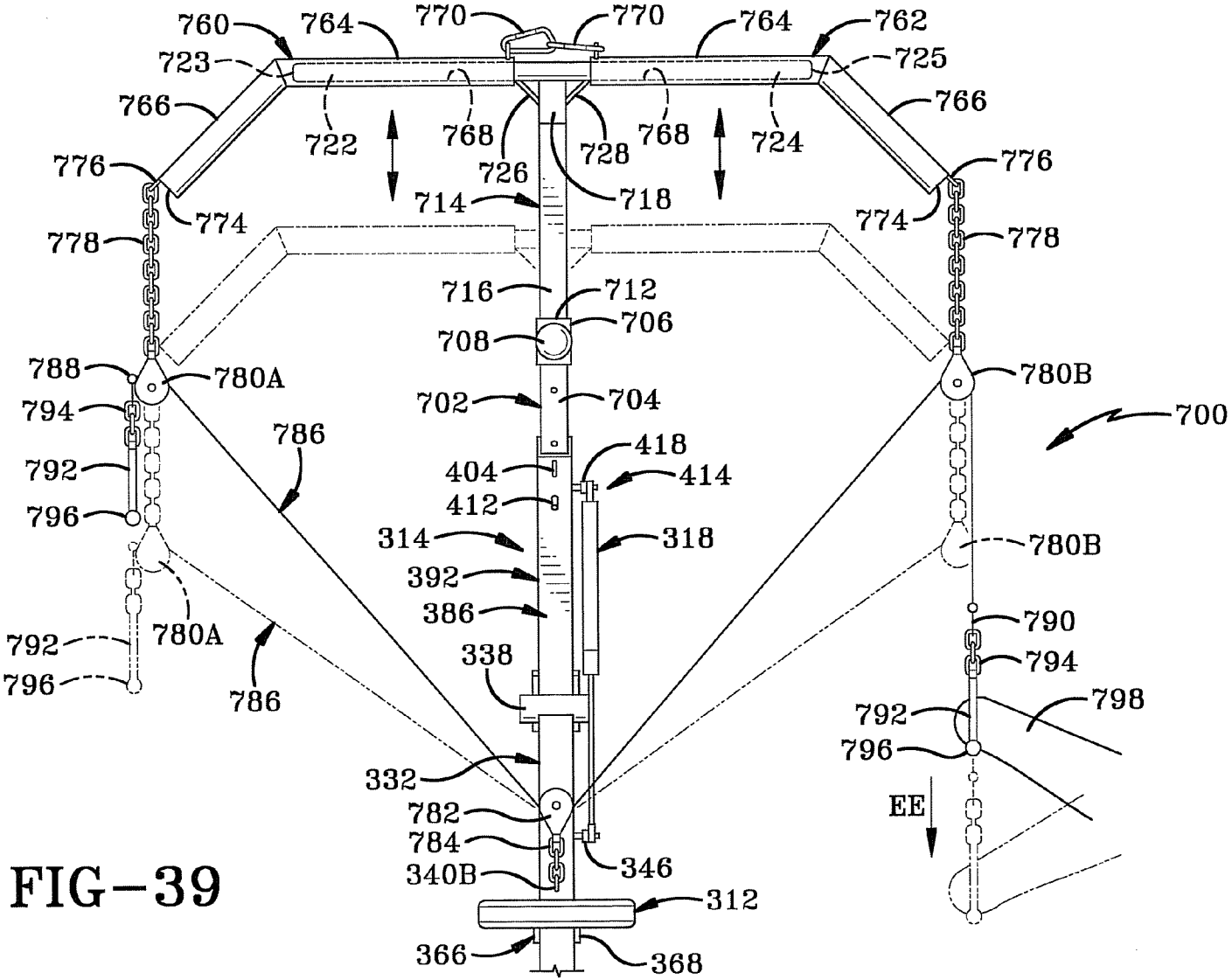
FIG. 39 is similar to FIG. 38 and shows one handle of the cable-pulley assembly being operated to pivot the front portion of the pivot arm downwardly.
Figure 40:
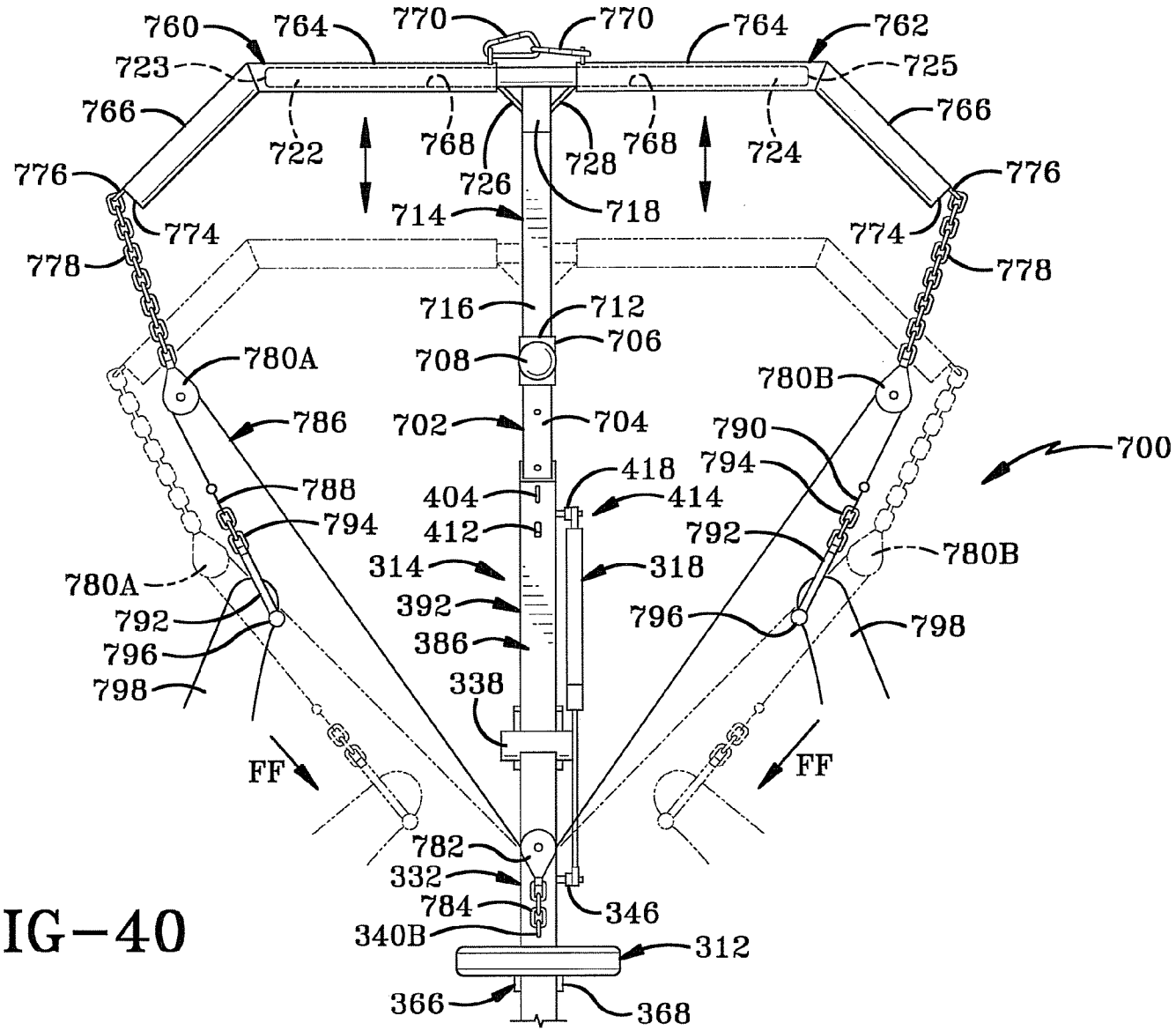
FIG. 40 is similar to FIG. 39 and shows both handles of the cable-pulley assembly being pulled forward and generally toward one another to pivot the front of the pivot arm downwardly.
Figure 41:
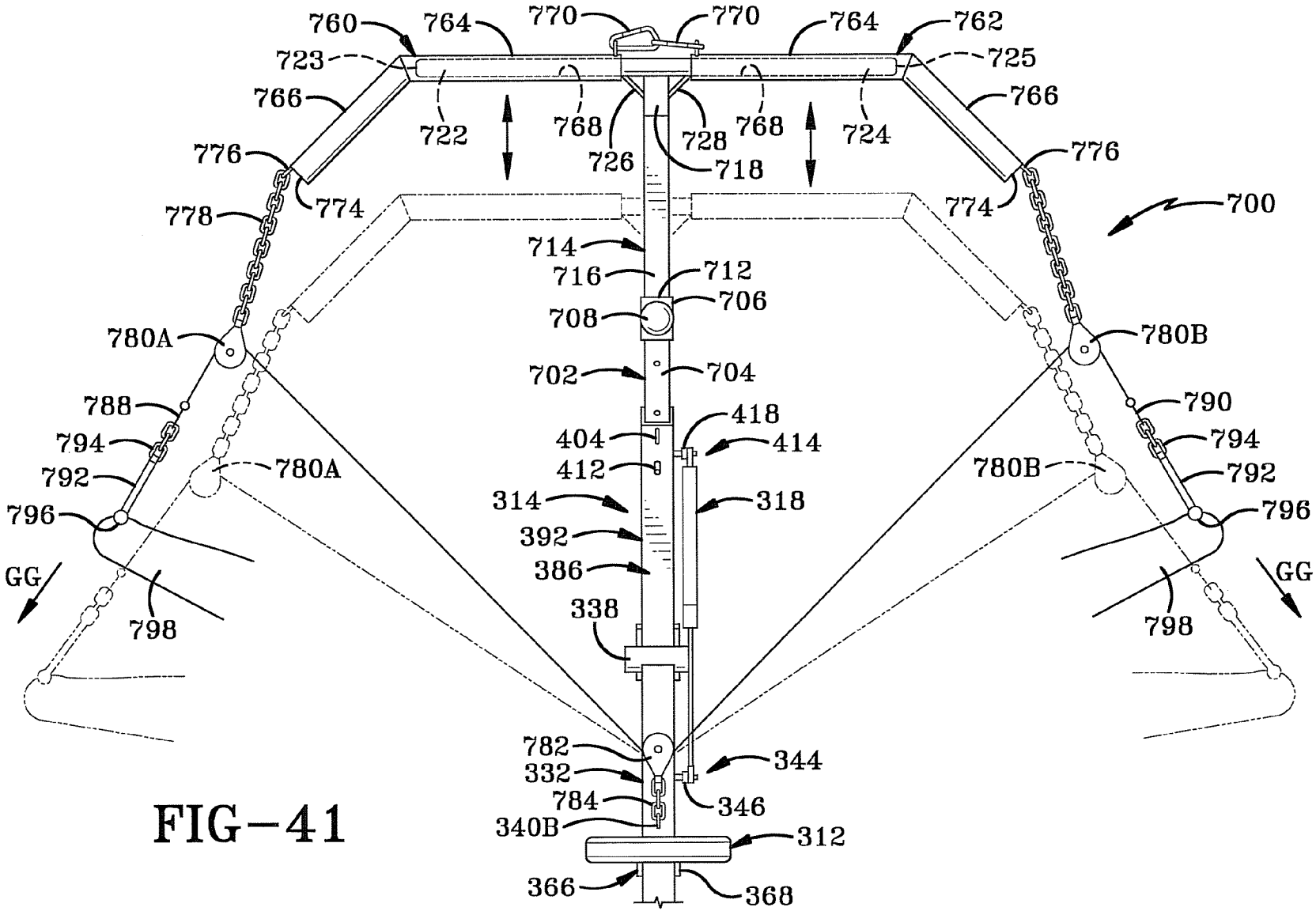
FIG. 41 is similar to FIG. 40 and shows both handles of the cable-pulley assembly being pulled forward and generally outwardly to pivot the front of the pivot arm downwardly.

FIGS. 39-41 show the operation of the cable-pulley assembly described above with reference to FIGS. 37-38. In particular, FIG. 39 shows the cable-pulley assembly being operated by a single one of handles 792. More particularly, FIG. 39 shows a hand 798 manually engaging grip 796 of the handle 792 which is suspended from second extender bar 762 and pulling typically downwardly as indicated at Arrow EE. This downward force causes cable 786 to shift positions relative to pulleys 780 and 782 so that pulley 780A serves as a stop to the movement of cable 786 relative to said pulley 780A as a result of the engagement of pulley 780A and one of the handle 792 attached to first end 788 of cable 786, the chain 794 associated therewith and a portion of cable 786 adjacent end 788. The continued downward force represented at Arrow EE then causes the downward pivotal movement of the front of pivot arm 314 along with extender bars 760 and 762, chains 778 and pulleys 780 as indicated by the phantom lines in FIG. 39.

FIG. 40 shows an alternate operation in which two hands 798 are used to engage the grips 796 of each handle 792 and apply a downward, inward and forward force as indicated at Arrows FF. That is, each handle 792 is pulled downwardly, inwardly toward the other and forward relative to the frame of machine 700. This is illustrative of the operator sitting on bench 312 and facing toward the rear of the machine. In this operation, neither of handles 792 or the associated structure engages either of pulleys 780. This inward, downward and forward force represented at Arrows FF likewise pulls the front of pivot arm 314 to pivot downwardly along with the T-shaped handle and respective extender bars 760 and 762 etc. against the force of gas springs 318.

FIG. 41 shows a similar operation illustrative of the operator sitting on bench 312 and facing forward with his or her back toward pivot 384 and the rear of the machine. Once again two hands 798 engage the respective grips 796 of handle 792 but in this scenario the handles are pulled downwardly, outwardly away from one another and forward as indicated at Arrows GG. This downward and outward force illustrated at Arrows GG once again causes the front of pivot arm 314 to pivot downwardly along with extender bars 760 and 762 and the associated structure.

Figure 42:
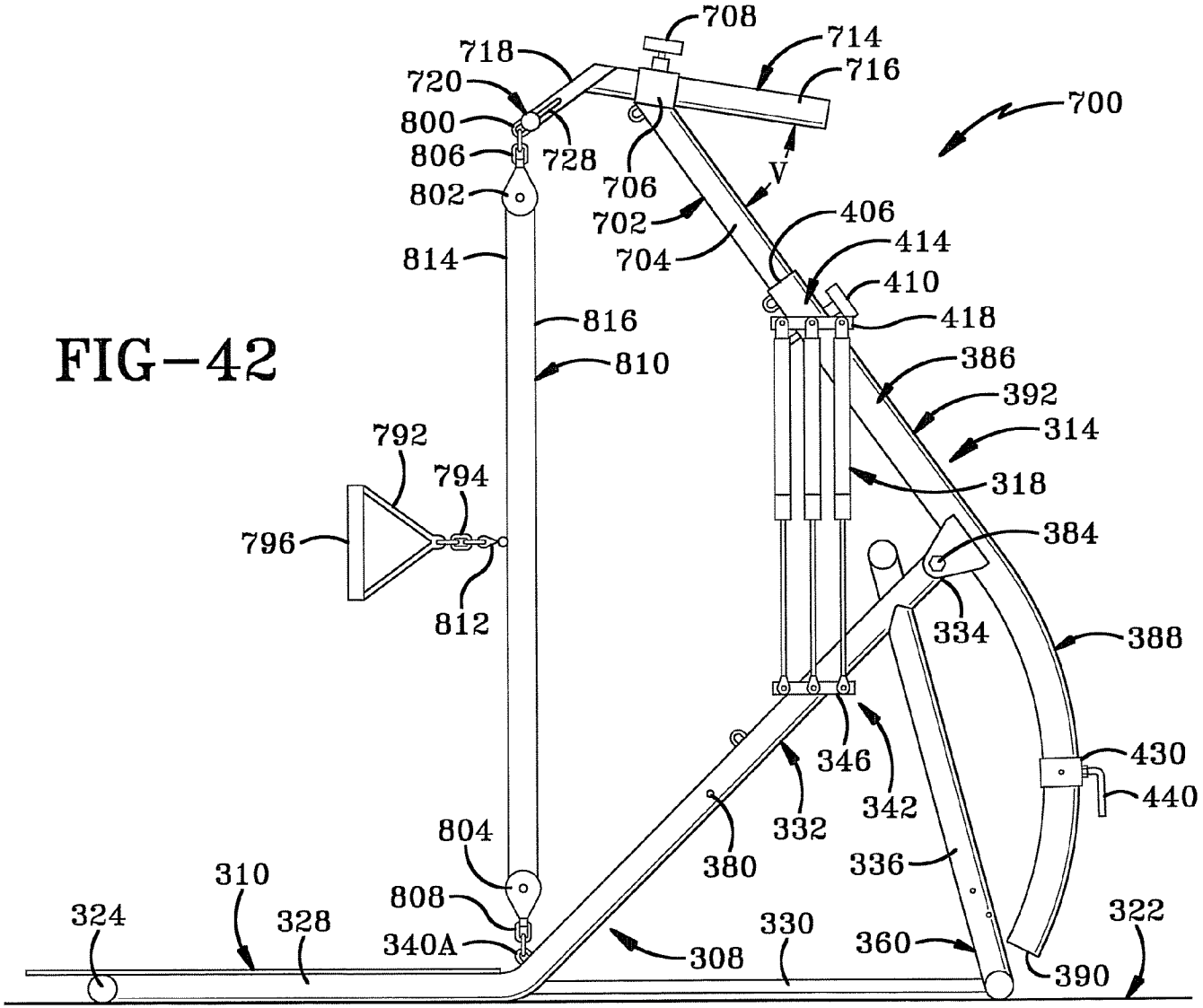
FIG. 42 is a side elevational view of the sixth embodiment with the pivot arm abutting the second stop and with the closed loop cable-pulley assembly secured to the frame and T-shaped handle in the home position.
Figure 43:
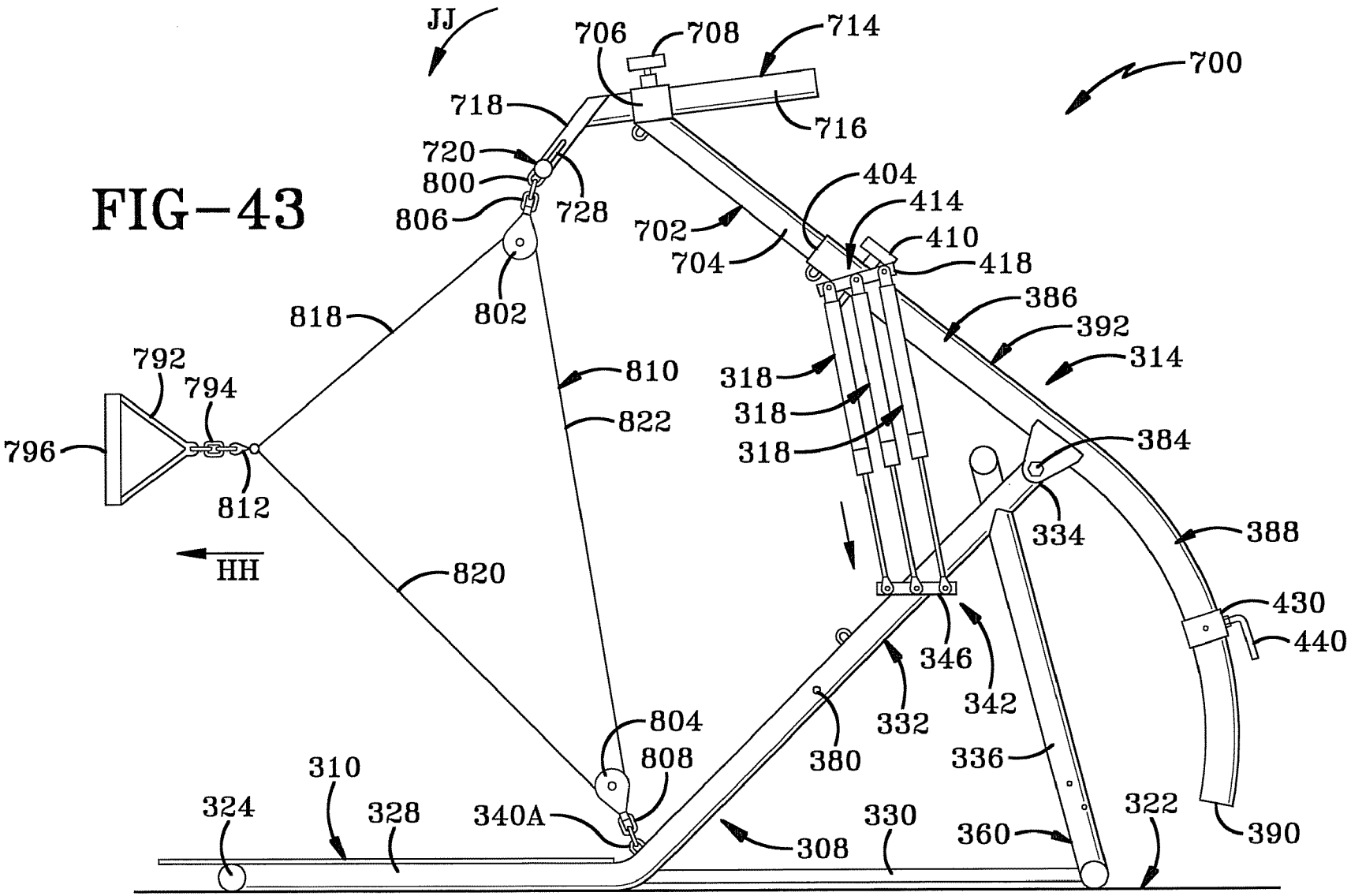
FIG. 43 is similar to FIG. 42 and shows the forward movement of the handle of the closed loop cable-pulley assembly to pivot the front of the pivot arm downwardly.

FIGS. 42 and 43 show machine 700 using a closed loop cable-pulley assembly. Pivot arm 314 is positioned at a home position with terminal end 390 abutting the second stop in FIG. 42. Adapter 702 is positioned so that when mounting leg 716 of T-shaped handled 714 is inserted through sleeve 706, leg 716 extends over adapter 702 to define therebetween angle V. Front leg 718 angles downwardly relative to mounting leg 716 and at a right angle to legs 704 and 392. A closed loop or D-ring 800 is connected to and extends forward from crossbar 720 at its midpoint to provide a pulley mounting location although rod 726 or 728 may be used for this purpose as well. The closed loop cable-pulley assembly includes an upper pulley 802 and a lower pulley 804. Pulley 802 is connected to D-ring 800 via a short segment of chain 806 and lower pulley 804 is likewise connected to ring 340A by a short segment of chain 808. A closed loop of cable 810 loops around and engages each of pulleys 802 and 804 so that said pulleys roll in response to movement of cable 810. A mounting ring or loop 812 is secured to cable 810 for mounting thereon one of triangular handles 792 via chain 794. More particularly, the closed loop of cable 810 in the home position shown in FIG. 42 shows two generally parallel vertically oriented segments 814 and 816 each extending from upper pulley 802 to lower pulley 804. Handle 792 is connected to segment 814 generally around the midpoint between pulleys 802 and 804. As shown in FIG. 43, an outward manual force may be applied to grip 796 of handle 792 (Arrow HH) so that the front of pivot arm 314 and pulley 802 pivot downwardly (Arrow JJ) toward pulley 804 and the front of frame 308, thus moving the closed loop cable-pulley assembly out of its home position. During this movement of handle 792, cable 810 forms a triangular shape including a front upper segment 818 extending from upper pulley 802 to mounting loop 812, a front lower segment 820 extending from lower pulley 804 to mounting loop 812 and a rear segment 822 extending from upper pulley 802 to lower pulley 804.

Figure 44:
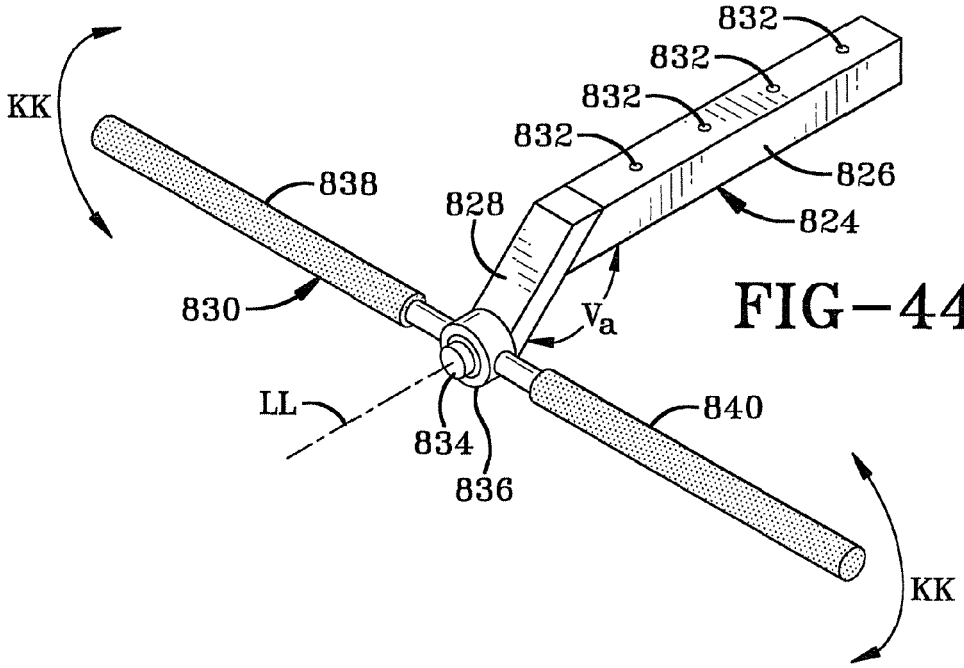
FIG. 44 is perspective view of an alternate T-shaped handle in which the crossbar is pivotable about a single axis perpendicular to the crossbar.

FIG. 44 shows an alternate T-shaped handle 824 which is similar to handle 714 and includes a straight mounting leg 826, a front leg 828 connected to the front of mounting leg 826 and angling downwardly therefrom in a manner analogous to front leg 718 relative to mounting leg 716, and a crossbar 830 pivotally connected to front leg 828 to pivot about axis LL as shown at Arrows KK. Axis LL in the exemplary embodiment is parallel to mounting leg 826. A plurality of adjustment holes 832 are formed in mounting leg 826 and spaced from one another longitudinally from the front to the rear of mounting leg 826. Adjustment holes 832 represent the adjustment holes formed in the other mounting legs from the various other attachments previously discussed although those holes were not shown. Holes 832 are configured to receive the rod or pin extending from handle 708 (FIG. 30) or a like mounting mechanism in order to secure mounting leg 826 at the various positions of extension and retraction relative to sleeve 708 of adapter 702. Alternately, mounting leg 826 (like the mounting legs of the other attachments described herein) may be received within front leg 392 of pivot arm 314 and secured by rod 412 of mounting mechanism 408 in the various positions of extension or retraction thereof. A short shaft 834 is connected to and extends forward from the lower front end of front leg 828. Crossbar 830 includes a generally cylindrical collar 836 which is rotatably mounted on shaft 834 with or without roller bearings or ball bearings to pivot about axis LL. Crossbar 830 further includes first and second segments or legs 838 and 840 which are connected to and extend in opposite directions from collar 836 and are typically straight and substantially collinear. The pivotal movement of crossbar 830 about axis LL (which passes through shaft 834) provides exercise machine 700 with a feel which is more similar to the lifting of free weights than that of standard exercise machines.

Figure 45:
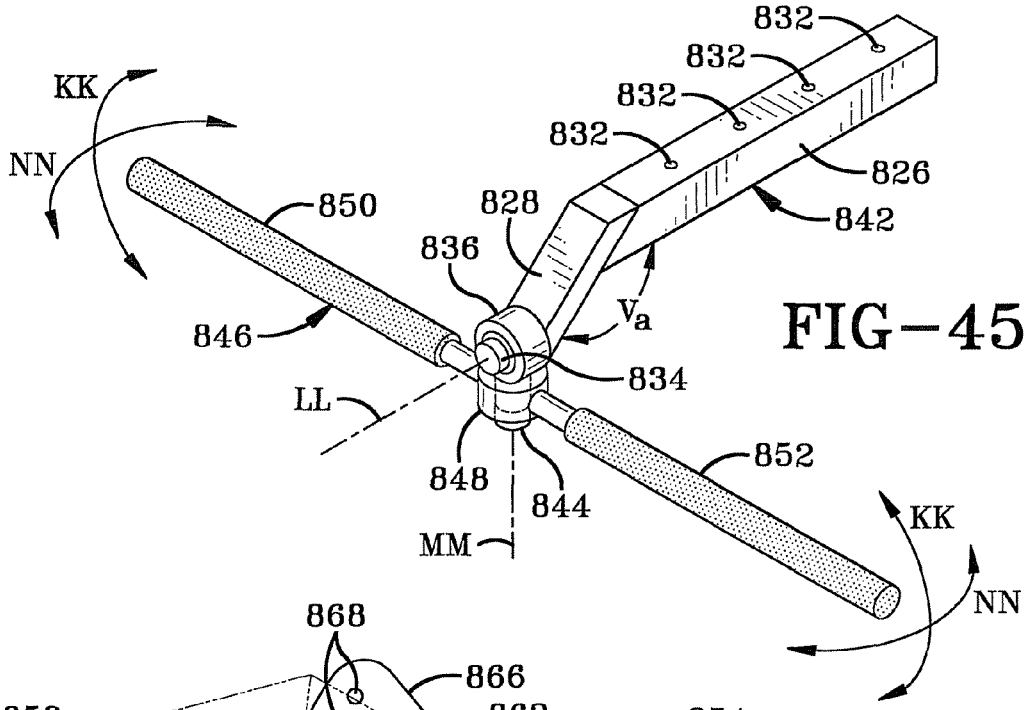
FIG. 45 is similar to FIG. 44 and shows an alternate embodiment of the T-shaped handle in which the crossbar is pivotable about first and second axes which are perpendicular to one another and the crossbar.

FIG. 45 illustrates another T-shaped handle 842 which is similar to handle 824 in that it allows the crossbar to pivot about axis LL, but also allows it to pivot about axis MM which is perpendicular axis LL in the exemplary embodiment. Thus, handle 842 includes mounting leg 826, front leg 828, shaft 834 and collar 836. In addition, handle 842 includes another shaft 844 which is connected to and extends downwardly from collar 836 perpendicular to shaft 834. Handle 842 also includes a straight crossbar 846 comprising a cylindrical collar 848 pivotally mounted on shaft 844 about axis MM. Crossbar 846 also includes first and second straight legs 850 and 852 which are connected to and extend in opposite direction from collar 848. Crossbar 846 pivots about axis MM as indicated at Arrows NN and also provides a feel to machine 700 which is more similar to the lifting of free weights than that of standard exercise machines.

Figure 46:
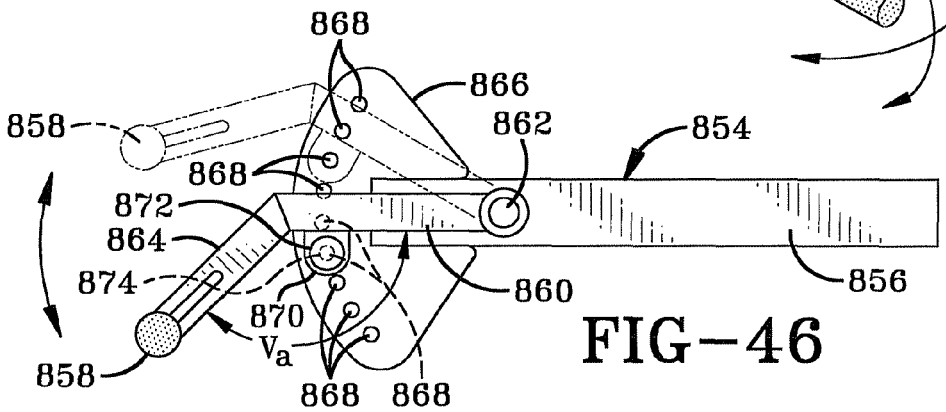
FIG. 46 is a side elevational view of an alternate T-shaped handle in which the crossbar and front portion of the handle are pivotally adjustable relative to its mounting leg.

FIG. 46 illustrates another T-shaped handle 854 which includes a mounting leg 856 similar to mounting leg 826 and a crossbar 858 which is similar to the earlier discussed crossbars of the various T-shaped handles and which is pivotally adjustable between a plurality of positions relative to mounting leg 856. Handle 854 further includes an intermediate leg 860 which is pivotally connected adjacent its rear end to mounting leg 856 adjacent its front end via a pivot 862. A front leg 864 is connected to the front of intermediate leg 806 and angles downwardly therefrom with crossbar 858 connected to the front end of front leg 864 and extending perpendicular thereto as in the pervious embodiments of the T-shaped handles. An adjustment plate 866 is rigidly connected to the front end of mounting leg 856 extending forward thereof as well as upwardly and downwardly thereof. A plurality of holes 868 is formed in plate 866 and are generally vertically spaced from one another along an arc of a circle concentric with pivot 862. A mounting projection 870 is rigidly connected to intermediate leg 860 adjacent its front end extending downwardly therefrom a short distance. A handle 872 with a pin 874 extending outwardly therefrom is movably mounted on projection 870 for selective insertion into one of holes 868 to provide a securing mechanism for securing crossbar 858 relative to mounting leg 856 at a selected one of the various positions associated with the pivotal movement of crossbar 858 and legs 860 and 864 relative to mounting leg 856. The pivotal adjustment and ability to secure crossbar 858 in various locations relative to mounting leg 856 allows the user of machine 700 to quickly adjust the position of crossbar 858 to a suitable location depending on the specific exercise to be performed on machine 700.

Figure 47:
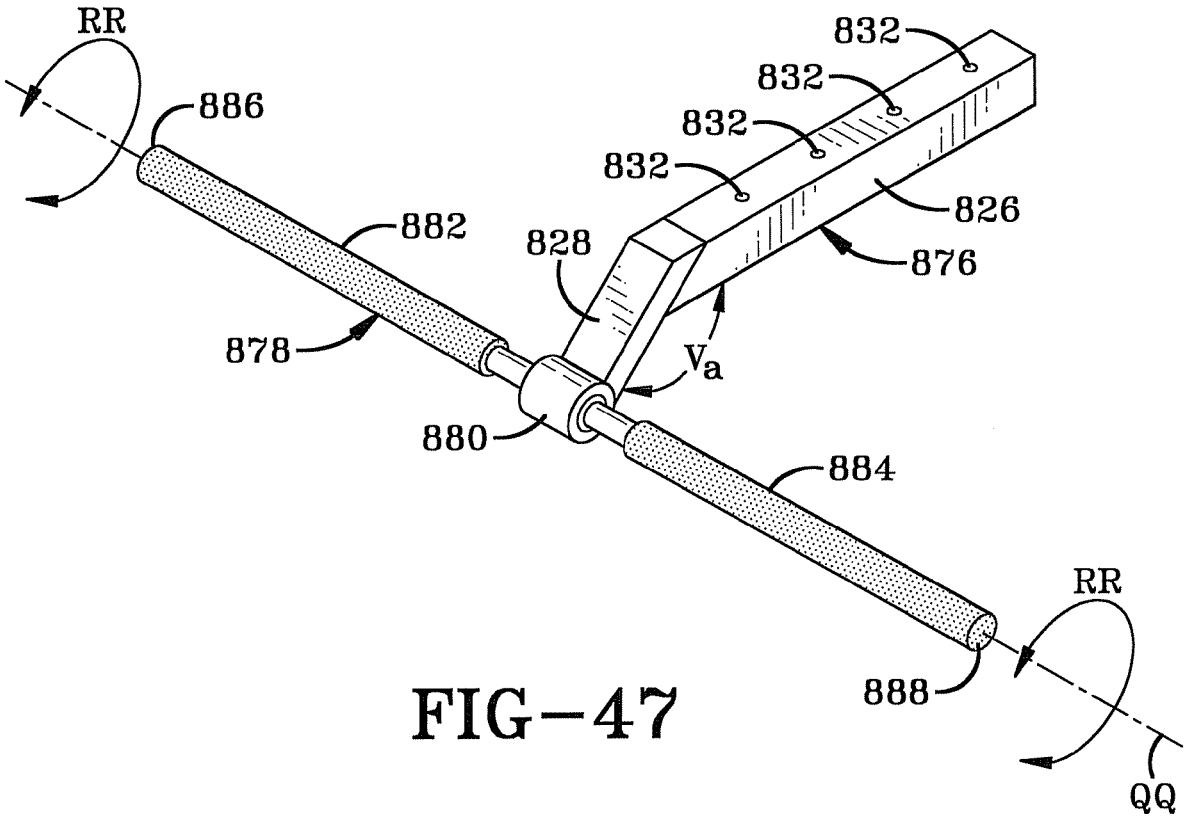
FIG. 47 is a perspective view of an alternate embodiment of a T-shaped handle in which the crossbar is pivotable about its longitudinal axis.

FIG. 47 shows another T-shaped handle 876 comprising mounting leg 826, front leg 828 and a crossbar 878 which is rotatable about a longitudinal axis QQ extending along the length of crossbar 878. More particularly, a collar 880 is rigidly mounted on the front lower end of front leg 828 for rotatably receiving therein a central portion of crossbar 878, which includes first and second segments or legs 882 and 884 extending outwardly from collar 880 in opposite directions. Thus, crossbar 878 has first and second opposed ends 886 and 888 defining therebetween the length of crossbar 878 so that axis QQ passes through ends 886 and 888 and crossbar 878 is rotatable in a rolling type motion about axis QQ as indicated at Arrows RR. This rotatable motion of crossbar 878 also provides a feel which is more like lifting free weights than that of standard exercise machines. The rotational movement of crossbar 878 may be combined with the pivoting or rotating movement of handles 830 and 846 as well.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. An exercise machine comprising:

a frame;

a pivot arm pivotally mounted on the frame about a pivot axis;

a resistance mechanism mount;

a resistance mechanism mounted on the resistance mechanism mount for resisting pivotal movement of the pivot arm;

an adapter mounted on the pivot arm and selectively adjustable relative to the pivot arm between a plurality of adapter positions;

a first securing mechanism for securing the adapter to the pivot arm at a selected one of the adapter positions;

an operator engagement device mounted on the adapter and selectively adjustable relative to the adapter between a plurality of engagement device positions; and a second securing mechanism for securing the engagement device to the adapter at a selected one of the engagement device positions; and wherein the adapter is telescopically mounted on the pivot arm so that the adapter is telescopically extendable and retractable along a first axis;

the second securing mechanism has an unsecured position in which the operator engagement device is rotatable relative to the adapter and a secured position in which the operator engagement device is secured against rotation relative to the adapter;

when the second securing mechanism is in its unsecured position, the engagement device is rotatable relative to the adapter about a second axis between a first engagement device position and a second engagement device position rotated 180 degrees about the second axis relative to the first engagement device position;

the first and second axes are fixed relative to one another and define therebetween a fixed angle;

the engagement device is in the form of a T-shaped handle having first and second segments which extend outwardly in opposite directions from one another and serve as respective hand grips of the engagement device; and the hand grips are above the second axis in the first engagement device position and below the second axis in the second engagement device position.

2. The exercise machine of claim 1 wherein the operator engagement device is telescopically mounted on the adapter to extend and retract along the second axis.

3. The exercise machine of claim 1 wherein the adapter is rotatable relative to the pivot arm about the first axis.

4. The exercise machine of claim 3 wherein the angle is approximately 135 degrees.

5. The exercise machine of claim 3 wherein the adapter has a first adapter position and a second adapter position rotated 180 degrees about the first axis relative to the first adapter position.

6. The exercise machine of claim 1 further comprising a straight segment on the pivot arm; a first leg on the engagement device mounted on the adapter; a second leg on the engagement device connected to and angling outwardly from the first leg; and wherein the adapter has a first position in which the second leg is perpendicular to the straight segment and a second position in which the second leg is parallel to the straight segment.

7. The exercise machine of claim 1 further comprising a first leg on the engagement device; a straight leg on the adapter; and wherein when the engagement device is in the first position the first leg is perpendicular to the straight leg and when the engagement device is in the second position the first leg is parallel to the straight leg.

8. The exercise machine of claim 7 further comprising a second leg on the engagement device connected to and angling outwardly from the first leg; and wherein the second securing mechanism selectively secures the second leg to the adapter.

9. The exercise machine of claim 1 further comprising a first straight leg on the adapter; and a second straight leg on the operator engagement device; and wherein the first axis is the longitudinal axis of the first leg and the second axis is the longitudinal axis of the second leg when the second leg is mounted on the adapter.

10. The exercise machine of claim 9 wherein the angle is approximately 135 degrees.

11. The exercise machine of claim 1 further comprising a sleeve on the adapter defining a passage; and a portion of the engagement device which is received in the passage and selectively secured to the sleeve by the second securing mechanism.

12. The exercise machine of claim 11 further comprising a first straight leg of the adapter having a first end; and wherein the first axis is the longitudinal axis of the first straight leg; the sleeve is fixedly secured to the first end of the first straight leg; and the portion of the engagement device is rotatable about the second axis within the sleeve passage.

13. The exercise machine of claim 1 wherein the entire adapter is fixed relative to the pivot arm when the first securing mechanism secures the adapter to the pivot arm.

14. The exercise machine of claim 1 wherein the engagement device comprises a first leg which is fixed relative to the pivot arm when the first securing mechanism secures the adapter to the pivot arm and the second securing mechanism secures the engagement device to the adapter.

15. The exercise machine of claim 14 wherein the engagement device comprises a second leg which is rigidly secured to and angles outwardly from the first leg so that the second leg is fixed relative to the pivot arm when the first securing mechanism secures the adapter to the pivot arm and the second securing mechanism secures the engagement device to the adapter.

16. The exercise machine of claim 15 wherein the second axis is the longitudinal axis of the second leg.

17. The exercise machine of claim 1 wherein the pivot arm is rotatable about the pivot axis between first and second pivot arm positions; and the first axis is horizontal in the first pivot arm position.

18. The exercise machine of claim 17 further comprising a straight segment of the pivot arm; wherein the adapter is telescopically mounted on the straight segment so that the adapter is telescopically extendable and retractable along the first axis; the frame has a front end and a rear end; the straight segment extends forward horizontally from adjacent the pivot axis in the first pivot arm position; and the straight segment extends forward and upwardly from adjacent the pivot axis in the second pivot arm position.

19. The exercise machine of claim 18 further comprising first and second stops on the frame; and wherein the straight segment rotates rearward and upward from the first pivot arm position to the second pivot arm position when the pivot arm rotates in a rearward direction; the straight segment rotates forward and downward from the second pivot arm position to the first pivot arm position when the pivot arm rotates in a forward direction opposite the rearward direction; the pivot arm engages the first stop in the first pivot arm position to limit rotation of the pivot arm in the forward direction; and the pivot arm engages the second stop in the second pivot arm position to limit rotation of the pivot arm in the rearward direction.

20. The exercise machine of claim 1 wherein the machine has a top and a bottom; and further comprising a horizontal standing platform mounted on the frame adjacent the bottom of the machine under the hand grips.

* * * * *